US007336026B2

(12) United States Patent
Takeuchi et al.

(10) Patent No.: US 7,336,026 B2
(45) Date of Patent: Feb. 26, 2008

(54) HIGH EFFICIENCY DIELECTRIC ELECTRON EMITTER

(75) Inventors: Yukihisa Takeuchi, Nishikamo-Gun (JP); Tsutomu Nanataki, Toyoake (JP); Iwao Ohwada, Nagoya (JP); Takayoshi Akao, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 473 days.

(21) Appl. No.: 10/950,976

(22) Filed: Sep. 27, 2004

(65) Prior Publication Data

US 2005/0104504 A1 May 19, 2005

Related U.S. Application Data

(63) Continuation-in-part of application No. 10/901,932, filed on Jul. 29, 2004, now abandoned, which is a continuation-in-part of application No. 10/877,517, filed on Jun. 25, 2004, now abandoned, which is a continuation-in-part of application No. 10/730,754, filed on Dec. 8, 2003, now Pat. No. 7,176,609, which is a continuation-in-part of application No. 10/678,958, filed on Oct. 3, 2003, now abandoned.

(30) Foreign Application Priority Data

Jun. 8, 2004 (JP) ..... 2004-169997

(51) Int. Cl.
*H01J 1/304* (2006.01)
*H01J 1/30* (2006.01)

(52) U.S. Cl. ..... 313/311; 313/310; 315/169.1; 315/169.3

(58) Field of Classification Search ..... 313/309–311; 315/169.1–169
See application file for complete search history.

(56) References Cited

U.S. PATENT DOCUMENTS

| | | | |
|---|---|---|---|
| 5,280,221 | A | 1/1994 | Okamoto et al. |
| 5,453,661 | A | 9/1995 | Auciello et al. |
| 5,508,590 | A | 4/1996 | Sampayan et al. |
| 5,666,019 | A | 9/1997 | Potter |

(Continued)

FOREIGN PATENT DOCUMENTS

| | | |
|---|---|---|
| DE | 3833604 | 4/1990 |

(Continued)

OTHER PUBLICATIONS

U.S. Appl. No. 10/459,415, filed Jun. 11, 2003, Takeuchi et al.

(Continued)

*Primary Examiner*—Karabi Guharay
(74) *Attorney, Agent, or Firm*—Burr & Brown

(57) ABSTRACT

An electron emitter has an emitter made of a dielectric material and an upper electrode and a lower electrode for being supplied with a drive voltage for emitting electrons. The upper electrode is disposed on an upper surface of the emitter, and the lower electrode is disposed on a lower surface of the emitter. The upper electrode has a plurality of through regions through which the emitter is exposed. Each of the through regions of the upper electrode has a peripheral portion having a surface facing the emitter and spaced from the emitter.

6 Claims, 49 Drawing Sheets

U.S. PATENT DOCUMENTS

| | | | | |
|---|---|---|---|---|
| 5,726,524 | A | 3/1998 | Debe | |
| 5,729,094 | A | 3/1998 | Geis et al. | |
| 5,747,926 | A | 5/1998 | Nakamoto et al. | |
| 5,874,802 | A | 2/1999 | Choi et al. | |
| 5,877,594 | A | 3/1999 | Miyano et al. | |
| 5,990,605 | A | 11/1999 | Yoshikawa et al. | |
| 6,040,973 | A | 3/2000 | Okamoto et al. | |
| 6,153,978 | A | 11/2000 | Okamoto | |
| 6,157,145 | A | 12/2000 | Vollkommer et al. | |
| 6,184,612 | B1 | 2/2001 | Negishi et al. | |
| 6,198,225 | B1 | 3/2001 | Kano et al. | |
| 6,274,881 | B1 | 8/2001 | Akiyama et al. | |
| 6,285,123 | B1 | 9/2001 | Yamada et al. | |
| 6,313,815 | B1 | 11/2001 | Takeda et al. | |
| 6,359,383 | B1 | 3/2002 | Chuang et al. | |
| 6,452,328 | B1 | 9/2002 | Saito et al. | |
| 6,469,452 | B2 | 10/2002 | Seo et al. | |
| 6,479,924 | B1 | 11/2002 | Yoo | |
| 6,580,108 | B1 | 6/2003 | Utsumi et al. | |
| 7,017,628 | B2 | 3/2006 | Najafi | |
| 7,071,628 | B2 * | 7/2006 | Takeuchi et al. | 315/169.1 |
| 2002/0060516 | A1 | 5/2002 | Kawate et al. | |
| 2002/0153827 | A1 | 10/2002 | Takeuchi et al. | |
| 2004/0061431 | A1 | 4/2004 | Takeuchi et al. | |
| 2004/0066133 | A1 | 4/2004 | Takeuchi et al. | |
| 2004/0090398 | A1 | 5/2004 | Takeuchi et al. | |
| 2004/0100200 | A1 | 5/2004 | Takeuchi et al. | |
| 2004/0104684 | A1 | 6/2004 | Takeuchi et al. | |
| 2004/0104689 | A1 | 6/2004 | Takeuchi et al. | |
| 2004/0104690 | A1 | 6/2004 | Takeuchi et al. | |
| 2004/0113561 | A1 | 6/2004 | Takeuchi et al. | |
| 2004/0256995 | A1 * | 12/2004 | Takeuchi et al. | 315/169.1 |

FOREIGN PATENT DOCUMENTS

| | | | |
|---|---|---|---|
| DE | 10057072 | | 5/2001 |
| EP | 0 353 632 | | 2/1990 |
| EP | 428853 | | 5/1991 |
| EP | 0 953 958 | A2 | 11/1999 |
| FR | 2639151 | | 5/1990 |
| FR | 2675306 | | 10/1992 |
| FR | 2789221 | | 8/2000 |
| FR | 2789223 | | 8/2000 |
| JP | 44-26125 | | 11/1969 |
| JP | 46-20944 | | 6/1971 |
| JP | 59-208587 | | 11/1984 |
| JP | 63-150837 | A | 6/1988 |
| JP | 1-311533 | A | 12/1989 |
| JP | 05-325777 | A1 | 12/1993 |
| JP | 7-147131 | A | 6/1995 |
| JP | 08-111166 | A1 | 4/1996 |
| JP | 09-090882 | A | 4/1997 |
| JP | 10-27539 | A | 1/1998 |
| JP | 11-185600 | | 7/1999 |
| JP | 11-288249 | A | 10/1999 |
| JP | 2000-285801 | A | 10/2000 |
| JP | 2000-310970 | A | 11/2000 |
| JP | 2001-035354 | | 2/2001 |
| JP | 3160213 | B2 | 2/2001 |
| JP | 3214256 | B2 | 7/2001 |
| JP | 2004-228064 | | 8/2004 |
| JP | 2004-228065 | | 8/2004 |
| WO | 02-052600 | A1 | 7/2002 |

OTHER PUBLICATIONS

U.S. Appl. No. 10/647,794, filed Aug. 25, 2003, Takeuchi et al.
U.S. Appl. No. 10/719,521, filed Nov. 21, 2003, Takeuchi et al.
U.S. Appl. No. 10/731,901, filed Dec. 9, 2003, Takeuchi et al.
U.S. Appl. No. 10/808,258, filed Mar. 24, 2004, Takeuchi et al.
U.S. Appl. No. 10/901,932, filed Jul. 29, 2004, Takeuchi et al.
U.S. Appl. No. 10/919,678, filed Aug. 17, 2004, Takeuchi et al.
U.S. Appl. No. 10/979,747, filed Aug. 17, 2004, Takeuchi et al.
"Pulsed Electron Source Using a Ferroelectric Cathode," Tokyo Institute of Technology, vol. 68, No. 5, Jan. 7, 1999, pp. 546-550.
Puchkarev, Victor F. and Mesyats, Gennady A., "On the Mechanism of Emission from the Ferroelectric Ceramic Cathode," Journal of Applied Physics, vol. 78, No. 9, Nov. 1, 1995, pp. 5633-5637.
Riege, H., "Electron Emission from Ferroelectrics—a Review," Nucl. Instr. and Meth. A340, 1994, pp. 80-89.
Masatoshi Miyake et al., "Electron Emission from Ferroelectric Cathodes Excited by Pulsed Voltage," Tokyo Institute of Technology, vol. 119, No. 5, 1999 pp. 622-627.
G. Benedek et al., "Electron Emission From Ferroelectric/Antiferroelectric Cathodes Excited by Short High-Voltage Pulses," Journal Applied Physics, vol. 81, No. 3, Feb. 1, 1997, pp. 1396-1403.
Gundel, H. et al., "Low Pressure Hollow Cathode Switch Triggered by a Pulsed Electron Beam Emitted From Ferroelectrics," Applied Physics Letter, American Institute of Physics, New York, US vol. 54, No. 21, May 22, 1989, pp. 2071-2073.
Gundel, H. et al., "Time-Dependent Electron Emission From Ferroelectrics by External Pulsed Electric Fields," Journal of Applied Physics, American Institute of Physics, New York, US vol. 69, No. 2, Jan. 15, 1991, pp. 975-982.
Kanemaru, Seigou, "Featuring: All About Flat Displays 2000, Leading Technological Trend of FEDs," Electronic Engineering, Nikkan Kogyo Shimbun, Ltd., Jul. 2000, pp. 38-41 (with partial translation).
U.S. Appl. No. 10/951,509, filed Sep. 28, 2004, Takeuchi et al.
U.S. Appl. No. 10/952,524, filed Sep. 28, 2004, Takeuchi et al.
U.S. Appl. No. 10/951,832, filed Sep. 28, 2004, Takeuchi et al.
Y. Takeuchi, T. Nanataki, I. Ohwada, "Novel Display Panel Utilizing Field Effect-Ferroelectric Electron Emitters", Proceedings of the 11th International Display Workshops, The Institute of Image Information and Television Engineers and The Society for Information Display, Dec. 8, 2004, 1193-1196.

* cited by examiner

FIG. 32

| | | CHARGE ACCUMULATION PERIOD | | LIGHT EMISSION PERIOD |
|---|---|---|---|---|
| | | ON | OFF | |
| | | 0～30[V] | 50[V] | 0[V] |
| SELECTION SIGNAL | 50[V] | -50～-20[V] | 0[V] | |
| NON-SELECTION SIGNAL | 0[V] | 0～30[V] | 50[V] | |
| ALL SELECTION SIGNAL | -350[V] | | | 350[V] |

10C electron charge in the emitter as a function of drive voltage

FIG. 41A (0) Keep data level 0.00
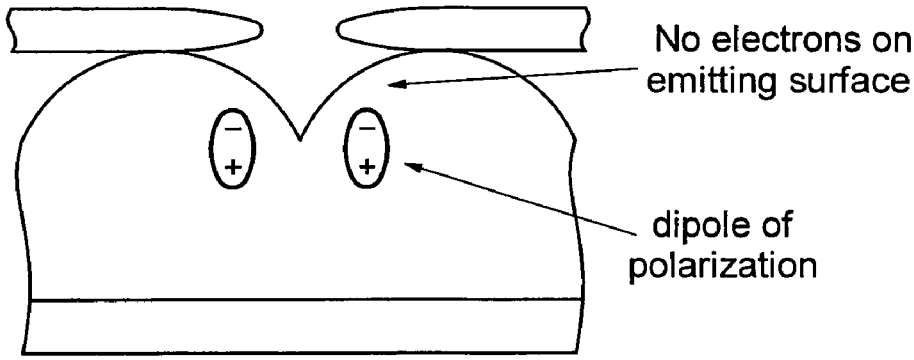
FIG. 41B (1-1) Getting into data set
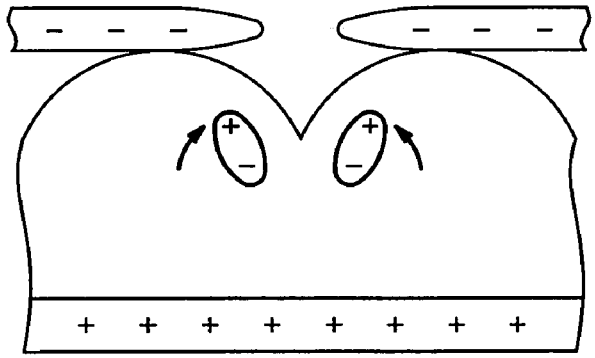
FIG. 41C
(1-2) Data set
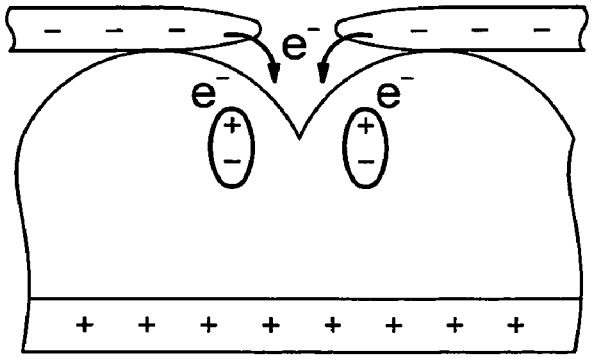

FIG. 42A (2) Keep data level 1.00
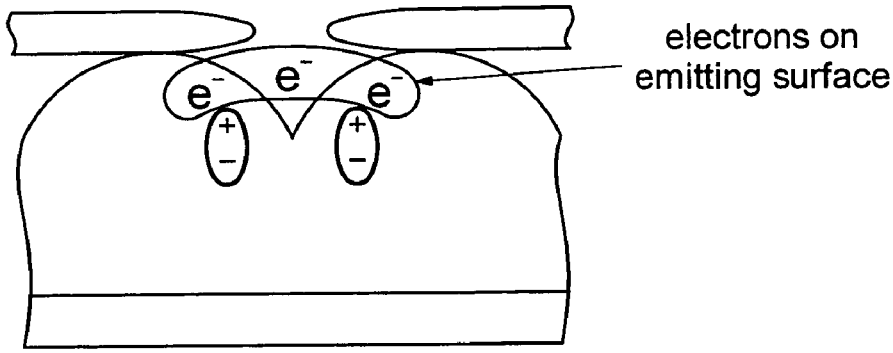
FIG. 42B (3-1) Getting into emission
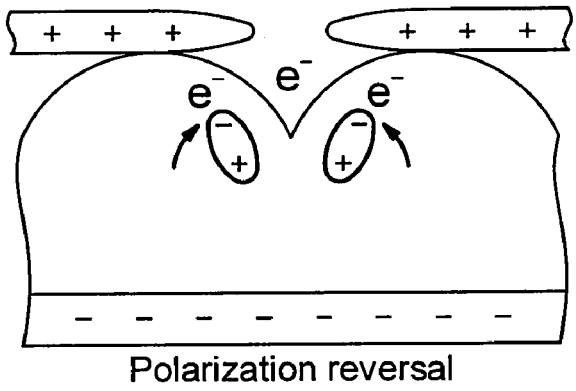
FIG. 42C (3-2) Electron emission
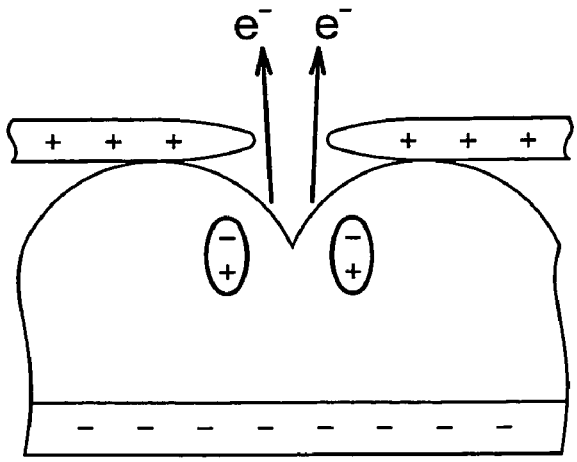

FIG. 46

| Table 1. 4.3 inch prototype display performance | |
|---|---|
| Luminance (White in the whole screen) | 440 cd/m$^2$ |
| Gray scale | 7 bits/color |
| Drive voltage | less than 50V (Data-set stage) |
| Electron accelerating voltage | 7kV |
| Repetition rate | 60Hz |
| Pixel Pitch | 0.6mm |
| Information Content | 128×128 pixels |

HIGH EFFICIENCY DIELECTRIC ELECTRON EMITTER

CROSS REFERENCE TO RELATED APPLICATIONS

This application is a continuation-in-part of U.S. application Ser. No. 10/901,932, filed Jul. 29, 2004 now abandoned, which is a continuation-in-part of U.S. application Ser. No. 10/877,517, filed Jun. 25, 2004 now abandoned, which is a continuation-in-part of U.S. application Ser. No. 10/730,754, filed Dec. 8, 2003 now U.S. Pat. No. 7,176,609, which is a continuation-in-part of U.S. application Ser. No. 10/678,958, filed Oct. 3, 2003 now abandoned, the entireties of which are incorporated herein by reference.

This application also claims the benefit of Japanese Application No. 2004-169997, filed Jun. 8, 2004, the entirety of which is incorporated herein by reference.

BACKGROUND OF THE INVENTION

1. Field of the Invention

The present invention relates to an electron emitter having a first electrode and a second electrode that are disposed in an emitter.

2. Description of the Related Art

Recently, electron emitters having a cathode electrode and an anode electrode have been finding use in various applications such as field emission displays (FEDs) and backlight units. In an FED, a plurality of electron emitters are arranged in a two-dimensional array, and a plurality of phosphors are positioned in association with the respective electron emitters with a predetermined gap left therebetween.

Conventional electron emitters are disclosed in Japanese Laid-Open Patent Publication No. 1-311533, Japanese Laid-Open Patent Publication No. 7-147131, Japanese Laid-Open Patent Publication No. 2000-285801, Japanese Patent Publication No. 46-20944, and Japanese Patent Publication No. 44-26125, for example. All of these disclosed electron emitters are disadvantageous in that, since no dielectric body is employed in the emitter, a forming process or a micromachining process is required between facing electrodes, a high voltage needs to be applied to emit electrons, and a panel fabrication process is complex and entails a high panel fabrication cost.

It has been considered to make an emitter from a dielectric material. Various theories about the emission of electrons from dielectric materials have been presented in the following documents: Yasuoka and Ishii, "Pulsed Electron Source Using a Ferroelectric Cathode", OYO BUTURI (A monthly publication of The Japan Society of Applied Physics), Vol. 68, No. 5, pp. 546-550 (1999), and V. F. Puchkarev, G. A. Mesyats, "On the Mechanism of Emission from the Ferroelectric Ceramic Cathode", J. Appl. Phys., Vol. 78, No. 9, 1 Nov., 1995, pp. 5633-5637, and H. Riege, "Electron Emission from Ferroelectrics—A Review", Nucl. Instr. and Meth. A340, pp. 80-89 (1994).

As shown in FIG. 51 of the accompanying drawings, a conventional electron emitter 200 has an upper electrode 204 and a lower electrode 206 mounted on an emitter 202. The upper electrode 204, in particular, is disposed in intimate contact with the emitter 202. An electric field concentration point is provided by a triple point including the upper electrode 204, the emitter 202, and the vacuum. In this case, the peripheral edge of the upper electrode 204 serves as the electric field concentration point.

However, since the peripheral edge of the upper electrode 204 is held in intimate contact with the emitter 202, the degree of the electric field concentration is small, and the energy required to emit electrons is low. Since electrons are emitted from a region that is limited to the peripheral edge of the upper electrode 204, the electron emitter 200 suffers variations of overall electron emission characteristics, making it difficult to control the electron emission, and has a low electron emission efficiency.

SUMMARY OF THE INVENTION

It is therefore an object of the present invention to provide an electron emitter which can easily generate a high electric field concentration, has many electron emission regions, can emit electrons highly efficiently at a large output level, and is capable of being driven at a low voltage.

Another object of the present invention is to provide an electron emitter which is easily applicable to a display apparatus having a plurality of electron emitters arrayed in association with respective pixels for displaying an image with electrons emitted from the electron emitters.

An electron emitter according to the present invention has an emitter made of a dielectric material, and a first electrode and a second electrode for being supplied with a drive voltage for emitting electrons, the first electrode being disposed on a first surface of the emitter, the second electrode being disposed on a second surface of the emitter, at least the first electrode having a plurality of through regions through which the emitter is exposed, wherein electrons are emitted from the first electrode toward the emitter to charge the emitter in a first stage, and electrons are emitted from the emitter in a second stage. Each of the through regions of the first electrode having a peripheral portion having a surface facing the emitter, the surface being spaced from the emitter.

First, a drive voltage is applied between the first electrode and the second electrode. The drive voltage is defined as a voltage, such as a pulse voltage or an alternating-current voltage, which abruptly changes with time from a voltage level that is higher or lower than a reference voltage (e.g., 0 V) to a voltage level that is lower or higher than the reference voltage.

A triple junction is formed in a region of contact between the first surface of the emitter, the first electrode, and a medium (e.g., a vacuum) around the electron emitter. The triple junction is defined as an electric field concentration region formed by a contact between the first electrode, the emitter, and the vacuum. The triple junction includes a triple point where the first electrode, the emitter, and the vacuum exist as one point. According to the present embodiment, the triple junction is formed around the through regions and the peripheral area of the first electrode. Therefore, when the above drive voltage is applied between the first electrode and the second electrode, an electric field concentration occurs at the triple junction.

In the first stage, a voltage higher or lower than a reference voltage is applied between the first electrode and the second electrode. An electric field concentration occurs in one direction, for example, at the triple junction referred to above, causing the first electrode to emit electrons toward the emitter. The emitted electrons are accumulated in the portions of the emitter which are exposed through the through region of the first electrode and regions near the outer peripheral portion of the first electrode, thus charging the emitter. At this time, the first electrode functions as an electron supply source.

In the second stage, the voltage level of the drive voltage abruptly changes, i.e., a voltage lower or higher than the reference voltage is applied between the first electrode and the second electrode. The electrons that have been accumulated in the portions of the emitter which are exposed through the through regions of the upper electrode and the regions near the outer peripheral portion of the first electrode are expelled from the emitter by dipoles (whose negative poles appear on the surface of the emitter) in the emitter whose polarization has been inverted in the opposite direction. The electrons are emitted from the portions of the emitter where the electrons have been accumulated, through the through regions. The electrons are also emitted from the regions near the outer peripheral portion of the first electrode. At this time, the electrons, which depend on an amount of charge stored in the emitter in the first stage, are emitted from the emitter in the second stage. The amount of charge stored in the emitter in the first stage is maintained until the electrons are emitted from the emitter in the second stage.

Since the first electrode has the plural through regions, electrons are uniformly emitted from each of the through regions and the outer peripheral portions of the first electrode. Thus, any variations in the overall electron emission characteristics of the electron emitter are reduced, making it possible to facilitate the control of the electron emission and increase the electron emission efficiency.

According to the present invention, a gap is formed between the surface of the peripheral portion of each of the through regions which faces the emitter and the emitter. Therefore, when the drive voltage is applied, an electric field concentration tends to be produced in the region of the gap. This leads to a higher efficiency of the electron emission, making the drive voltage lower (emitting electrons at a lower voltage level).

As described above, according to the present invention, since the gap is formed between the surface of the peripheral portion of each of the through regions which faces the emitter and the emitter, the upper electrode has an overhanging portion (flange) on the peripheral portion of the through region, and together with the increased electric field concentration in the region of the gap, electrons are easily emitted from the overhanging portion (the peripheral portion of the through region) of the first electrode. This leads to a larger output and higher efficiency of the electron emission, making the drive voltage lower. As the overhanging portion of the first electrode functions as a gate electrode (a control electrode, a focusing electronic lens, or the like), the linearity of emitted electrons can be increased. This is effective in reducing crosstalk if a number of electron emitters are arrayed for use as an electron source of displays.

As described above, the electron emitter according to the present invention is capable of easily developing a high electric field concentration, provides many electron emission regions, has a larger output and higher efficiency of the electron emission, and can be driven at a lower voltage (lower power consumption).

According to the present invention, if a voltage applied in one direction between the first electrode and the second electrode to invert polarization in one direction of the emitter in the first stage is referred to as a first coercive voltage v1, and a voltage applied in an opposite direction between the first electrode and the second electrode to change polarization of the emitter back to the one direction in the second stage is referred to as a second coercive voltage v2, then the first coercive voltage v1 and the second coercive voltage v2 satisfy the following relationship:

$$v1<0 \text{ or } v2<0, \text{ and}$$

$$|v1|<|v2|.$$

Therefore, the electron emitter can easily be applied to a display which has a plurality of electron emitters arrayed in association with a plurality of pixels, for emitting light due to the emission of electrons from the electron emitters.

If a period for displaying one image is defined as one frame, then all electron emitters are scanned in a certain period (first stage) in one frame and accumulating voltages depending on the luminance levels of pixels to be turned on to emit light are applied to the electron emitters corresponding to the pixels to be turned on to emit light, accumulating charges depending on the luminance levels of corresponding pixels. In a next period (second stage), a constant emission voltage is applied to all the electron emitters to cause the electron emitters corresponding to the pixels to be turned on to emit light to emit electrons in an amount depending on the luminance levels of corresponding pixels.

Usually, if the electron emitters are arranged in a matrix, and when a row of electron emitters is selected at a time in synchronism with a horizontal scanning period and the selected electron emitters are supplied with a pixel signal depending on the luminance levels of the pixels, the pixel signal is also supplied to the unselected pixels.

If the unselected electron emitters emit electrons in response to the supplied pixel signal, then the quality and contrast of a displayed image are lowered.

According to the present invention, however, inasmuch as the amount of charge stored in the emitter in the first stage is maintained until the electrons are emitted from the emitter in the second stage, the unselected pixels are not adversely affected by the signal supplied to the selected pixels. Consequently, each pixel can have a memory effect and emit light with high luminance and high contrast.

At least the first surface of the emitter may have surface irregularities due to the grain boundary of the dielectric material, the first electrode having the through regions in areas corresponding to concavities of the surface irregularities due to the grain boundary of the dielectric material. The first electrode may comprise a cluster of a plurality of scale-like members or a cluster of electrically conductive members including the scale-like members.

With this arrangement, the structure wherein each of the through regions of the first electrode has a peripheral portion having a surface facing the emitter and spaced from the emitter, i.e., the gap is formed between the surface of the peripheral portion of the through region which faces the emitter and the emitter, can easily be realized.

As described above, the electron emitter according to the present invention is capable of easily developing a high electric field concentration, provides many electron emission regions, has a larger output and higher efficiency of the electron emission, and can be driven at a lower voltage (lower power consumption).

The electron emitter according to the present invention can easily be applied to a display which has a plurality of electron emitters arrayed in association with a plurality of pixels, for emitting light due to the emission of electrons from the electron emitters.

The above and other objects, features, and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 32 is a diagram showing the relationship of applied voltages according to the drive method shown in FIG. 31;

FIG. 41A is a view showing a state of the electron emitter at (0) in FIG. 40;

FIG. 41B is a view showing a state of the electron emitter at (1-1) in FIG. 40;

FIG. 41C is a view showing a state of the electron emitter at (1-2) in FIG. 40;

FIG. 42A is a view showing a state of the electron emitter at (2) in FIG. 40;

FIG. 42B is a view showing a state of the electron emitter at (3-1) in FIG. 40;

FIG. 42C is a view showing a state of the electron emitter at (3-2) in FIG. 40;

FIG. 46 is a table showing the 4.3 inch prototype display performance;

DESCRIPTION OF THE PREFERRED EMBODIMENTS

Electron emitters according to embodiments of the present invention will be described below with reference to FIGS. 1 through 50.

Electron emitters according to embodiments of the present invention are applicable to electron beam irradiation apparatus, light sources, LED alternatives, electronic parts manufacturing apparatus, and electronic circuit components, in addition to display apparatus.

An electron beam in an electron beam irradiation apparatus has a higher energy and a better absorption capability than ultraviolet rays in ultraviolet ray irradiation apparatus that are presently in widespread use. The electron emitters may be used to solidify insulating films in superposing wafers for semiconductor devices, harden printing inks without irregularities for drying prints, and sterilize medical devices while being kept in packages.

The electron emitters may also be used as high-luminance, high-efficiency light sources for use in projectors, for example, which may employ ultrahigh-pressure mercury lamps. If the electron emitters according to the present invention are applied to light sources, then the light sources are reduced in size, have a longer service life, can be turned on at high speed, and pose a reduced environmental burden because they are free of mercury.

The electron emitters may also be used as LED alternatives in surface light sources such as indoor illumination units, automobile lamps, traffic signal devices, and also in chip light sources, traffic signal devices, and backlight units for small-size liquid-crystal display devices for cellular phones.

The electron emitters may also be used in electronic parts manufacturing apparatus as electron beam sources for film growing apparatus such as electron beam evaporation apparatus, electron sources for generating a plasma (to activate a gas or the like) in plasma CVD apparatus, and electron sources for decomposing gases. The electron emitters may also be used in vacuum micro devices including ultrahigh-speed devices operable in a tera-Hz range and large-current output devices. If the two-stage electron emission mechanism of the electron emitter according to the present invention is applied, then the electron emitter may be used as an analog data storage element capable of storing analog data. The electron emitters may also preferably be used as printer components, i.e., light emission devices for applying light to a photosensitive drum in combination with a phosphor, and electron sources for charging dielectric materials.

The electron emitters may also be used in electronic circuit components including digital devices such as switches, relays, diodes, etc. and analog devices such as operational amplifiers, etc. as they can be designed for outputting large currents and higher amplification factors.

Figure 1:
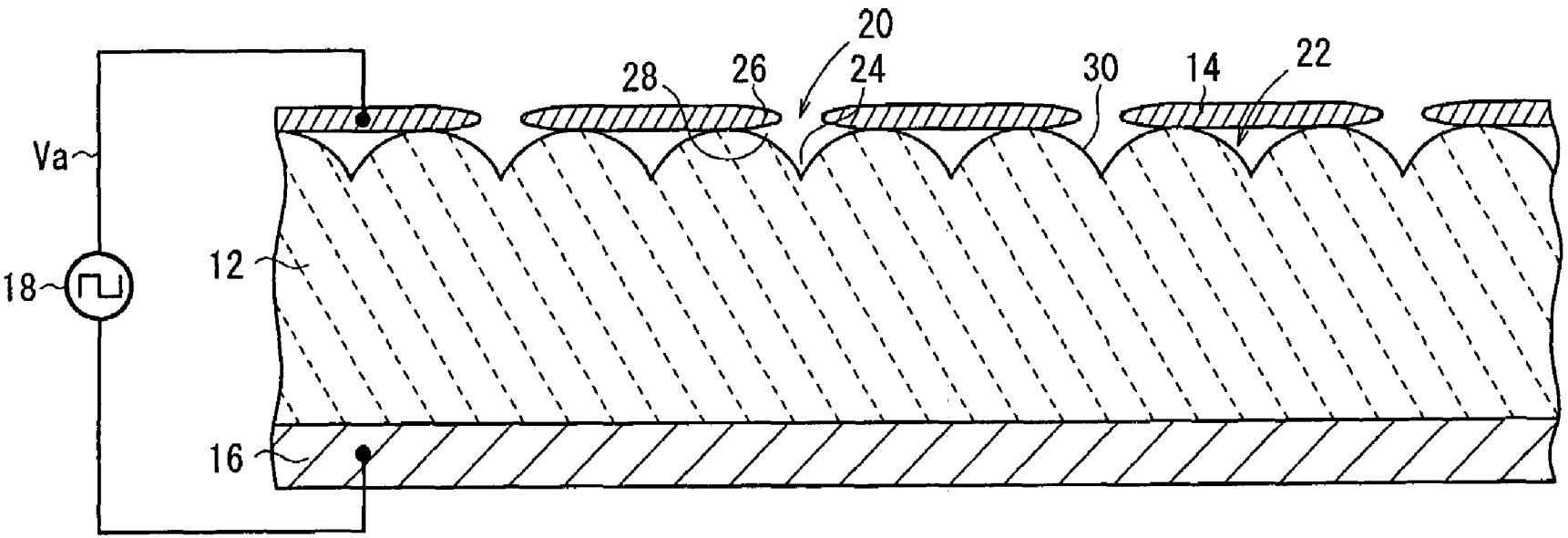
FIG. 1 is a fragmentary cross-sectional view of an electron emitter according to a first embodiment of the present invention.

As shown in FIG. 1, an electron emitter 10A according to a first embodiment of the present invention comprises a plate-like emitter 12 made of a dielectric material, a first electrode (e.g., an upper electrode) 14 formed on a first surface (e.g., an upper surface) of the emitter 12, a second electrode (e.g., a lower electrode) 16 formed on a second surface (e.g., a lower surface) of the emitter 12, and a pulse generation source 18 for applying a drive voltage Va between the upper electrode 14 and the lower electrode 16.

The upper electrode 14 has a plurality of through regions 20 where the emitter 12 is exposed. The emitter 12 has surface irregularities 22 due to the grain boundary of a dielectric material that the emitter 12 is made of. The through regions 20 of the upper electrode 14 are formed in areas corresponding to concavities 24 due to the grain boundary of the dielectric material. In the embodiment shown in FIG. 1, one through region 20 is formed in association with one concavity 24. However, one through region 20 may be formed in association with a plurality of concavities 24. The particle diameter of the dielectric material of the emitter 12 should preferably be in the range from 0.1 μm to 10 μm, and more preferably be in the range from 2 μm to 7 μm. In the embodiment shown in FIG. 1, the particle diameter of the dielectric material is 3 μm.

Figure 2:
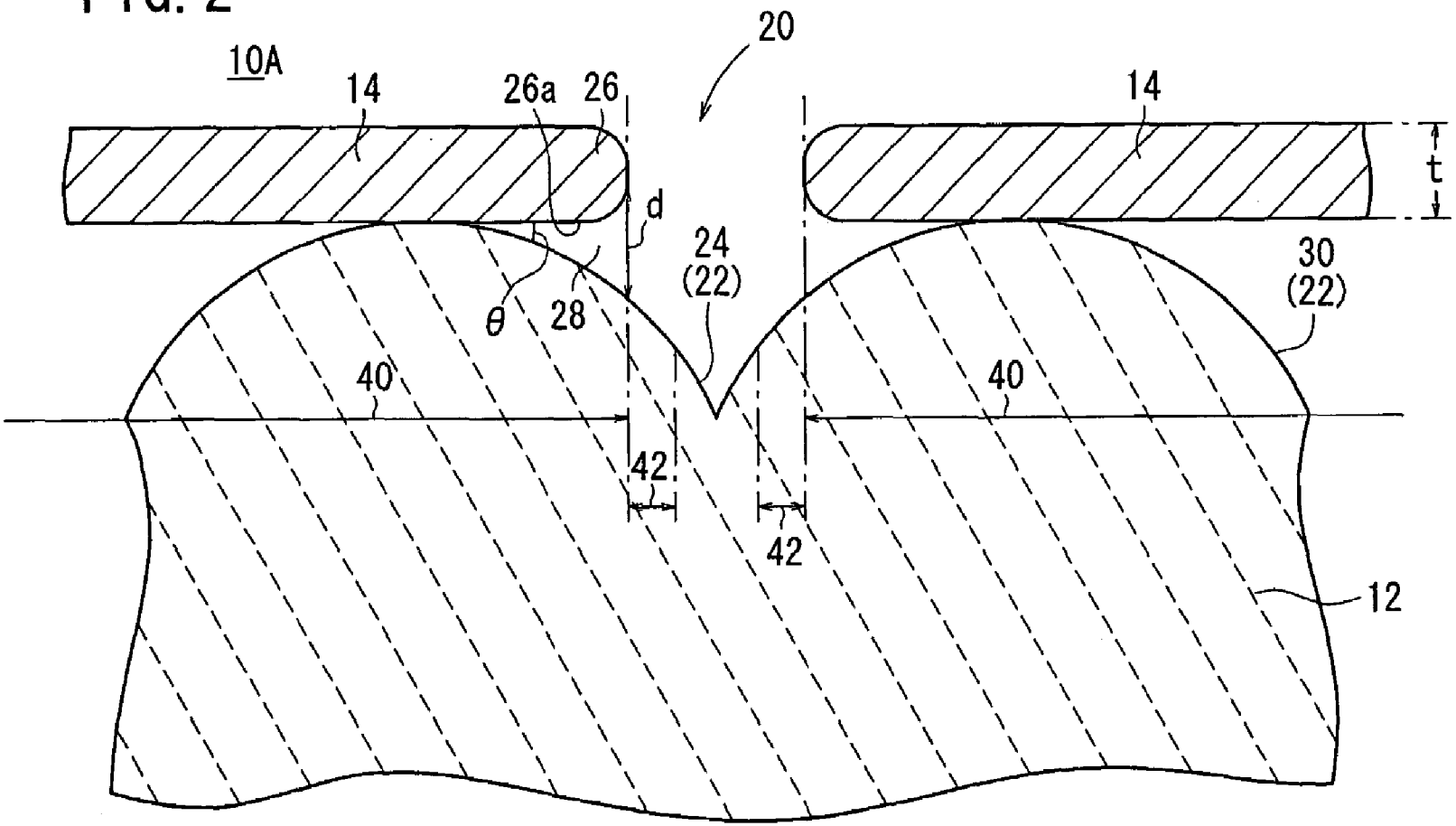
FIG. 2 is an enlarged fragmentary cross-sectional view of the electron emitter according to the first embodiment.

In this embodiment, as shown in FIG. 2, each of the through regions 20 of the upper electrode 14 has a peripheral portion 26 having a surface 26*a* facing the emitter 12, the surface 26*a* being spaced from the emitter 12. Specifically, a gap 28 is formed between the surface 26*a*, facing the emitter 12, of the peripheral portion 26 of the through region 20 and the emitter 12, and the peripheral portion 26 of the through region 20 of the upper electrode 14 is formed as an overhanging portion (flange). In the description which follows, "the peripheral portion 26 of the through region 20 of the upper electrode 14" is referred to as "the overhanging portion 26 of the upper electrode 14". In FIGS. 1, 2, 4A, 4B, 5A, 5B, 8 through 10, and 15, convexities 30 of the surface irregularities 22 of the grain boundary of the dielectric material are shown as having a semicircular cross-sectional shape. However, the convexities 30 are not limited to the semicircular cross-sectional shape.

With the electron emitter 10A, the upper electrode 14 has a thickness t in the range of 0.01 μm≦t≦10 μm, and the maximum angle θ between the upper surface of the emitter 12, i.e., the surface of the convexity 30 (which is also the inner wall surface of the concavity 24) of the grain boundary of the dielectric material, and the lower surface 26*a* of the overhanging portion 26 of the upper electrode 14 is in the range of 1°≦θ≦60°. The maximum distance d in the vertical direction between the surface of the convexity 30 (the inner wall surface of the concavity 24) of the grain boundary of the dielectric material and the lower surface 26*a* of the overhanging portion 26 of the upper electrode 14 is in the range of 0 μm<d≦10 μm.

Figure 3:
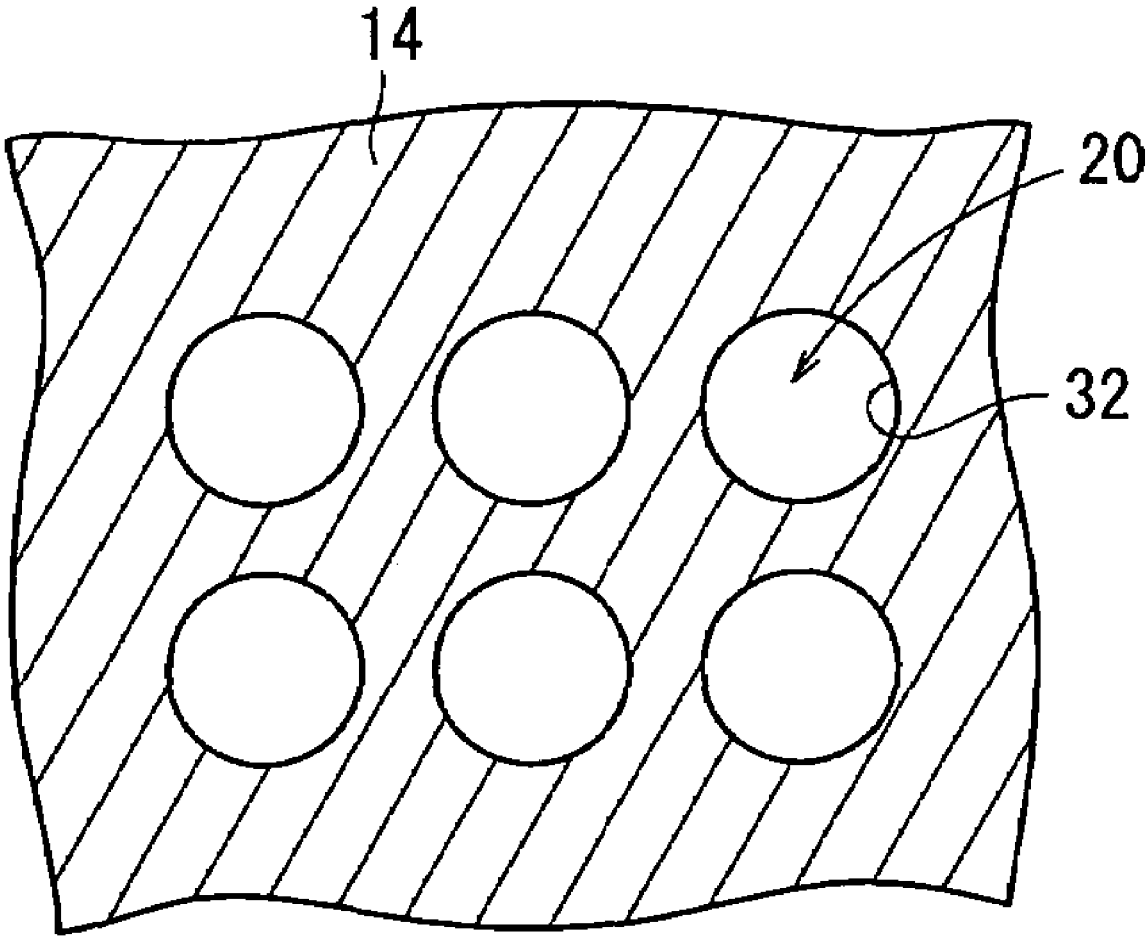
FIG. 3 is a plan view showing an example of the shape of through regions defined in an upper electrode.

In the electron emitter 10A, the shape of the through region 20, particularly the shape as seen from above, as shown in FIG. 3, is the shape of a hole 32, which may be a shape including a curve such as a circular shape, an elliptical shape, a track shape, or a polygonal shape such as a quadrangular shape or a triangular shape. In FIG. 3, the shape of the hole 32 is a circular shape.

The hole 32 has an average diameter ranging from 0.1 μm to 10 μm. The average diameter represents the average of the lengths of a plurality of different line segments passing through the center of the hole 32.

The materials of the various components of the electron emitter 10A will be described below. The dielectric material that the emitter 12 is made of may preferably be a dielectric material having a relatively high dielectric constant, e.g., a dielectric constant of 1000 or higher. Dielectric materials of such a nature may be ceramics including barium titanate, lead zirconate, lead magnesium niobate, lead nickel niobate, lead zinc niobate, lead manganese niobate, lead magnesium tantalate, lead nickel tantalate, lead antimony tinate, lead titanate, lead magnesium tungstenate, lead cobalt niobate, etc. or a combination of any of these materials, a material which chiefly contains 50 weight % or more of any of these materials, or such ceramics to which there is added an oxide of such as lanthanum, calcium, strontium, molybdenum, tungsten, barium, niobium, zinc, nickel, manganese, or the like, or a combination of these materials, or any of other compounds.

For example, a two-component material nPMN-mPT (n, m represent molar ratios) of lead magnesium niobate (PMN) and lead titanate (PT) has its Curie point lowered for a larger specific dielectric constant at room temperature if the molar ratio of PMN is increased.

Particularly, a dielectric material where n=0.85–1.0 and m=1.0–n is preferable because its specific dielectric constant is 3000 or higher. For example, a dielectric material where n=0.91 and m=0.09 has a specific dielectric constant of 15000 at room temperature, and a dielectric material where n=0.95 and m=0.05 has a specific dielectric constant of 20000 at room temperature.

For increasing the specific dielectric constant of a three-component dielectric material of lead magnesium niobate (PMN), lead titanate (PT), and lead zirconate (PZ), it is preferable to achieve a composition close to a morphotropic phase boundary (MPB) between a tetragonal system and a quasi-cubic system or a tetragonal system and a rhombohedral system, as well as to increase the molar ratio of PMN. For example, a dielectric material where PMN:PT:PZ=0.375:0.375:0.25 has a specific dielectric constant of 5500, and a dielectric material where PMN:PT:PZ=0.5:0.375:0.125 has a specific dielectric constant of 4500, which is particularly preferable. Furthermore, it is preferable to increase the dielectric constant by introducing a metal such as platinum into these dielectric materials within a range to keep them insulative. For example, a dielectric material may be mixed with 20 weight % of platinum.

The emitter 12 may be in the form of a piezoelectric/electrostrictive layer or an antiferroelectric layer. If the emitter 12 comprises a piezoelectric/electrostrictive layer, then it may be made of ceramics such as lead zirconate, lead magnesium niobate, lead nickel niobate, lead zinc niobate, lead manganese niobate, lead magnesium tantalate, lead nickel tantalate, lead antimony tinate, lead titanate, barium titanate, lead magnesium tungstenate, lead cobalt niobate, or the like or a combination of any of these materials.

The emitter 12 may be made of chief components including 50 wt % or more of any of the above compounds. Of the above ceramics, the ceramics including lead zirconate is mostly frequently used as a constituent of the piezoelectric/electrostrictive layer of the emitter 12.

If the piezoelectric/electrostrictive layer is made of ceramics, then lanthanum, calcium, strontium, molybdenum, tungsten, barium, niobium, zinc, nickel, manganese, or the like, or a combination of these materials, or any of other compounds may be added to the ceramics. Alternatively, ceramics produced by adding $SiO_2$, $CeO_2$, $Pb_5Ge_3O_{11}$, or a combination of any of these compounds to the above ceramics may be used. Specifically, a material produced by adding 0.2 wt % of $SiO_2$, 0.1 wt % of $CeO_2$, or 1 to 2 wt % of $Pb_5Ge_3O_{11}$ to a PT-PZ-PMN piezoelectric material is preferable.

For example, the piezoelectric/electrostrictive layer should preferably be made of ceramics including as chief components lead magnesium niobate, lead zirconate, and lead titanate, and also including lanthanum and strontium.

The piezoelectric/electrostrictive layer may be dense or porous. If the piezoelectric/electrostrictive layer is porous, then it should preferably have a porosity of 40% or less.

If the emitter 12 is in the form of an antiferroelectric layer, then the antiferroelectric layer may be made of lead zirconate as a chief component, lead zirconate and lead tin as chief components, lead zirconate with lanthanum oxide added thereto, or lead zirconate and lead tin as components with lead zirconate and lead niobate added thereto.

The antiferroelectric layer may be porous. If the antiferroelectric layer is porous, then it should preferably have a porosity of 30% or less.

If the emitter 12 is made of strontium tantalate bismuthate ($SrBi_2Ta_2O_9$), then its polarization inversion fatigue is small. Materials whose polarization inversion fatigue is small are laminar ferroelectric compounds and expressed by the general formula of $(BiO_2)^{2+}$ $(A_{m-1}B_mO_{3m+1})^{2-}$. Ions of the metal A are $Ca^{2+}$, $Sr^{2+}$, $Ba^{2+}$, $Pb^{2+}$, $Bi^{3+}$, $La^{3+}$, etc., and ions of the metal B are $Ti^{4+}$, $Ta^{5+}$, $Nb^{5+}$, etc. An additive may be added to piezoelectric ceramics of barium titanate, lead zirconate, and PZT to convert them into a semiconductor. In this case, it is possible to provide an irregular electric field distribution in the emitter 12 to concentrate an electric field in the vicinity of the interface with the upper electrode 14 which contributes to the emission of electrons.

The baking temperature can be lowered by adding glass such as lead borosilicate glass or the like or other compounds of low melting point (e.g., bismuth oxide or the like) to the piezoelectric/electrostrictive/antiferroelectric ceramics.

If the emitter 12 is made of piezoelectric/electrostrictive/antiferroelectric ceramics, then it may be a sheet-like molded body, a sheet-like laminated body, or either one of such bodies stacked or bonded to another support substrate.

If the emitter 12 is made of a non-lead-based material, then it may be a material having a high melting point or a high evaporation temperature so as to be less liable to be damaged by the impingement of electrons or ions.

The emitter 12 may be made by any of various thick-film forming processes including screen printing, dipping, coating, electrophoresis, aerosol deposition, etc., or any of various thin-film forming processes including an ion beam process, sputtering, vacuum evaporation, ion plating, chemical vapor deposition (CVD), plating, etc. Particularly, it is preferable to form a powdery piezoelectric/electrostrictive material as the emitter 12 and impregnate the emitter 12 thus formed with glass of a low melting point or sol particles. According to this process, it is possible to form a film at a low temperature of 700° C. or lower or 600° C. or lower.

The upper electrode 14 is made of an organic metal paste which can produce a thin film after being baked. For example, a platinum resinate paste or the like, should preferably be used. An oxide electrode for suppressing a polarization inversion fatigue, which is made of ruthenium oxide ($RuO_2$), iridium oxide ($IrO_2$), strontium ruthenate ($SrRuO_3$), $La_{1-x}Sr_xCoO_3$ (e.g., x=0.3 or 0.5), $La_{1-x}Ca_xMnO_3$, (e.g., x=0.2), $La_{1-x}Ca_xMn_{1-y}Co_yO_3$ (e.g., x=0.2, y=0.05), or a mixture of any one of these compounds and a platinum resinate paste, for example, is preferable.

Figure 4B:
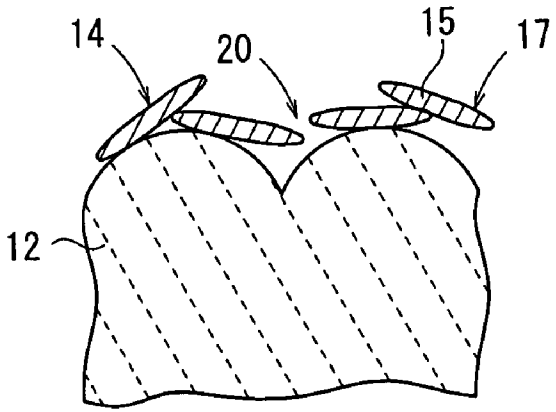
FIG. 4B is an enlarged fragmentary cross-sectional view of the upper electrode.
Figure 4A:
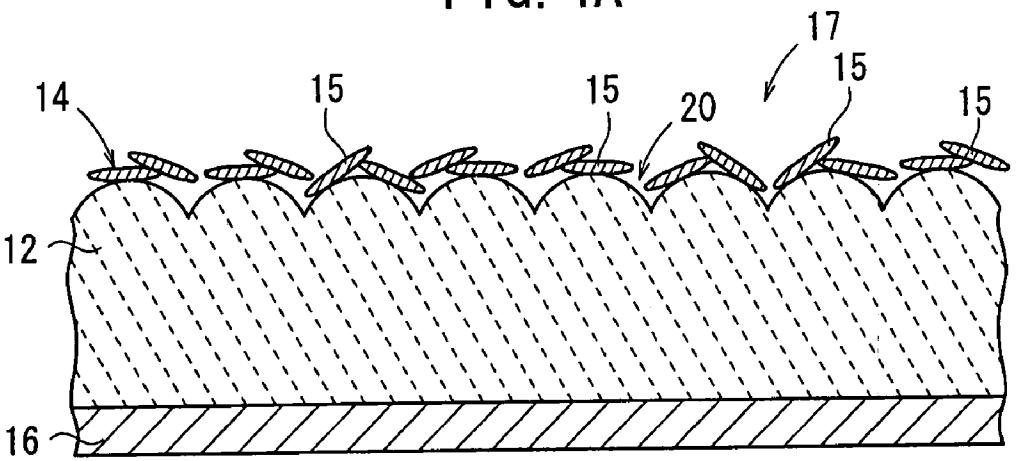
FIG. 4A is a cross-sectional view of another example of the upper electrode.
Figure 5B:
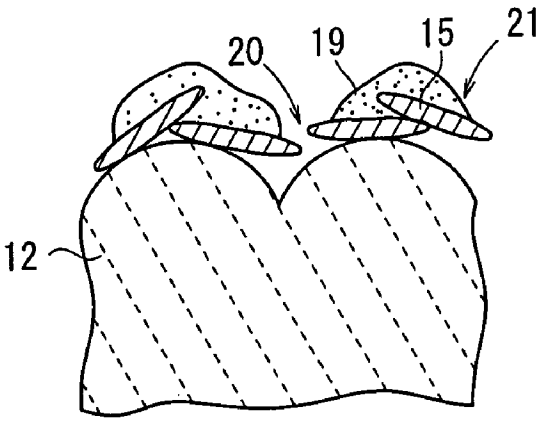
FIG. 5B is an enlarged fragmentary cross-sectional view of the upper electrode.
Figure 5A:
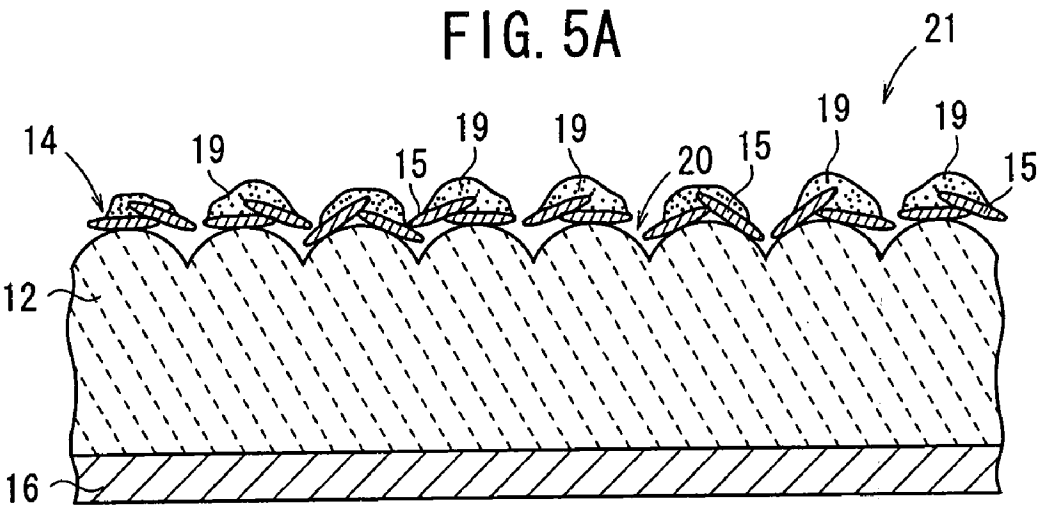
FIG. 5A is a cross-sectional view of still another example of the upper electrode.

As shown in FIGS. 4A and 4B, the upper electrode 14 may preferably be in the form of a cluster 17 of a plurality of scale-like members 15 (e.g., of graphite). Alternatively, as shown in FIGS. 5A and 5B, the upper electrode 14 may preferably be in the form of a cluster 21 of electrically conductive members 19 including the scale-like members 15. The cluster 17 or 21 does not fully cover the surface of the emitter 12, but a plurality of through regions 20 are provided through which the emitter 12 is partly exposed, and those portions of the emitter 12 which face the through regions 20 serve as electron emission regions.

The upper electrode 14 may be made of any of the above materials by any of thick-film forming processes including screen printing, spray coating, coating, dipping, electrophoresis, etc., or any of various thin-film forming processes including sputtering, an ion beam process, vacuum evaporation, ion plating, chemical vapor deposition (CVD), plating, etc. Preferably, the upper electrode 14 is made by any of the above thick-film forming processes.

The lower electrode 16 is made of an electrically conductive material, e.g., a metal such as platinum, molybdenum, tungsten, or the like. Alternatively, the lower electrode 16 is made of an electric conductor which is resistant to a high-temperature oxidizing atmosphere, e.g., a metal, an alloy, a mixture of insulative ceramics and a metal, a mixture of insulative ceramics and an alloy, or the like. Preferably, the lower electrode 16 should be made of a precious metal having a high melting point such as platinum, iridium, palladium, rhodium, molybdenum, or the like, or a material chiefly composed of an alloy of silver and palladium, silver and platinum, platinum and palladium, or the like, or a cermet of platinum and ceramics. Further preferably, the lower electrode 16 should be made of platinum only or a material chiefly composed of a platinum-base alloy.

The lower electrode 16 may be made of carbon or a graphite-base material. Ceramics to be added to the electrode material should preferably have a proportion ranging from 5 to 30 volume %. The lower electrode 16 may be made of the same material as the upper electrode 14, as described above.

The lower electrode 16 should preferably be formed by any of various thick-film forming processes. The lower electrode 16 has a thickness of 20 μm or less or preferably a thickness of 5 μm or less.

Each time the emitter 12, the upper electrode 14, or the lower electrode 16 is formed, the assembly is heated (sintered) into an integral structure.

The sintering process for integrally combining the emitter 12, the upper electrode 14, and the lower electrode 16 may be carried out at a temperature ranging from 500° to 1400° C., preferably from 1000° to 1400° C. For heating the emitter 12 which is in the form of a film, the emitter 12 should be sintered together with its evaporation source while their atmosphere is being controlled, so that the composition of the emitter 12 will not become unstable at high temperatures.

By performing the sintering process, the film which will serve as the upper electrode 14 is shrunk from the thickness of 10 μm to the thickness of 0.1 μm, and simultaneously a plurality of holes are formed therein. As a result, as shown in FIG. 1, a plurality of through regions 20 are formed in the upper electrode 14, and the peripheral portions 26 of the through regions 20 are turned into overhanging portions. In advance (of the sintering process), the film which will serve as the upper electrode 14 may be patterned by etching (wet etching or dry etching) or lift-off, and then may be sintered. In this case, recesses or slits may easily be formed as the through regions 20.

The emitter 12 may be covered with a suitable member, and then sintered such that the surface of the emitter 12 will not be exposed directly to the sintering atmosphere.

The principles of electron emission of the electron emitter 10A will be described below. First, a drive voltage Va is applied between the upper electrode 14 and the lower electrode 16. The drive voltage Va is defined as a voltage, such as a pulse voltage or an alternating-current voltage, which abruptly changes with time from a voltage level that is higher or lower than a reference voltage (e.g., 0 V) to a voltage level that is lower or higher than the reference voltage.

A triple junction is formed in a region of contact between the upper surface of the emitter 12, the upper electrode 14, and a medium (e.g., a vacuum) around the electron emitter 10A. The triple junction is defined as an electric field concentration region formed by a contact between the upper electrode 14, the emitter 12, and the vacuum. The triple junction includes a triple point where the upper electrode 14, the emitter 12, and the vacuum coexist at one point. The vacuum level in the atmosphere should preferably in the range from $10^2$ to $10^{-6}$ Pa and more preferably in the range from $10^{-3}$ to $10^{-5}$ Pa.

According to the first embodiment, the triple junction is formed on the overhanging portion 26 of the upper electrode 14 and the peripheral area of the upper electrode 14. Therefore, when the above drive voltage Va is applied between the upper electrode 14 and the lower electrode 16, an electric field concentration occurs at the triple junction.

Figure 6:
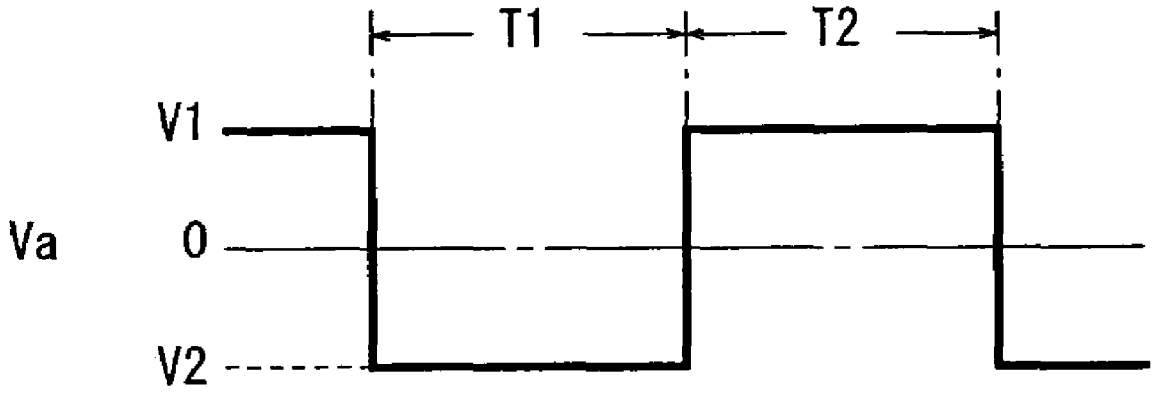
FIG. 6 is a diagram showing the voltage waveform of a drive voltage in an electron emission process for the electron emitter according to the first embodiment.
Figure 7:
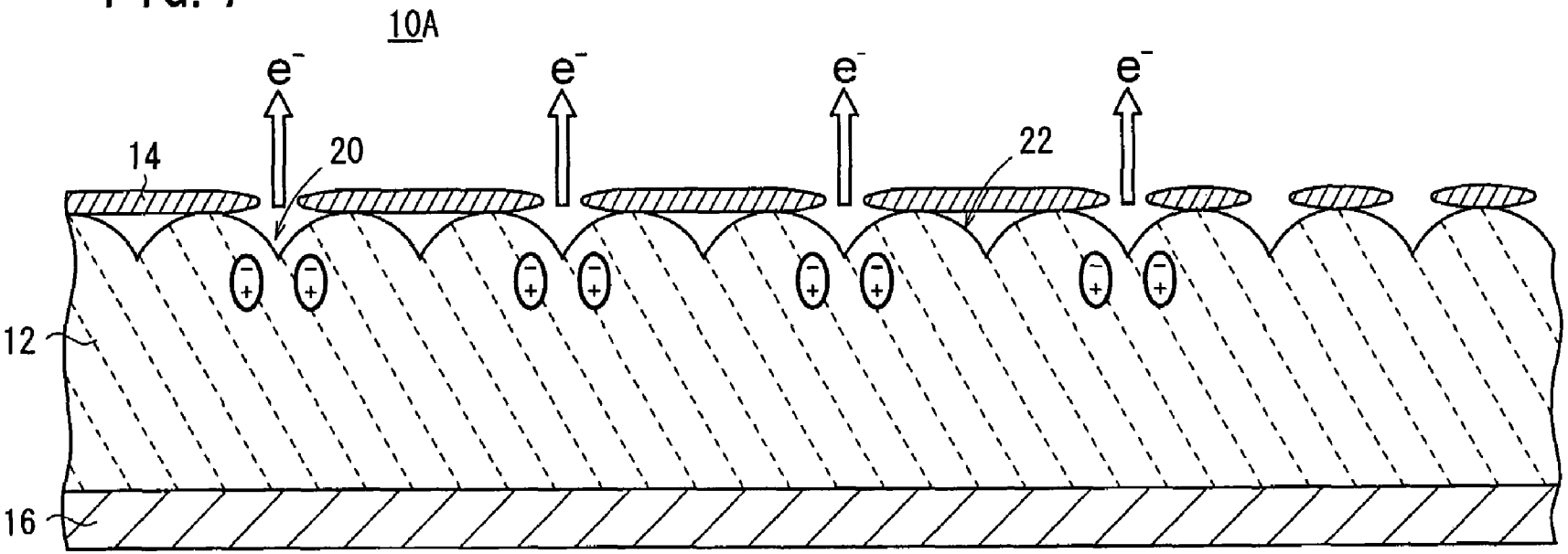
FIG. 7 is a view illustrative of the emission of electrons in a second output period (second stage) of the electron emission process for the electron emitter according to the first embodiment.

A first electron emission process for the electron emitter 10A will be described below with reference to FIGS. 6 and 7. In a first output period T1 (first stage) shown in FIG. 6, a voltage V2 lower than a reference voltage (e.g., 0 V) is applied to the upper electrode 14, and a voltage V1 higher than the reference voltage is applied to the lower electrode 16. In the first output period T1, an electric field concentration occurs at the triple junction referred to above, causing the upper electrode 14 to emit primary electrons toward the emitter 12. The emitted electrons are accumulated in the portions of the emitter 12 which are exposed through the through region 20 of the upper electrode 14 and regions near the outer peripheral portion of the upper electrode 14, thus charging the emitter 12. At this time, the upper electrode 14 functions as an electron supply source.

In a next output period T2 (second stage), the voltage level of the drive voltage Va abruptly changes, i.e., the voltage V1 higher than the reference voltage is applied to the upper electrode 14, and the voltage V2 lower than the reference voltage to the lower electrode 16. The electrons that have been accumulated in the portions of the emitter 12 which are exposed through the through region 20 of the upper electrode 14 and the regions near the outer peripheral portion of the upper electrode 14 are expelled from the emitter 12 by dipoles (whose negative poles appear on the surface of the emitter 12) in the emitter 12 whose polarization has been inverted in the opposite direction. The electrons are emitted from the portions of the emitter 12 where the electrons have been accumulated, through the through regions 20. The electrons are also emitted from the regions near the outer peripheral portion of the upper electrode 14.

The electron emitter 10A according to the first embodiment offers the following advantages: Since the upper electrode 14 has plural through regions 20, electrons are uniformly emitted from each of the through regions 20 and the outer peripheral portions of the upper electrode 14. Thus, any variations in the overall electron emission characteristics of the electron emitter 10A are reduced, making it possible to facilitate the control of the electron emission and increase the electron emission efficiency.

Because the gap 28 is formed between the overhanging portion of the upper electrode 14 and the emitter 12, when the drive voltage Va is applied, an electric field concentration tends to be produced in the region of the gap 28. This leads to a higher efficiency of the electron emission, making the drive voltage lower (emitting electrons at a lower voltage level).

As described above, according to the first embodiment, since the upper electrode 14 has the overhanging portion 26 on the peripheral portion of the through region 20, together with the increased electric field concentration in the region of the gap 28, electrons are easily emitted from the overhanging portion 26 of the upper electrode 14. This leads to a larger output and higher efficiency of the electron emission, making the drive voltage Va lower. According to the above electron emission process, as the overhanging portion 26 of the upper electrode 14 functions as a gate electrode (a control electrode, a focusing electronic lens, or the like), the straightness of emitted electrons can be improved. This is effective in reducing crosstalk if a number of electron emitters 10A are arrayed for use as an electron source of displays.

As described above, the electron emitter 10A according to the first embodiment is capable of easily developing a high electric field concentration, provides many electron emission regions, has a larger output and higher efficiency of the electron emission, and can be driven at a lower voltage (lower power consumption).

Particularly, according to the first embodiment, at least the upper surface of the emitter 12 has the surface irregularities 22 due to the grain boundary of the dielectric material. As the upper electrode 14 has the through regions 20 in portions corresponding to the concavities 24 of the grain boundary of the dielectric material, the overhanging portions 26 of the upper electrode 14 can easily be realized.

The maximum angle θ between the upper surface of the emitter 12, i.e., the surface of the convexity 30 (which is also the inner wall surface of the concavity 24) of the grain boundary of the dielectric material, and the lower surface 26*a* of the overhanging portion 26 of the upper electrode 14 is in the range of $1° \leqq \theta \leqq 60°$. The maximum distance d in the vertical direction between the surface of the convexity 30 (the inner wall surface of the concavity 24) of the grain boundary of the dielectric material and the lower surface 26*a* of the overhanging portion 26 of the upper electrode 14 is in the range of $0\ \mu m < d \leqq 10\ \mu m$. These arrangements make it possible to increase the degree of the electric field concentration in the region of the gap 28, resulting in a larger output and higher efficiency of the electron emission and higher efficiency of making the drive voltage lower.

According to the first embodiment, the through region 20 is in the shape of the hole 32. As shown in FIG. 2, the portions of the emitter 12 where the polarization is inverted or changed depending on the drive voltage Va applied between the upper electrode 14 and the lower electrode 16 (see FIG. 1) include a portion (first portion) 40 directly below the upper electrode 14 and a portion (second portion) 42 corresponding to a region extending from the inner peripheral edge of the through region 20 inwardly of the through region 20. Particularly, the second portion 42 changes depending on the level of the drive voltage and the degree of the electric field concentration. According to the first embodiment, the average diameter of the hole 32 is in the range from 0.1 μm to 10 μm. Insofar as the average diameter of the hole 32 is in this range, the distribution of electrons emitted through the through region 20 is almost free of any variations, allowing electrons to be emitted efficiently.

If the average diameter of the hole 32 is less than 0.1 μm, then the region where electrons are accumulated is made narrower, reducing the amount of emitted electrons. While one solution would be to form many holes 32, it would be difficult and highly costly to form many holes 32. If the average diameter of the hole 32 is in excess of 10 μm, then the proportion (share) of the portion (second portion) 42 which contributes to the emission of electrons in the portion of the emitter 12 that is exposed through the through region 20 is reduced, resulting in a reduction in the electron emission efficiency.

Figure 8:
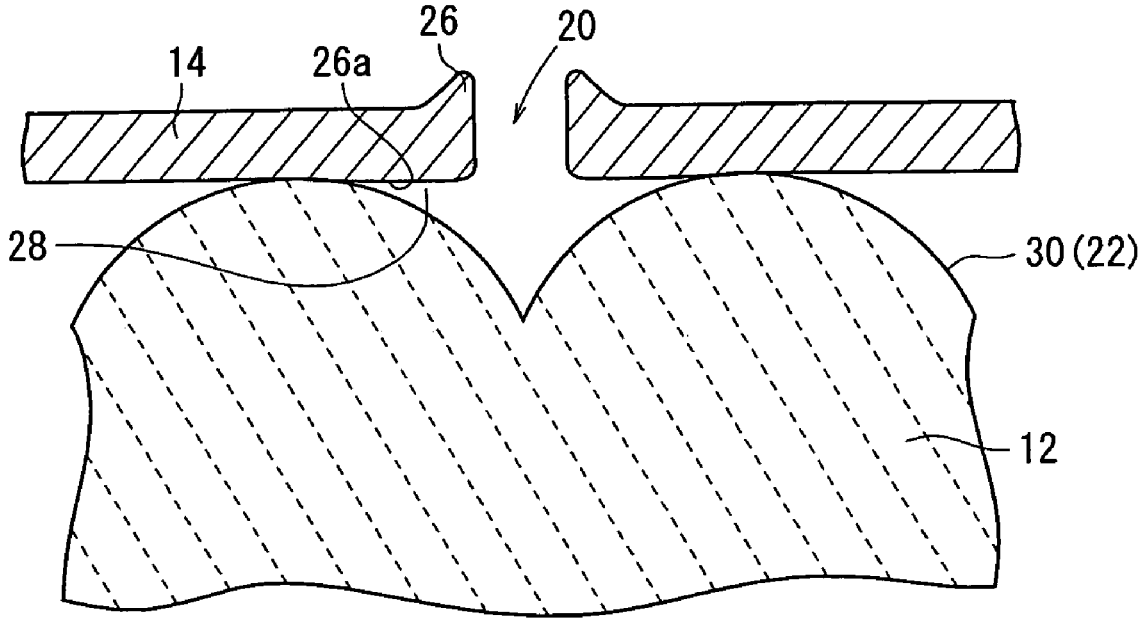
FIG. 8 is a view showing a cross-sectional shape of an overhanging portion of the upper electrode.
Figure 9:
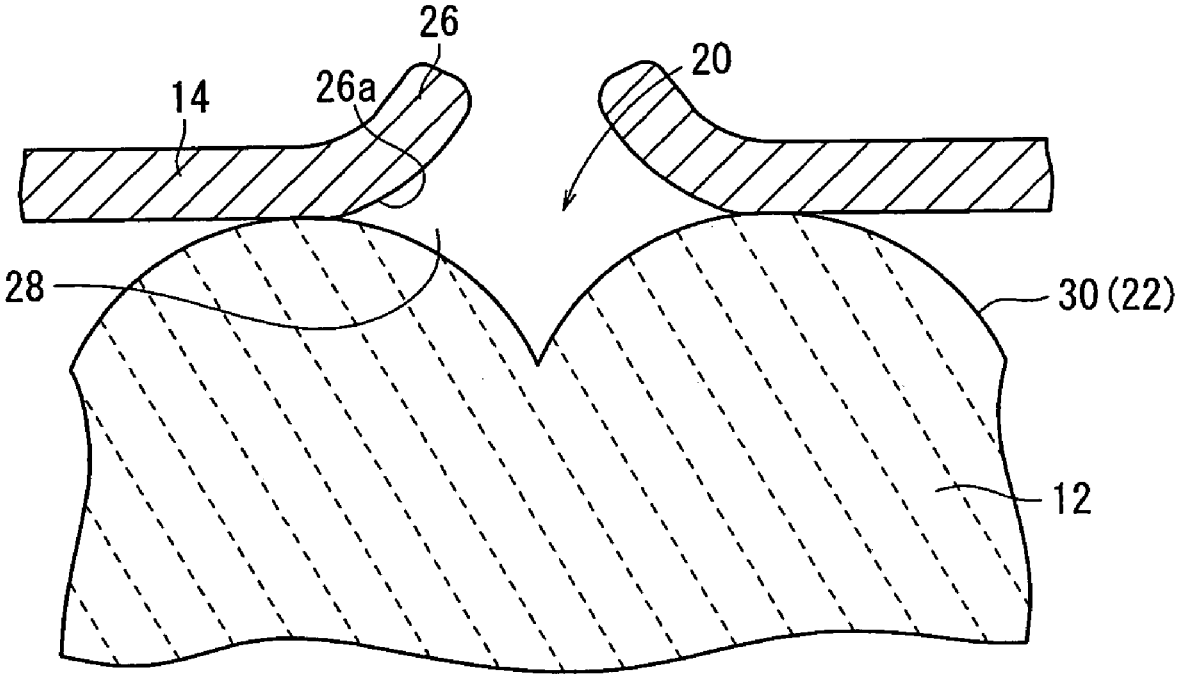
FIG. 9 is a view showing a cross-sectional shape of another overhanging portion of the upper electrode.
Figure 10:
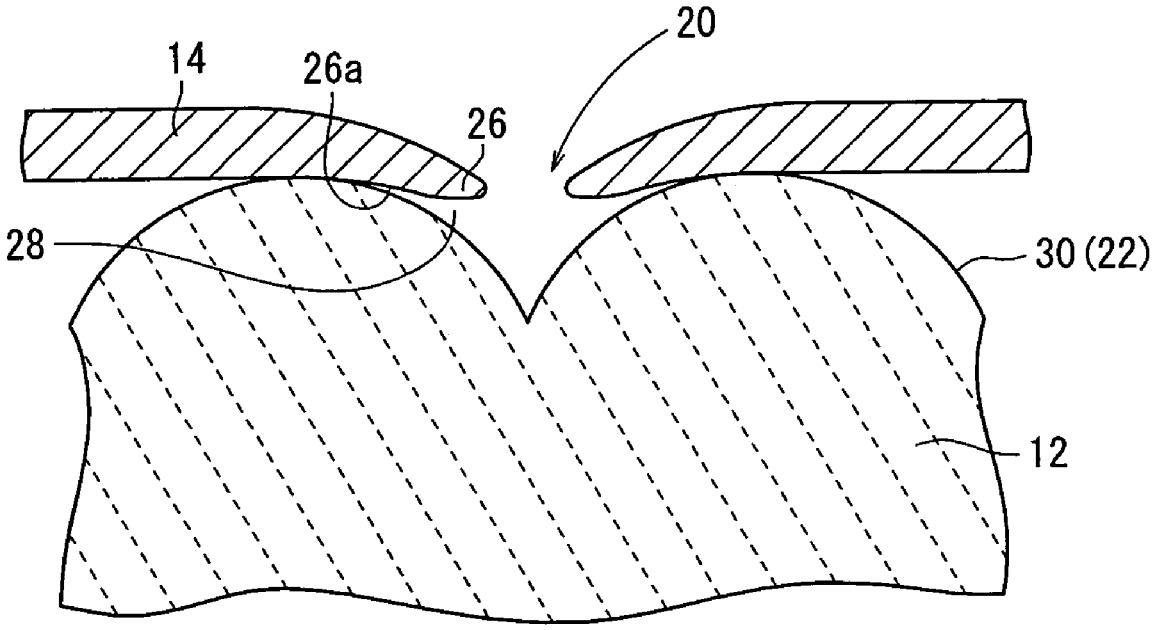
FIG. 10 is a view showing a cross-sectional shape of still another overhanging portion of the upper electrode.

The overhanging portion 26 of the upper electrode 14 may have upper and lower surfaces extending horizontally as shown in FIG. 2. Alternatively, as shown in FIG. 8, the overhanging portion 26 may have a lower surface 26*a* extending substantially horizontally and an upper end raised upwardly. Alternatively, as shown in FIG. 9, the overhanging portion 26 may have a lower surface 26*a* inclined progressively upwardly toward the center of the through region 20. Further alternatively, as shown in FIG. 10, the overhanging portion 26 may have a lower surface 26*a* inclined progressively downwardly toward the center of the through region 20. The arrangement shown in FIG. 8 is capable of increasing the function as a gate electrode. The arrangement shown in FIG. 10 makes it easier to produce a higher electric field concentration for a larger output and higher efficiency of the electron emission because the gap 28 is narrower.

Figure 11:
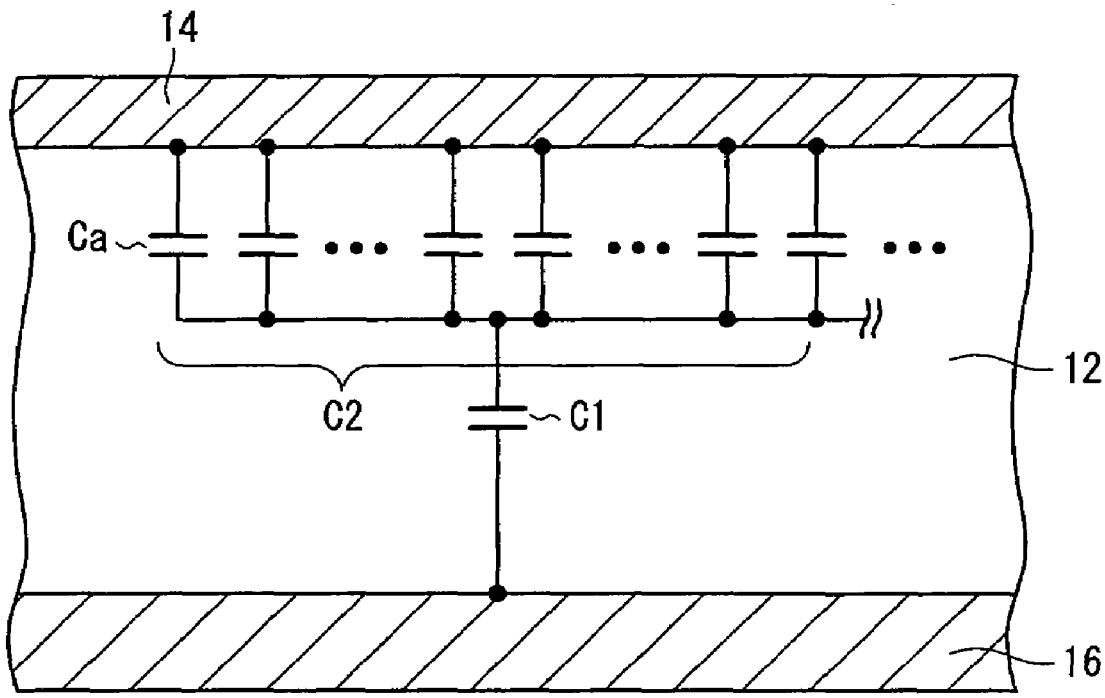
FIG. 11 is an equivalent circuit diagram showing a connected state of various capacitors connected between the upper electrode and the lower electrode.

As shown in FIG. 11, the electron emitter 10A according to the first embodiment has in its electrical operation a capacitor C1 due to the emitter 12 and a cluster of capacitors Ca due to respective gaps 28, disposed between the upper electrode 14 and the lower electrode 16. The capacitors Ca due to the respective gaps 28 are connected parallel to each other into a single capacitor C2. In terms of an equivalent circuit, the capacitor C1 due to the emitter 12 is connected in series to the capacitor C2 which comprises the cluster of capacitors Ca.

Actually, the capacitor C1 due to the emitter 12 is not directly connected in series to the capacitor C2 which comprises the cluster of capacitors Ca, but the capacitive component that is connected in series varies depending on the number of the through regions 20 formed in the upper electrode 14 and the overall area of the through regions 20.

Figure 12:
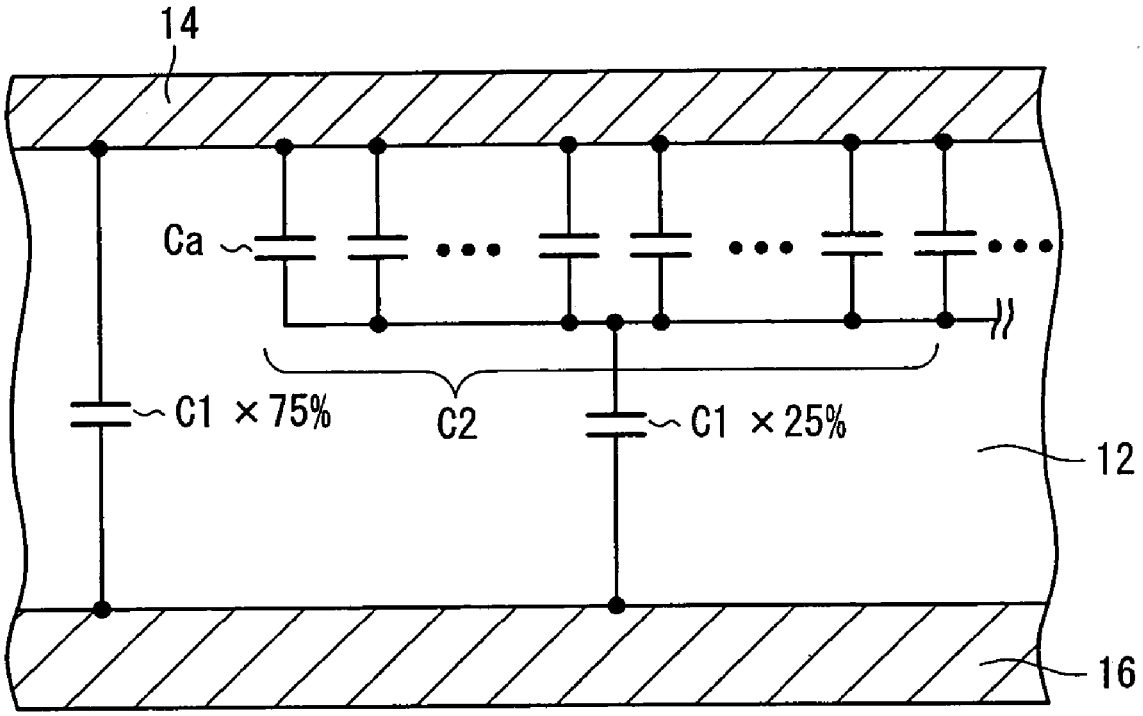
FIG. 12 is a diagram illustrative of calculations of capacitances of the various capacitors connected between the upper electrode and the lower electrode.

Capacitance calculations will be performed on the assumption that 25% of the capacitor C1 due to the emitter 12 is connected in series to the capacitor C2 which comprises the cluster of capacitors Ca, as shown in FIG. 12. Since the gaps 28 are in vacuum, the relative dielectric constant thereof is 1. It is assumed that the maximum distance d across the gaps 28 is 0.1 μm, the area S of each gap 28 is S=1 μm×1 μm, and the number of the gaps 28 is 10,000. It is also assumed that the emitter 12 has a relative dielectric constant of 2000, the emitter 12 has a thickness of 20 μm, and the confronting area of the upper and lower electrodes 14, 16 is 200 μm×200 μm. The capacitor C2 which comprises the cluster of capacitors Ca has a capacitance of 0.885 pF, and the capacitor C1 due to the emitter 12 has a capacitance of 35.4 pF. If the portion of the capacitor C1 due to the emitter 12 which is connected in series to the capacitor C2 which comprises the cluster of capacitors Ca is 25% of the entire capacitor C1, then that series-connected portion has a capacitance (including the capacitance of capacitor C2 which comprises the cluster of capacitors Ca) of 0.805 pF, and the remaining portion has a capacitance of 26.6 pF.

Because the series-connected portion and the remaining portion are connected in parallel to each other, the overall capacitance is 27.5 pF. This capacitance is 78% of the capacitance 35.4 pF of the capacitor C1 due to the emitter 12. Therefore, the overall capacitance is smaller than the capacitance of the capacitor C1 due to the emitter 12.

Consequently, the capacitance of the cluster of capacitors Ca due to the gaps 28 is relatively small. Because of the voltage division between the cluster of capacitors Ca and the capacitor C1 due to the emitter 12, almost the entire applied voltage Va is applied across the gaps 28, which are effective to produce a larger output of the electron emission.

Since the capacitor C2 which comprises the cluster of capacitors Ca is connected in series to the capacitor C1 due to the emitter 12, the overall capacitance is smaller than the capacitance of the capacitor C1 due to the emitter 12. This is effective to provide preferred characteristics, namely, the electron emission is performed for a larger output and the overall power consumption is lower.

Three modifications of the electron emitter 10A according to the first embodiment will be described below with reference to FIGS. 13 through 15.

Figure 13:
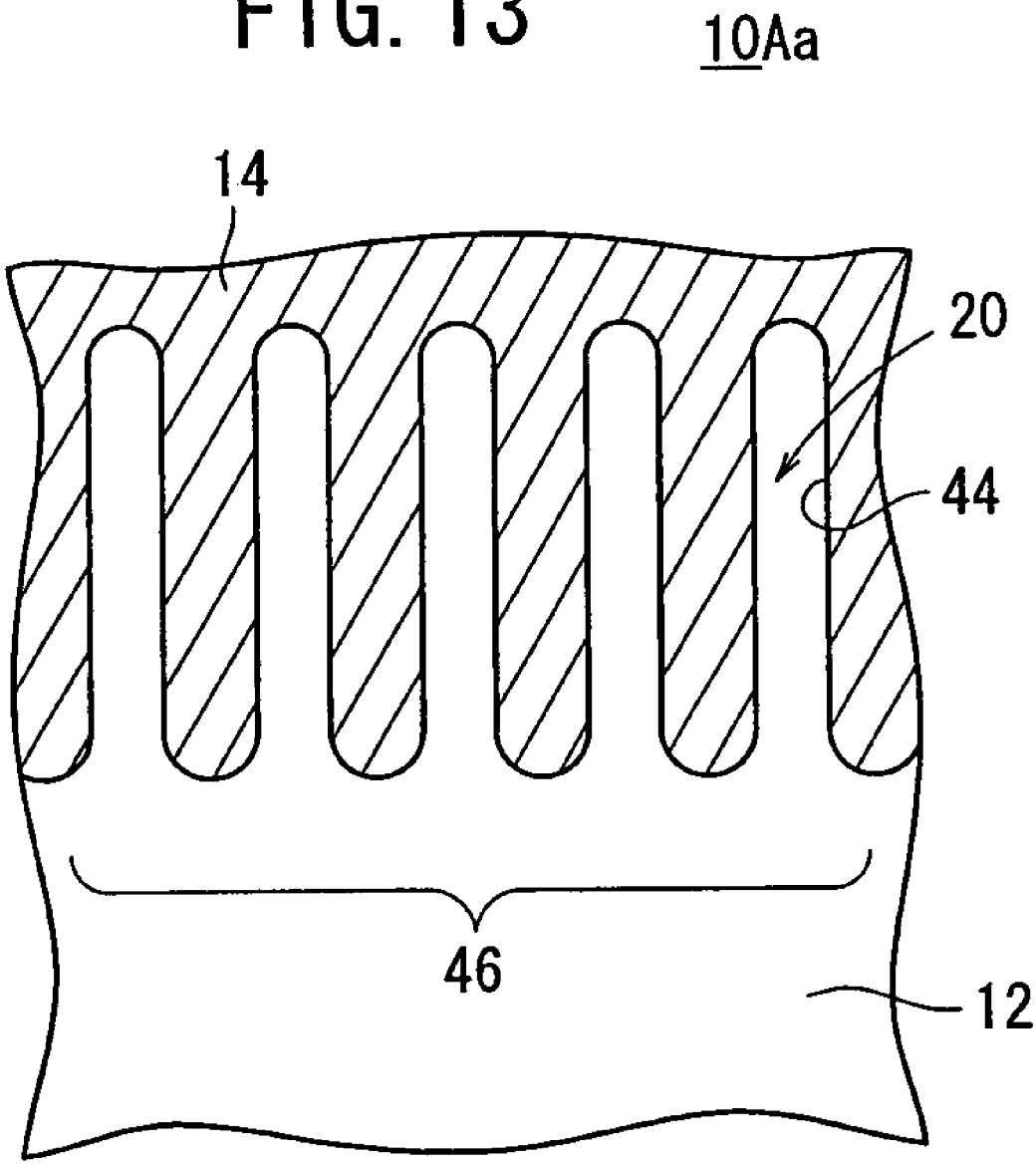
FIG. 13 is a fragmentary plan view of a first modification of the electron emitter according to the first embodiment.

As shown in FIG. 13, an electron emitter 10Aa according to a first modification differs from the above electron emitter 10A in that the through region 20 has a shape, particularly a shape viewed from above, in the form of a recess 44. As shown in FIG. 13, the recess 44 should preferably be shaped such that a number of recesses 44 are successively formed into a saw-toothed recess 46. The saw-toothed recess 46 is effective to reduce variations in the distribution of electrons emitted through the through region 20 for efficient electron emission. Particularly, it is preferable to have the average width of the recesses 44 in the range from 0.1 μm to 10 μm. The average width represents the average of the lengths of a plurality of different line segments extending perpendicularly across the central line of the recess 44.

Figure 14:
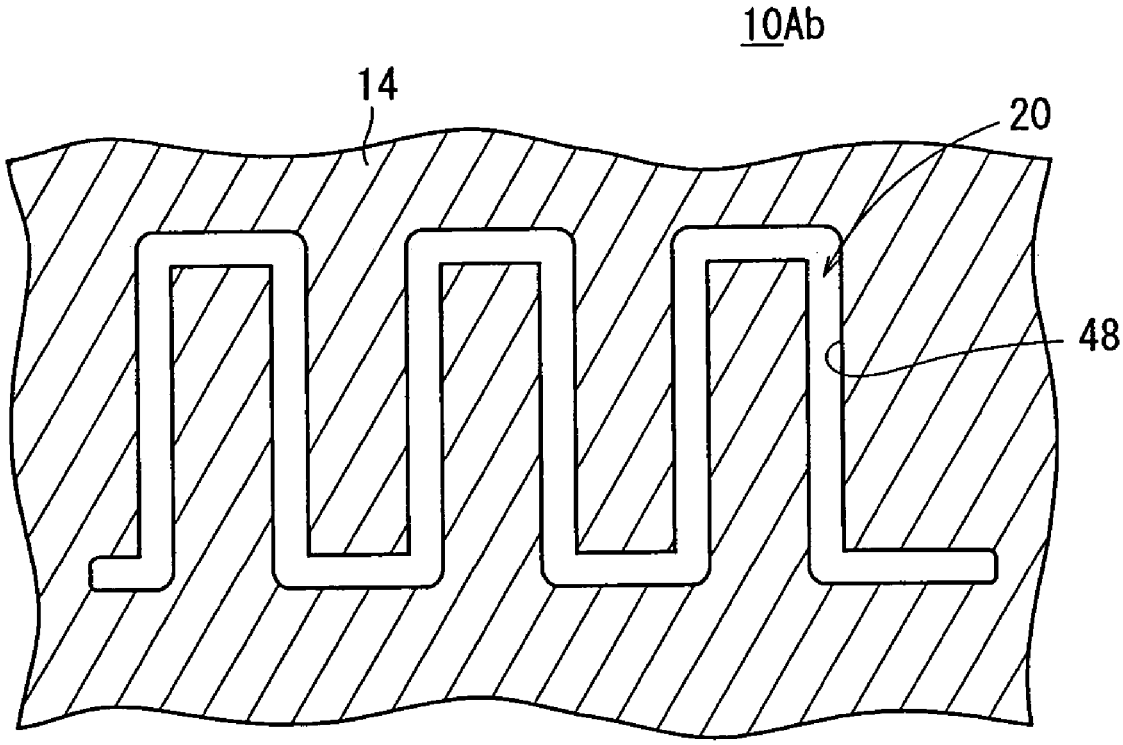
FIG. 14 is a fragmentary plan view of a second modification of the electron emitter according to the first embodiment.

As shown in FIG. 14, an electron emitter 10Ab according to a second modification differs from the above electron emitter 10A in that the through region 20 has a shape, particularly a shape viewed from above, in the form of a slit 48. The slit 48 is defined as something having a major axis (extending in a longitudinal direction) whose length is 10 times or more the length of the minor axis (extending in a transverse direction) thereof. Those having a major axis (extending in a longitudinal direction) whose length is less than 10 times the length of the minor axis (extending in a transverse direction) thereof are defined as holes 32 (see FIG. 3). The slit 48 includes a succession of holes 32 in communication with each other. The slit 48 should preferably have an average width ranging from 0.1 μm to 10 μm for reducing variations in the distribution of electrons emitted through the through region 20 for efficient electron emission. The average width represents the average of the lengths of a plurality of different line segments extending perpendicularly across the central line of the slit 48.

Figure 15:
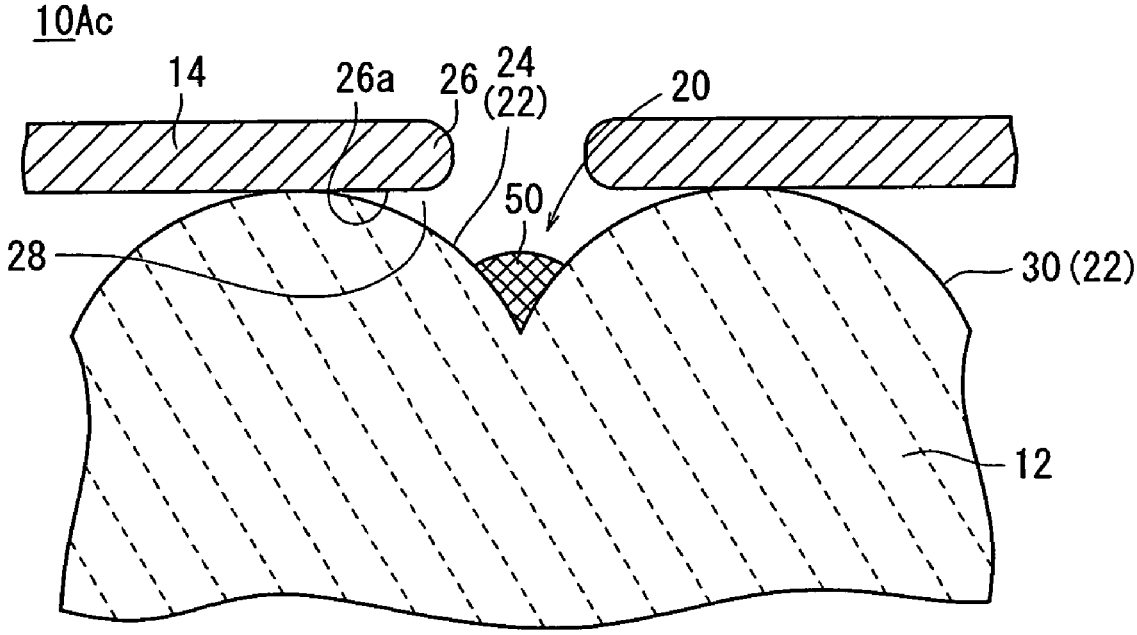
FIG. 15 is a fragmentary cross-sectional view of a third modification of the electron emitter according to the first embodiment.

As shown in FIG. 15, an electron emitter 10Ac according to a third modification differs from the above electron emitter 10A in that a floating electrode 50 exists on the portion of the upper surface of the emitter 12 which corresponds to the through region 20, e.g., in the concavity 24 due to the grain boundary of the dielectric material. With this arrangement, as the floating electrode 50 functions as an electron supply source, the electron emitter 10Ac can emit many electrons through the through region 20 in an electron emission stage (second stage). The electron emission from the floating electrode 50 may be attributed to an electric field concentration at the triple junction of the floating electrode 50, the dielectric material, and the vacuum.

The characteristics of the electron emitter 10A according to the first embodiment, particularly, the voltage vs. charge quantity characteristics (the voltage vs. polarization quantity characteristics) thereof will be described below.

Figure 16:
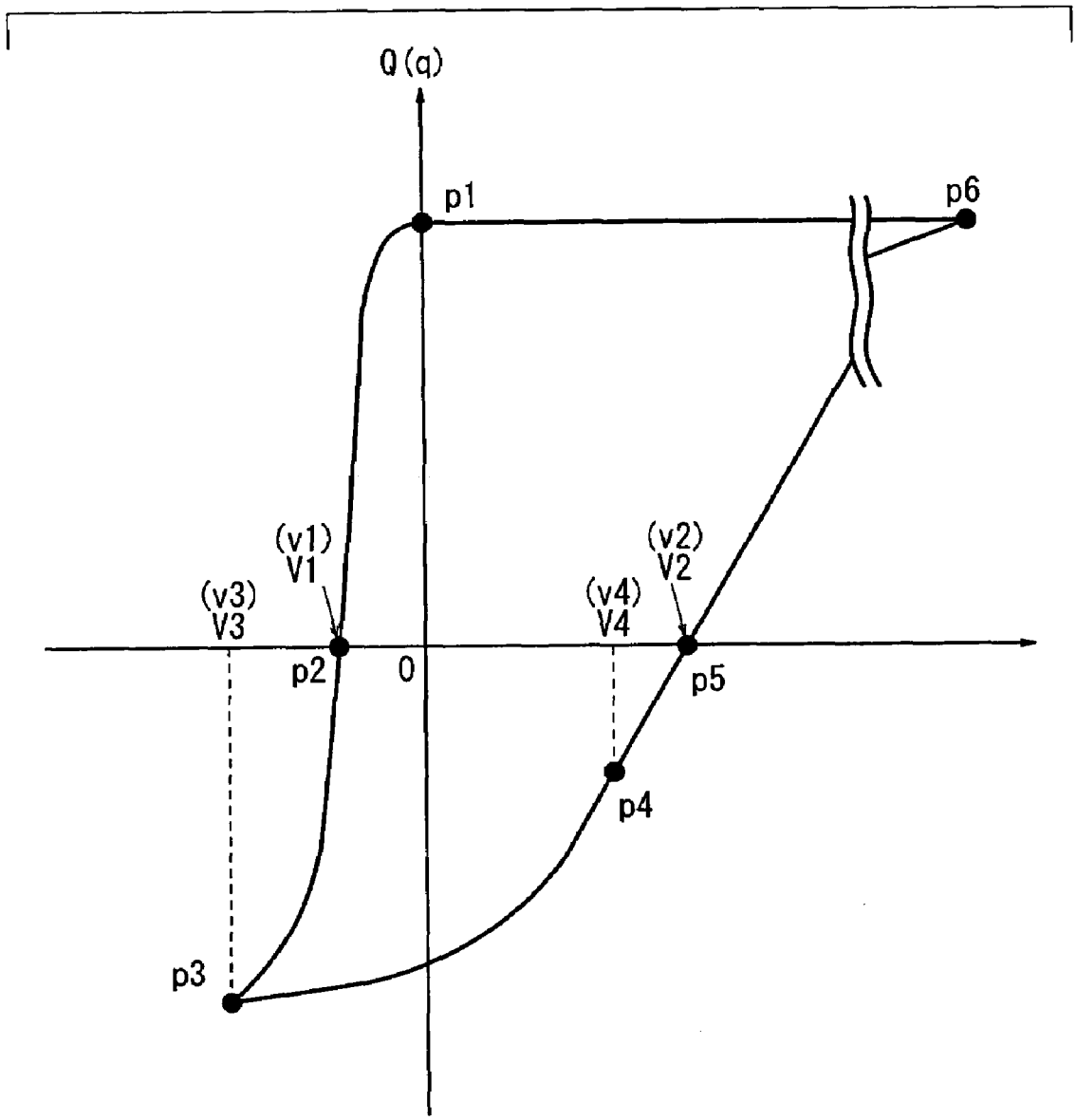
FIG. 16 is a diagram showing the voltage vs. charge quantity characteristics (voltage vs. polarized quantity characteristics) of the electron emitter according to the first embodiment.

The electron emitter 10A is characterized by an asymmetric hysteresis curve based on the reference voltage=0 (V) in vacuum, as indicated by the characteristics shown in FIG. 16.

The voltage vs. charge quantity characteristics will be described below. If a region from which electrons are emitted is defined as an electron emission region, then at a point p1 (initial state) where the reference voltage is applied, almost no electrons are stored in the electron emission region. Thereafter, when a negative voltage is applied, the amount of positive charges of dipoles whose polarization is inverted in the emitter 12 in the electron emission region increases, and electrons are emitted from the upper electrode 14 toward the electron emission region in the first stage, so that electrons are stored. When the level of the negative voltage decreases in a negative direction, electrons are progressively stored in the electron emission region until the amount of positive charges and the amount of electrons are held in equilibrium with each other at a point p2 of the negative voltage. As the level of the negative voltage further decreases in the negative direction, the stored amount of electrons increases, making the amount of negative charges greater than the amount of positive charges. The accumulation of electrons is saturated at a point p3. The amount of negative charges is the sum of the amount of electrons remaining to be stored and the amount of negative charges of the dipoles whose polarization is inverted in the emitter 12.

As the level of the negative voltage further decreases, and a positive voltage is applied in excess of the reference voltage, electrons start being emitted at a point p4 in the second stage. When the positive voltage increases in a positive direction, the amount of emitted electrons increases until the amount of positive charges and the amount of electrons are held in equilibrium with each other at a point p5. At a point p6, almost all the stored electrons are emitted, bringing the difference between the amount of positive charges and the amount of negative charges into substantial conformity with a value in the initial state. That is, almost all stored electrons are eliminated, and only the negative charges of dipoles whose polarization is inverted in the emitter 12 appear in the electron emission region.

The voltage vs. charge quantity characteristics have the following features:

(1) If the negative voltage at the point p2 where the amount of positive charges and the amount of electrons are held in equilibrium with each other is represented by V1 and the positive voltage at the point p5 by V2, then these voltages satisfy the following relationship:

$$|V1|<|V2|$$

(2) More specifically, the relationship is expressed as $1.5\times|V1|<|V2|$ (3) If the rate of change of the amount of positive charges and the amount of electrons at the point p2 is represented by $\Delta Q1/\Delta V1$ and the rate of change of the amount of positive charges and the amount of electrons at the point p5 by $\Delta Q2/\Delta V2$, then these rates satisfy the following relationship:

$$(\Delta Q1/\Delta V1)>(\Delta Q2/\Delta V2)$$

(4) If the voltage at which the accumulation of electrons is saturated is represented by V3 and the voltage at which electrons start being emitted by V4, then these voltages satisfy the following relationship:

$$1\leqq|V4|/|V3|\leqq 1.5$$

The characteristics shown in FIG. 16 will be described below in terms of the voltage vs. polarization quantity characteristics. It is assumed that the emitter 12 is polarized in one direction, with dipoles having negative poles facing toward the upper surface of the emitter 12 (see FIG. 17A).

Figure 17A:
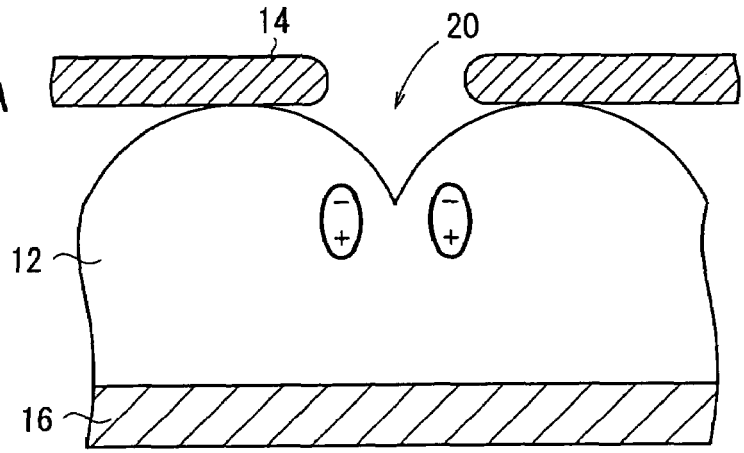
FIG. 17A is a view illustrative of a state at a point p1 shown in FIG. 16.
Figure 17B:
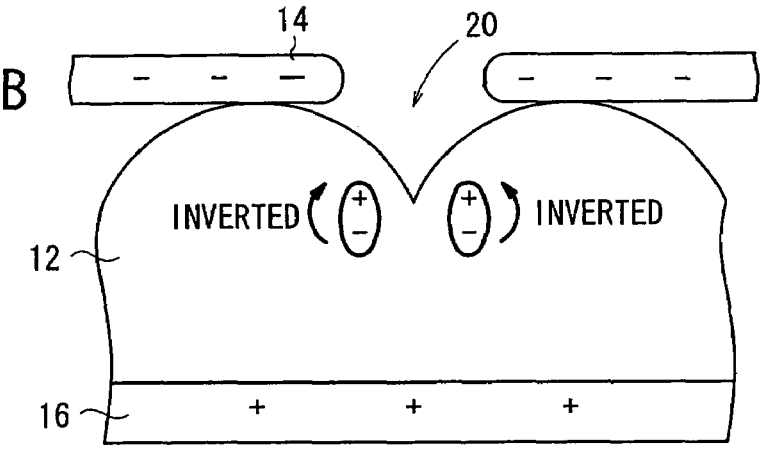
FIG. 17B is a view illustrative of a state at a point p2 shown in FIG. 16.
Figure 17C:
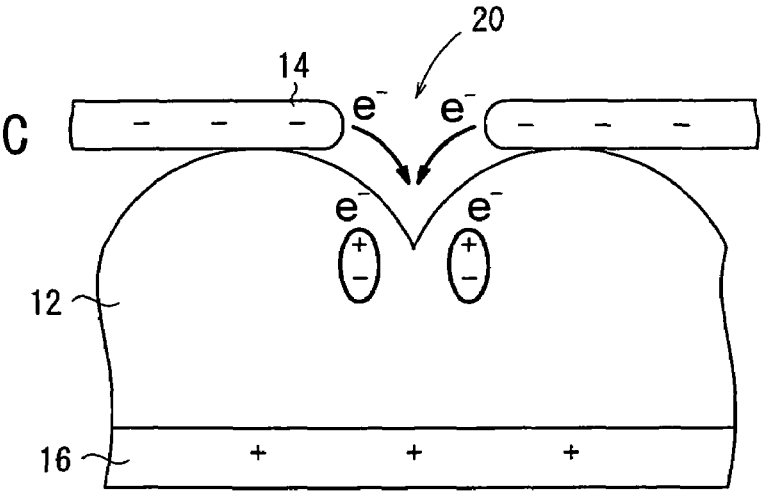
FIG. 17C is a view illustrative of a state from the point p2 to a point p3 shown in FIG. 16.

At the point p1 (initial state) where the reference voltage (e.g., 0 V) is applied as shown in FIG. 16, since the negative poles of the dipole moments face toward the upper surface of the emitter 12, as shown in FIG. 17A, almost no electrons are accumulated on the upper surface of the emitter 12.

Thereafter, when a negative voltage is applied and the level of the negative voltage is decreased in the negative direction, the polarization starts being inverted substantially at the time the negative voltage exceeds a negative coercive voltage (see the point p2 in FIG. 16). All the polarization is inverted at the point p3 shown in FIG. 16 (see FIG. 17B). Because of the polarization inversion, an electric field concentration occurs at the triple junction, and the upper electrode 14 emits electrons toward the emitter 12 in the first stage, causing electrons to be accumulated in the portion of the emitter 12 which is exposed through the through region 20 of the upper electrode 14 and the portion of the emitter 12 which is near the peripheral portion of the upper electrode 14 (see FIG. 17C). In particular, electrons are emitted (emitted inwardly) from the upper electrode 14 toward the portion of the emitter 12 which is exposed through the through region 20 of the upper electrode 14. At the point p3 shown in FIG. 16, the accumulation of electrons is saturated.

Figure 18A:
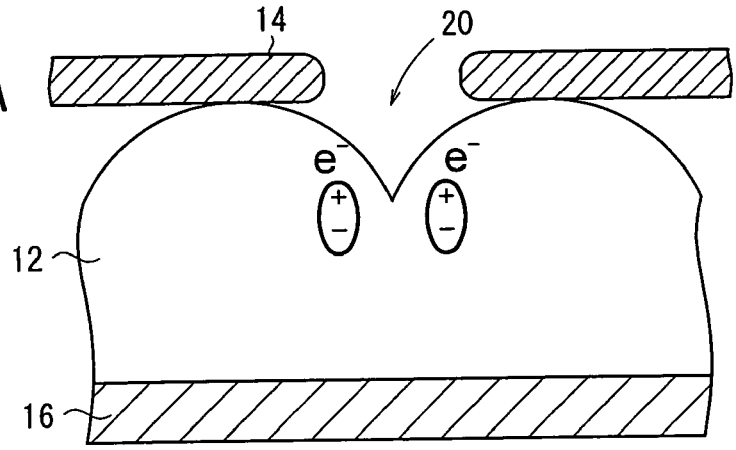
FIG. 18A is a view illustrative of a state from the point p3 to a point p4 shown in FIG. 16.
Figure 18B:
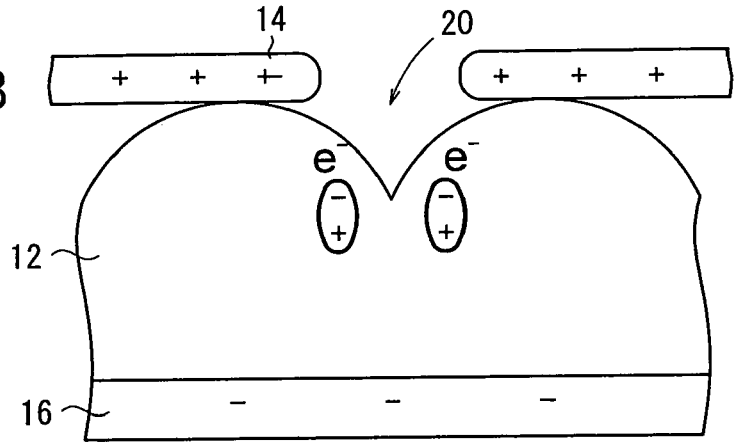
FIG. 18B is a view illustrative of a state immediately prior to a point p4 shown in FIG. 16.

Thereafter, when the level of the negative voltage is reduced and a positive voltage is applied in excess of the reference voltage, the upper surface of the emitter 12 is kept charged up to a certain voltage level (see FIG. 18A). As the level of the positive voltage is increased, there is produced a region where the negative poles of dipoles start facing the upper surface of the emitter 12 (see FIG. 18B) immediately prior to the point p4 in FIG. 16. When the level is further increased, electrons start being emitted due to coulomb repulsive forces posed by the negative poles of the dipoles after the point p4 in FIG. 16 (see FIG. 18C). When the positive voltage is increased in the positive direction, the amount of emitted electrons is increased. Substantially at the time the positive voltage exceeds the positive coercive voltage (the point p5), a region where the polarization is inverted again is increased. At the point p6, almost all the accumulated electrons are emitted, and the amount of polarization at this time is essentially the same as the amount of polarization in the initial state.

The characteristics of the electron emitter 12 has have the following features:

(A) If the negative coercive voltage is represented by v1 and the positive coercive voltage by v2, then $$|v1|<|v2|$$

(B) More specifically, $1.5\times|v1|<|v2|$ (C) If the rate of change of the polarization at the time the negative coercive voltage v1 is applied is represented by $\Delta q1/\Delta v1$ and the rate of change of the amount of positive charges and the rate of change of the polarization at the time the positive coercive voltage v2 is applied is represented by $\Delta q2/\Delta v2$, then $$(\Delta q1/\Delta v1)>(\Delta q2/\Delta v2)$$

(D) If the voltage at which the accumulation of electrons is saturated is represented by v3 and the voltage at which electrons start being emitted by v4, then $$1\leqq|v4|/|v3|\leqq 1.5$$

Since the electron emitter 10A has the above characteristics, it can easily be applied to a display which has a plurality of electron emitters 10A arrayed in association with a plurality of pixels, for emitting light due to the emission of electrons from the electron emitters 10A.

A display 100 which employs the electron emitters 10A according to the first embodiment will be described below.

Figure 19:
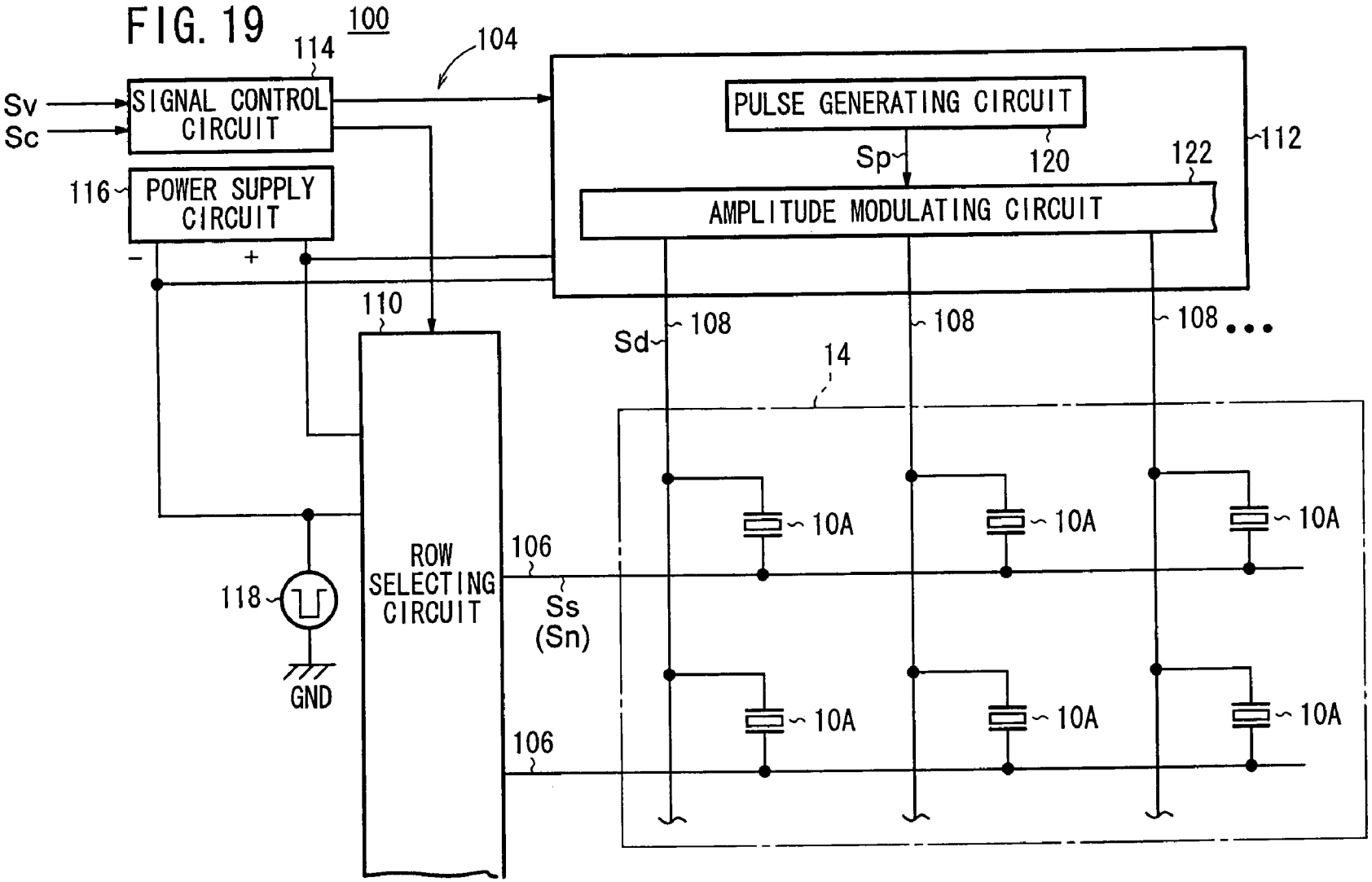
FIG. 19 is a block diagram of a display area and a drive circuit that are used in a display which employs the electron emitter according to the first embodiment.

As shown in FIG. 19, the display 100 has a display section 102 comprising a matrix or staggered pattern of electron emitters 10A corresponding to respective pixels, and a drive circuit 104 for driving the display section 102. One electron emitter 10A may be assigned to each pixel, or a plurality of electron emitters 10A may be assigned to each pixel. In the present embodiment, it is assumed for the sake of brevity that one electron emitter 10A is assigned to each pixel.

The drive circuit 104 has a plurality of row select lines 106 for selecting rows in the display section 102 and a plurality of signal lines 108 for supplying pixel signals Sd to the display section 102.

The drive circuit 104 also has a row selecting circuit 110 for supplying a selection signal Ss selectively to the row select lines 106 to successively select a row of electron emitters 10A, a signal supplying circuit 112 for supplying parallel pixel signals Sd to the signal lines 108 to supply the pixel signals Sd to a row (selected row) selected by the row selecting circuit 110, and a signal control circuit 114 for controlling the row selecting circuit 110 and the signal supplying circuit 112 based on a video signal Sv and a synchronizing signal Sc that are input to the signal control circuit 114.

A power supply circuit 116 (which supplies 50 V and 0 V, for example) is connected to the row selecting circuit 110 and the signal supplying circuit 112. A pulse power supply 118 is connected between a negative line between the row selecting circuit 110 and the power supply circuit 116, and GND (ground). The pulse power supply 118 outputs a pulsed voltage waveform having a reference voltage (e.g., 0 V) during a charge accumulation period Td, to be described later, and a certain voltage (e.g., −400 V) during a light emission period Th.

During the charge accumulation period Td, the row selecting circuit 110 outputs the selection signal Ss to the selected row and outputs a non-selection signal Sn to the unselected rows. During the light emission period Th, the row selecting circuit 110 outputs a constant voltage (e.g., −350 V) which is the sum of a power supply voltage (e.g., 50 V) from the power supply circuit 116 and a voltage (e.g., −400 V) from the pulse power supply 118.

The signal supplying circuit 112 has a pulse generating circuit 120 and an amplitude modulating circuit 122. The pulse generating circuit 120 generates and outputs a pulse signal Sp having a constant pulse period and a constant amplitude (e.g., 50 V) during the charge accumulation period Td, and outputs a reference voltage (e.g., 0 V) during the light emission period Th.

During the charge accumulation period Td, the amplitude modulating circuit 122 amplitude-modulates the pulse signal Sp from the pulse generating circuit 120 depending on the luminance levels of the light-emitting devices of the selected row, and outputs the amplitude-modulated pulse signal Sp as the pixel signal Sd for the pixels of the selected row. During the light emission period Th, the amplitude modulating circuit 122 outputs the reference voltage from the pulse generating circuit 120 as it is. The timing control in the amplitude modulating circuit 122 and the supply of the luminance levels of the selected pixels to the amplitude modulating circuit 122 are performed through the signal supplying circuit 114.

Figure 20A:
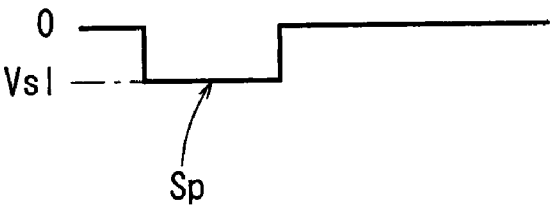
FIGS. 20A through 20C are waveform diagrams illustrative of the amplitude modulation of pulse signals by an amplitude modulating circuit.
Figure 20B:
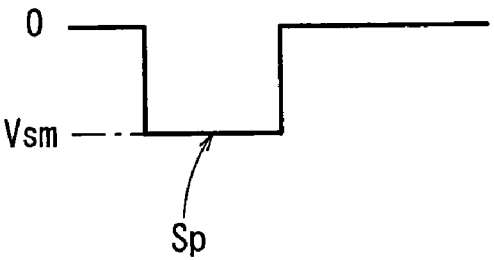
Figure 20C:
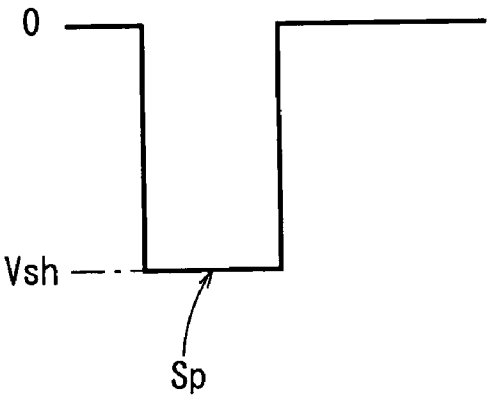

For example, as indicated by three examples shown in FIGS. 20A through 20C, if the luminance level is low, then the amplitude of the pulse signal Sp is set to a low level Vsl (see FIG. 20A), if the luminance level is medium, then the amplitude of the pulse signal Sp is set to a medium level Vsm (see FIG. 20B), and if the luminance level is high, then the amplitude of the pulse signal Sp is set to a high level Vsh (see FIG. 20C). Though the amplitude of the pulse signal Sp is modulated into three levels in the above examples, if the amplitude modulation is applied to the display 100, then the pulse signal Sp is amplitude-modulated to 128 levels or 256 levels depending on the luminance levels of the pixels.

A modification of the signal supplying circuit 112 will be described below with reference to FIGS. 21 through 22C.

Figure 21:
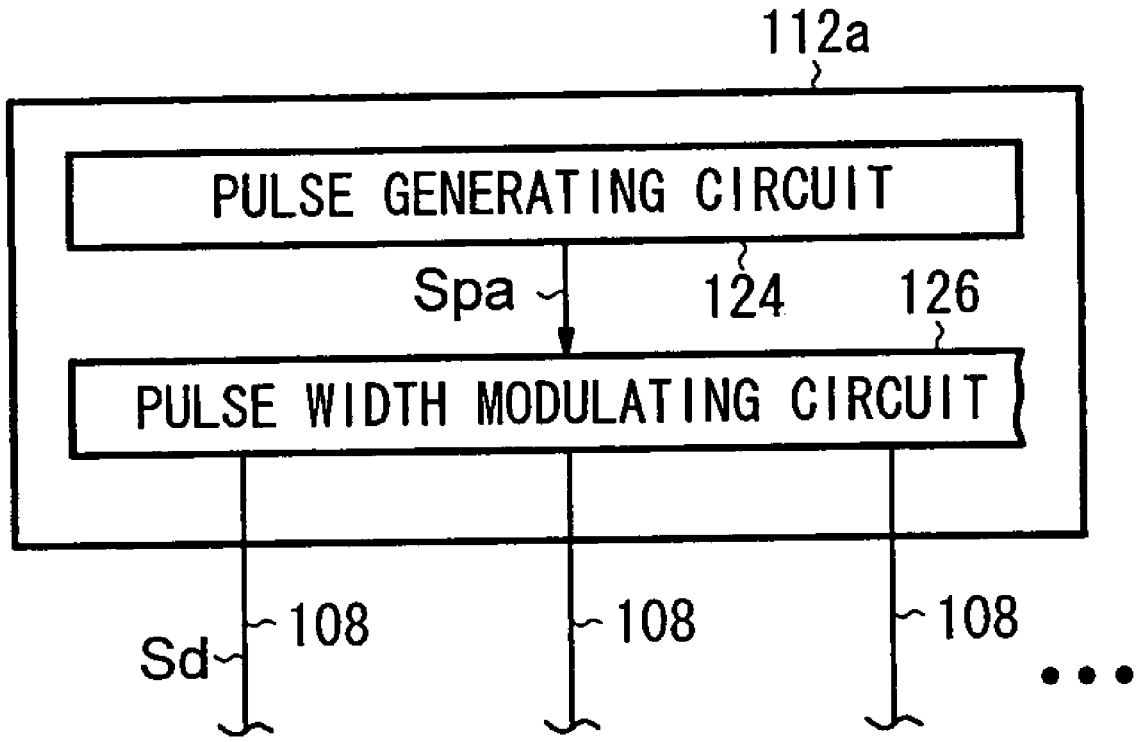
FIG. 21 is a block diagram of a signal supply circuit according to a modification.

As shown in FIG. 21, a modified signal supplying circuit 112*a* has a pulse generating circuit 124 and a pulse width modulating circuit 126. The pulse generating circuit 124 generates and outputs a pulse signal Spa (indicated by the broken lines in FIGS. 22A through 22C) where the positive-going edge of a voltage waveform (indicated by the solid lines in FIGS. 22A through 22C) applied to the electron emitter 10A is continuously changed in level, during the charge accumulation period Td. The pulse generating circuit 124 outputs a reference voltage during the light emission period Th. During the charge accumulation period Td, the pulse width modulating circuit 126 modulates the pulse width Wp (see FIGS. 22A through 22C) of the pulse signal Spa from the pulse generating circuit 124 depending on the luminance levels of the pixels of the selected row, and outputs the pulse signal Spa with the modulated pulse width Wp as the data signal Sd for the pixels of the selected row. During the light emission period Th, the pulse width modulating circuit 126 outputs the reference voltage from the pulse generating circuit 124 as it is. The timing control in the pulse width modulating circuit 126 and the supply of the luminance levels of the selected pixels to the pulse width modulating circuit 126 are also performed through the signal supplying circuit 114.

Figure 22A:
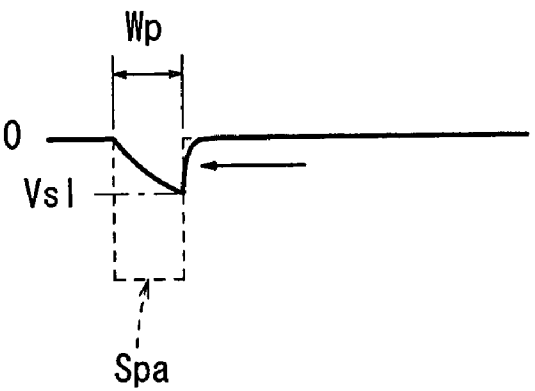
FIGS. 22A through 22C are waveform diagrams illustrative of the pulse width modulation of pulse signals by a pulse width modulating circuit.
Figure 22B:
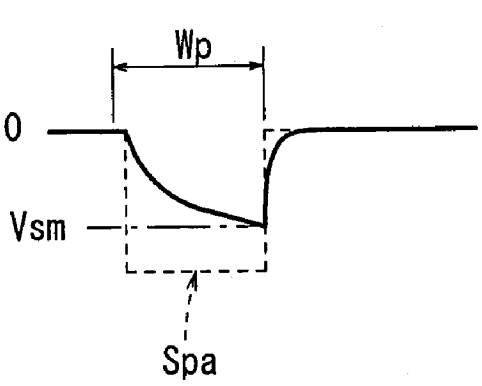
Figure 22C:
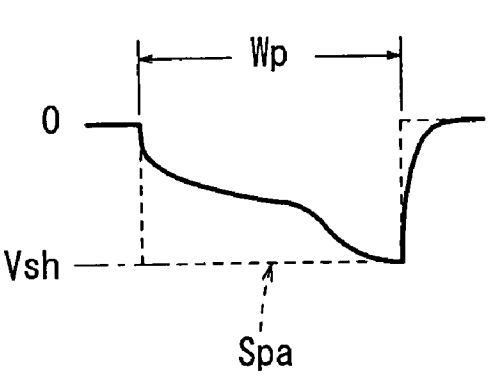

For example, as indicated by three examples shown in FIGS. 22A through 22C, if the luminance level is low, then the pulse width Wp of the pulse signal Spa is set to a short width, setting the substantial amplitude to a low level Vsl (see FIG. 22A), if the luminance level is medium, then the pulse width Wp of the pulse signal Spa is set to a medium width, setting the substantial amplitude to a medium level Vsm (see FIG. 22B), and if the luminance level is high, then the pulse width Wp of the pulse signal Spa is set to a long width, setting the substantial amplitude to a high level Vsh (see FIG. 22C). Though the pulse width Wp of the pulse signal Spa is modulated into three levels in the above examples, if the amplitude modulation is applied to the display 100, then the pulse signal Spa is pulse-width-modulated to 128 levels or 256 levels depending on the luminance levels of the pixels.

Figure 23A:
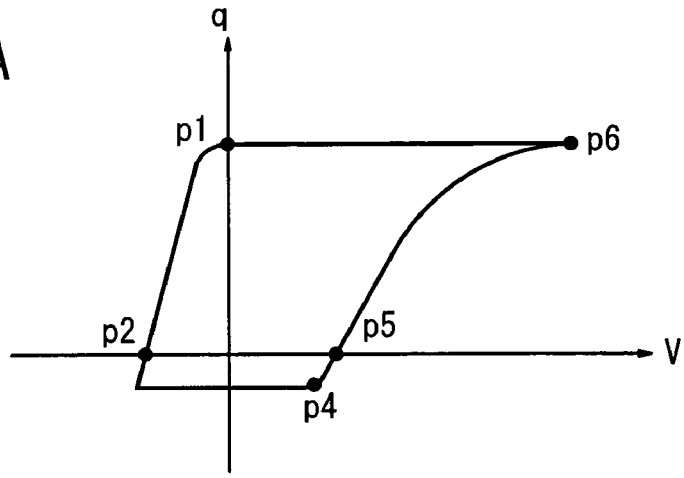
FIG. 23A is a diagram showing a hysteresis curve plotted when a voltage Vsl shown in FIG. 20A or 22A is applied.
Figure 23B:
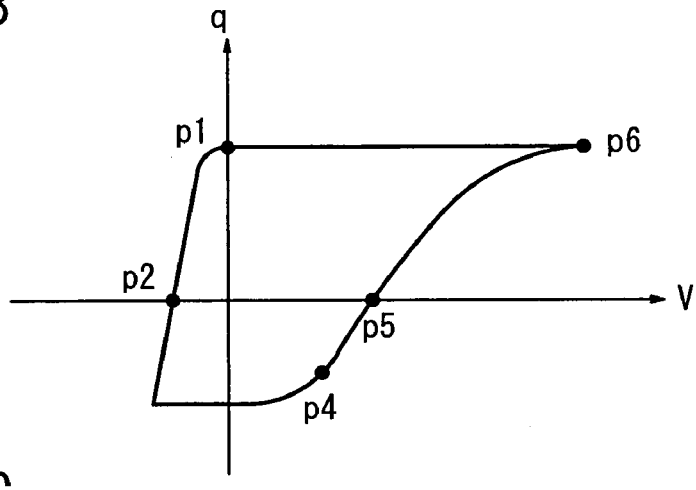
FIG. 23B is a diagram showing a hysteresis curve plotted when a voltage Vsm shown in FIG. 20B or 22B is applied.

Changes of the characteristics at the time the level of the negative voltage for the accumulation of electrons will be reviewed in relation to the three examples of amplitude modulation on the pulse signal Sp shown in FIGS. 20A through 20C and the three examples of pulse width modulation on the pulse signal Spa shown in FIGS. 22A through 22C. At the level Vsl of the negative voltage shown in FIGS. 20A and 22A, the amount of electrons accumulated in the electron emitter 10A is small as shown in FIG. 23A. At the level Vsm of the negative voltage shown in FIGS. 20B and 22B, the amount of electrons accumulated in the electron emitter 12B is medium as shown in FIG. 23B. At the level Vsh of the negative voltage shown in FIGS. 20C and 22C, the amount of electrons accumulated in the electron emitter 10A is large and is substantially saturated as shown in FIG. 23C.

Figure 23C:
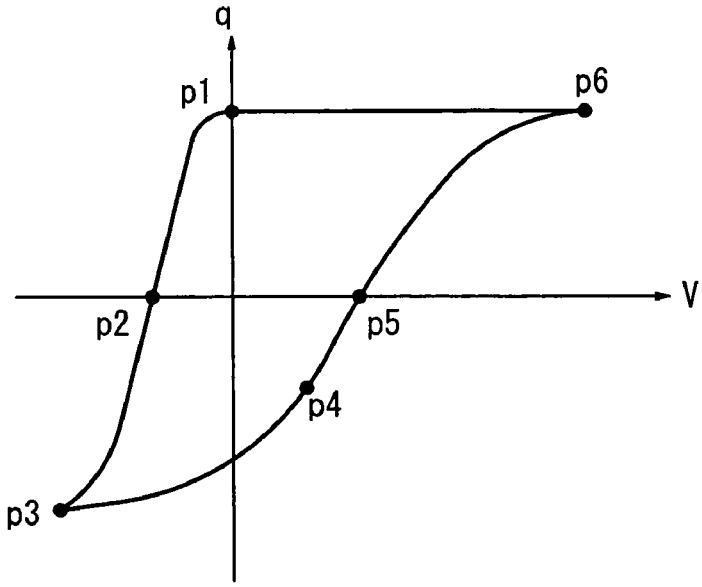
FIG. 23C is a diagram showing a hysteresis curve plotted when a voltage Vsh shown in FIG. 20C or 22C is applied.

However, as shown in FIGS. 23A through 23C, the voltage level at the point p4 where electrons start being emitted is substantially the same. That is, even if the applied voltage changes to the voltage level indicated at the point p4 after electrons are accumulated, the amount of accumulated electrons does not change essentially. It can thus be seen that a memory effect has been caused.

Figure 24:
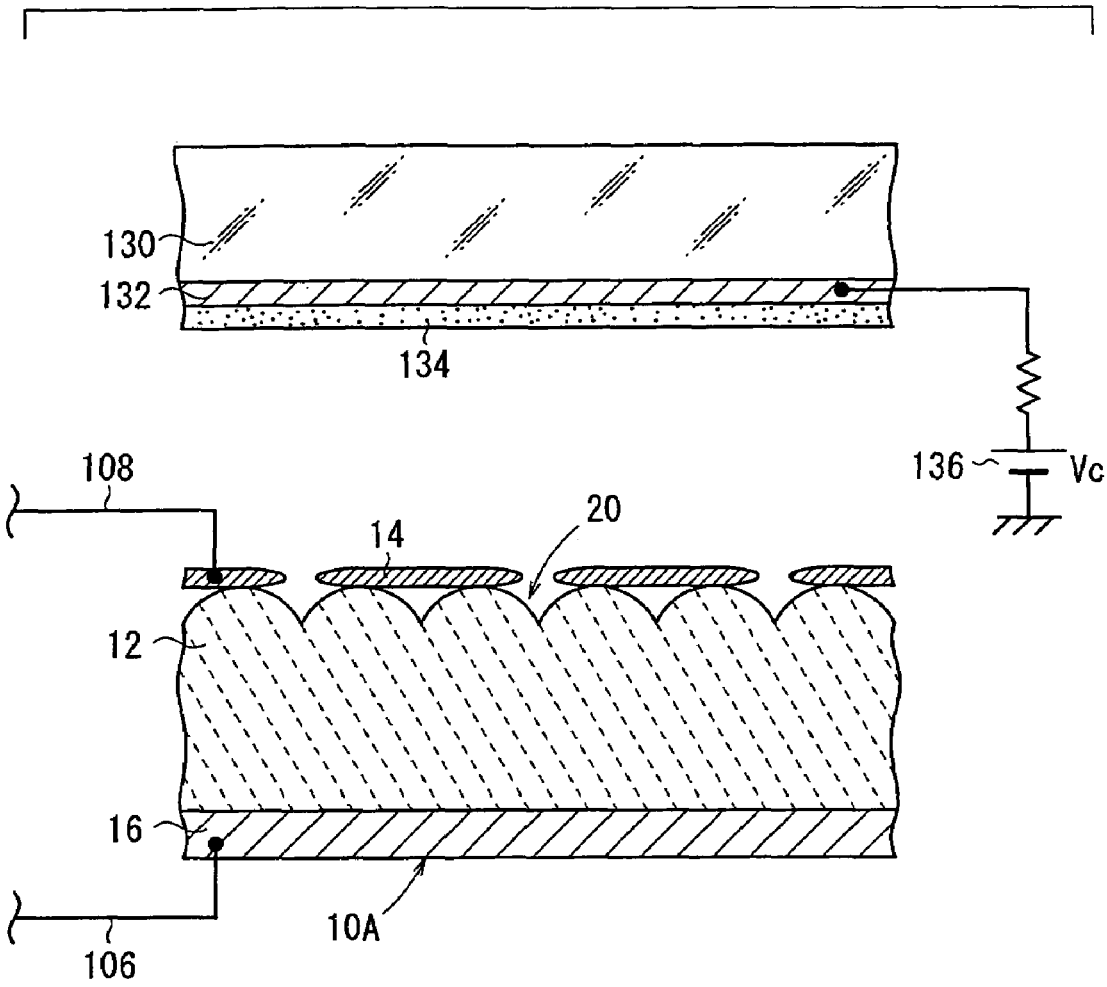
FIG. 24 is a view showing a layout of a collector electrode, a phosphor, and a transparent plate on the upper electrode.

For using the electron emitter 10A as the pixel of the display 100, as shown in FIG. 24, a transparent plate 130 made of glass or acrylic resin is placed above the upper electrode 14, and a collector electrode 132 in the form of a transparent electrode, for example, is placed on the reverse side of the transparent plate 130 (which faces the upper electrode 14), the collector electrode 132 being coated with a phosphor 134. A bias voltage source 136 (collector voltage Vc) is connected to the collector electrode 132 through a resistor. The electron emitter 10A is naturally placed in a vacuum. The vacuum level in the atmosphere should preferably in the range from $10^2$ to $10^{-6}$ Pa and more preferably in the range from $10^{-3}$ to $10^{-5}$ Pa.

The reason for the above range is that in a lower vacuum, (1) many gas molecules would be present in the space, and a plasma can easily be generated and, if an intensive plasma were generated excessively, many positive ions thereof would impinge upon the upper electrode 14 and damage the same, and (2) emitted electrons would tend to impinge upon gas molecules prior to arrival at the collector electrode 132, failing to sufficiently excite the phosphor 134 with electrons that are sufficiently accelerated under the collector voltage Vc.

In a higher vacuum, though electrons would be liable to be emitted from a point where electric field concentrates, structural body supports and vacuum seals would be large in size, posing disadvantages on efforts to make the emitter smaller in size.

Figure 25:
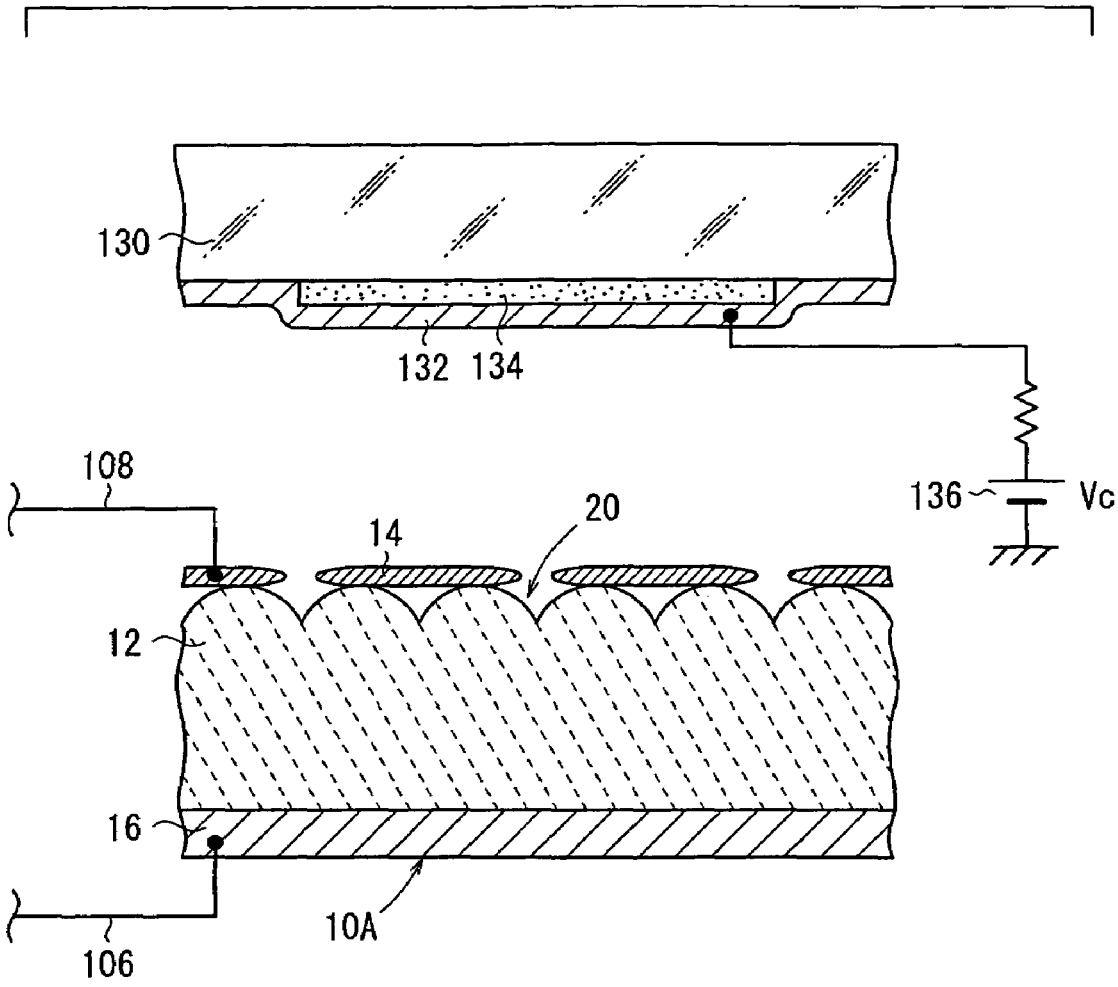
FIG. 25 is a view showing another layout of a collector electrode, a phosphor, and a transparent plate on the upper electrode.

In the embodiment shown in FIG. 24, the collector electrode 132 is formed on the reverse side of the transparent plate 130, and the phosphor 134 is formed on the surface of the collector electrode 132 (which faces the upper electrode 14). According to another arrangement, as shown in FIG. 25, the phosphor 134 may be formed on the reverse side of the transparent plate 130, and the collector electrode 132 may be formed in covering relation to the phosphor 134.

Such another arrangement is for use in a CRT or the like where the collector electrode 132 functions as a metal back. Electrons emitted from the emitter 12 pass through the collector electrode 132 into the phosphor 134, exciting the phosphor 134. Therefore, the collector electrode 132 is of a thickness which allows electrons to pass therethrough, preferably having a thickness of 100 nm or less. As the kinetic energy of the emitted electrons is larger, the thickness of the collector electrode 132 may be increased.

This arrangement offers the following advantages:

(a) If the phosphor 134 is not electrically conductive, then the phosphor 134 is prevented from being charged (negatively), and an electric field for accelerating electrons can be maintained.

(b) The collector electrode 132 reflects light emitted from the phosphor 134, and discharges the light emitted from the phosphor 134 efficiently toward the transparent plate 130 (light emission surface).

(c) Electrons are prevented from impinging excessively upon the phosphor 134, thus preventing the phosphor 134 from being deteriorated and from producing a gas.

Four experimental examples (first through fourth experimental examples) of the electron emitter 10A according to the first embodiment will be shown.

Figure 26A:
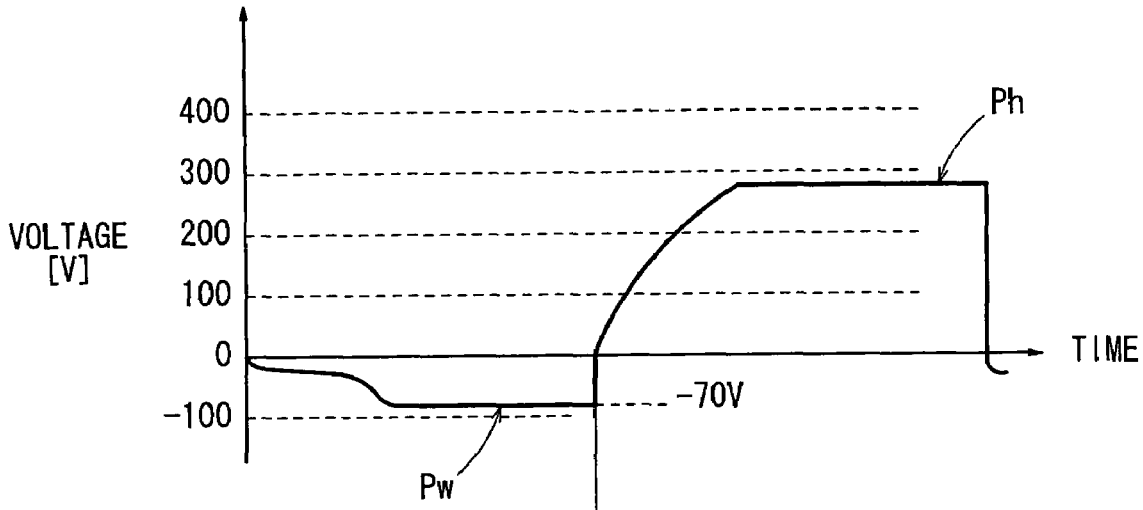
FIG. 26A is a diagram showing the waveform of a write pulse and a turn-on pulse that are used in a first experimental example (an experiment for observing the emission of electrons from an electron emitter)
Figure 26B:
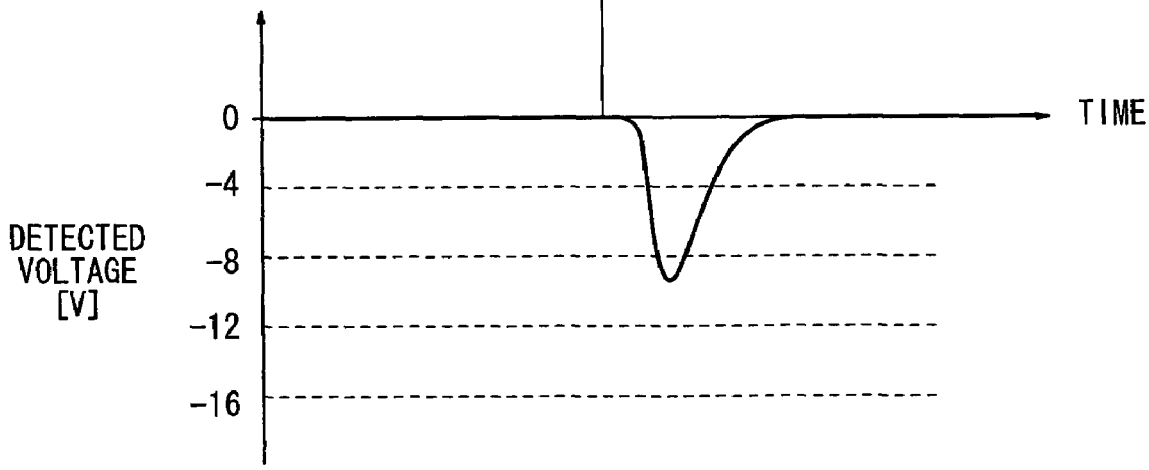
FIG. 26B is a diagram showing the waveform of a detected voltage of a light-detecting device, which is representative of the emission of electrons from the electron emitter in the first experimental example.

According to the first experimental example, the emission of electrons from the electron emitter 10A was observed. Specifically, as shown in FIG. 26A, a write pulse Pw having a voltage of −70 V was applied to the electron emitter 10A to cause the electron emitter 10A to accumulate electrons, and thereafter a turn-on pulse Ph having a voltage of 280 V was applied to cause the electron emitter 10A to emit electrons. The emission of electrons was measured by detecting the light emission from the phosphor 134 with a light-detecting device (photodiode). The detected waveform is shown in FIG. 26B. The write pulse Pw and the turn-on pulse Ph had a duty cycle of 50%.

It can be seen from the first experimental example that light starts to be emitted on a positive-going edge of the turn-on pulse Ph and the light emission is finished in an initial stage of the turn-on pulse Ph. Therefore, it is considered that the light emission will not be affected by shortening the period of the turn-on pulse Ph. This period shortening will lead to a reduction in the period in which to apply the high voltage, resulting in a reduction in power consumption.

Figure 27:
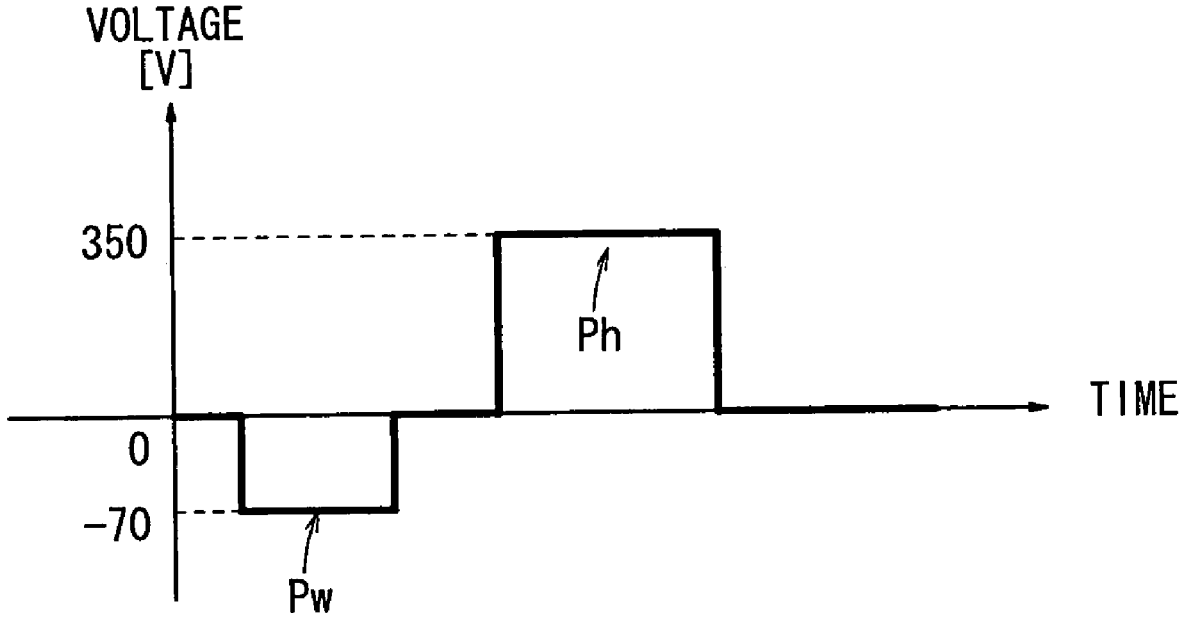
FIG. 27 is a diagram showing the waveform of a write pulse and a turn-on pulse that are used in second through fourth experimental examples.

According to the second experimental example, how the amount of electrons emitted from the electron emitter 10A is changed by the amplitude of the write pulse Pw shown in FIG. 27 was observed. Changes in the amount of emitted electrons were measured by detecting the light emission from the phosphor 134 with a light-detecting device (photodiode), as with the first experimental example. The experimental results are shown in FIG. 28.

Figure 28:
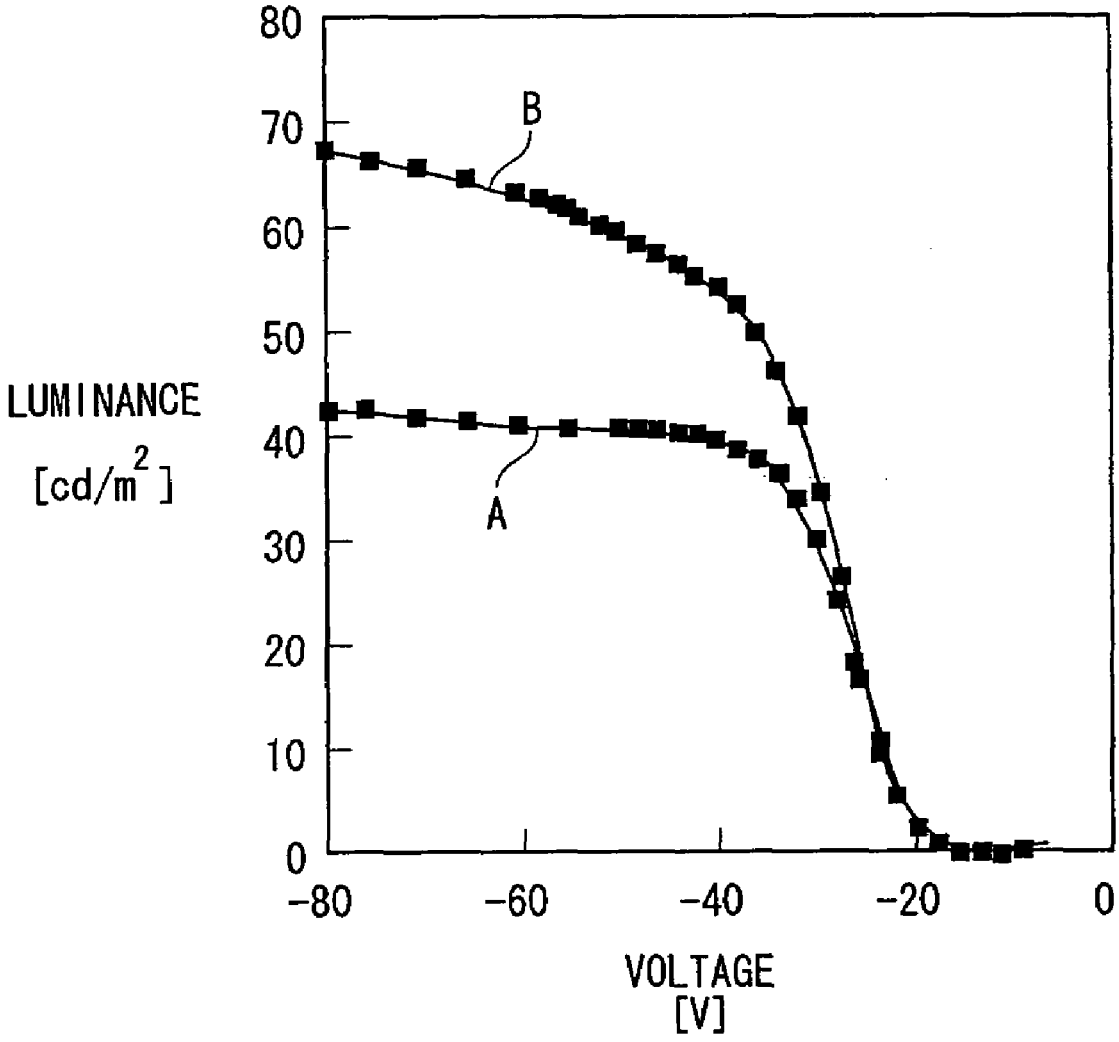
FIG. 28 is a characteristic diagram showing the results of a second experimental example (an experiment for observing how the amount of electrons emitted from the electron emitter changes depending on the amplitude of a write pulse)

In FIG. 28, the solid-line curve A represents the characteristics at the time the turn-on pulse Ph had an amplitude of 200 V and the write pulse Pw had an amplitude changing from −10 V to −80 V, and the solid-line curve B represents the characteristics at the time the turn-on pulse Ph had an amplitude of 350 V and the write pulse Pw had an amplitude changing from −10 V to −80 V.

As illustrated in FIG. 28, when the write pulse Pw is changed from −20 V to −40 V, it can be understood that the light emission luminance changes substantially linearly. A comparison between the amplitudes 350 V and 200 V of the turn-on pulse Ph in particular indicates that a change in the light emission luminance in response to the write pulse Pw at the time the amplitude of the turn-on pulse Ph is 350 V has a wider dynamic range, which is advantageous for increased luminance, and the contrast of the display can be increased. This tendency appears to be more advantageous as the amplitude of the turn-on pulse Ph increases in a range until the light emission luminance is saturated with respect to the setting of the amplitude of the turn-on pulse Ph. It is preferable to set the amplitude of the turn-on pulse Ph to an optimum value in relation to the withstand voltage and power consumption of the signal transmission system.

According to the third experimental example, how the amount of electrons emitted from the electron emitter 10A is changed by the amplitude of the turn-on pulse Ph shown in FIG. 27 was observed. Changes in the amount of emitted electrons were measured by detecting the light emission from the phosphor 134 with a light-detecting device (photodiode), as with the first experimental example. The experimental results are shown in FIG. 29.

Figure 29:
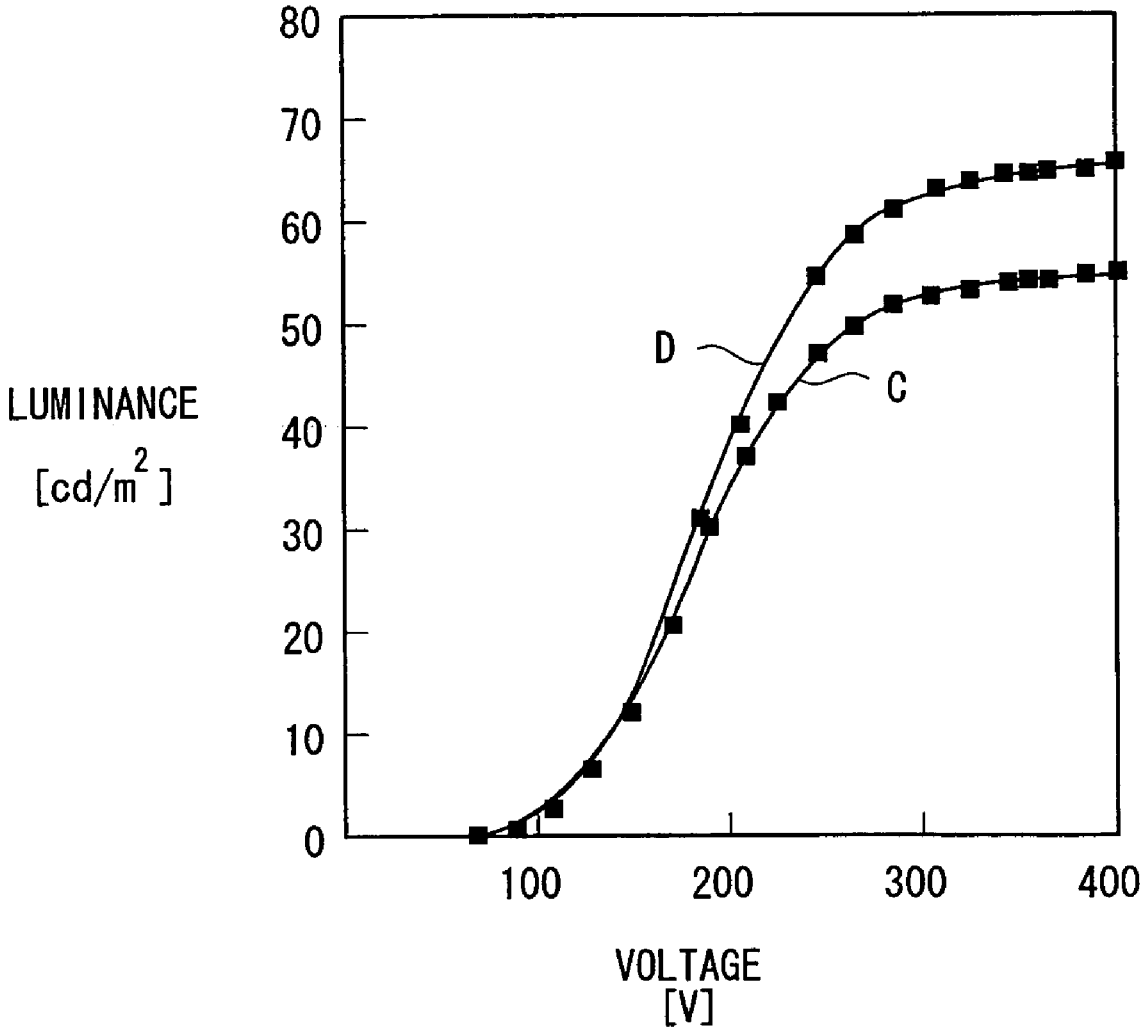
FIG. 29 is a characteristic diagram showing the results of a third experimental example (an experiment for observing how the amount of electrons emitted from the electron emitter changes depending on the amplitude of a turn-on pulse)

In FIG. 29, the solid-line curve C represents the characteristics at the time the write pulse Pw had an amplitude of −40 V and the turn-on pulse Ph had an amplitude changing from 50 V to 400 V, and the solid-line curve D represents the characteristics at the time the write pulse Pw had an amplitude of −70 V and the turn-on pulse Ph had an amplitude changing from 50 V to 400 V.

As illustrated in FIG. 29, when the turn-on pulse Ph is changed from 100 V to 300 V, it can be understood that the light emission luminance changes substantially linearly. A comparison between the amplitudes −40 V and −70 V of the write pulse Pw in particular indicates that a change in the light emission luminance in response to the turn-on pulse Ph at the time the amplitude of the write pulse Pw is −70 V has a wider dynamic range, which is advantageous for increased luminance and also increased contrast of displayed images. This tendency appears to be more advantageous as the amplitude (in this case, the absolute value) of the write pulse Pw increases in a range until the light emission luminance is saturated with respect to the setting of the amplitude of the write pulse Pw. It is preferable also in this case to set the amplitude (absolute value) of the write pulse Pw to an optimum value in relation to the withstand voltage and power consumption of the signal transmission system.

According to the fourth experimental example, how the amount of electrons emitted from the electron emitter 10A is changed by the level of the collector voltage Vc shown in FIG. 24 or 25 was observed. Changes in the amount of emitted electrons were measured by detecting the light emission from the phosphor 134 with a light-detecting device (photodiode), as with the first experimental example. The experimental results are shown in FIG. 30.

Figure 30:
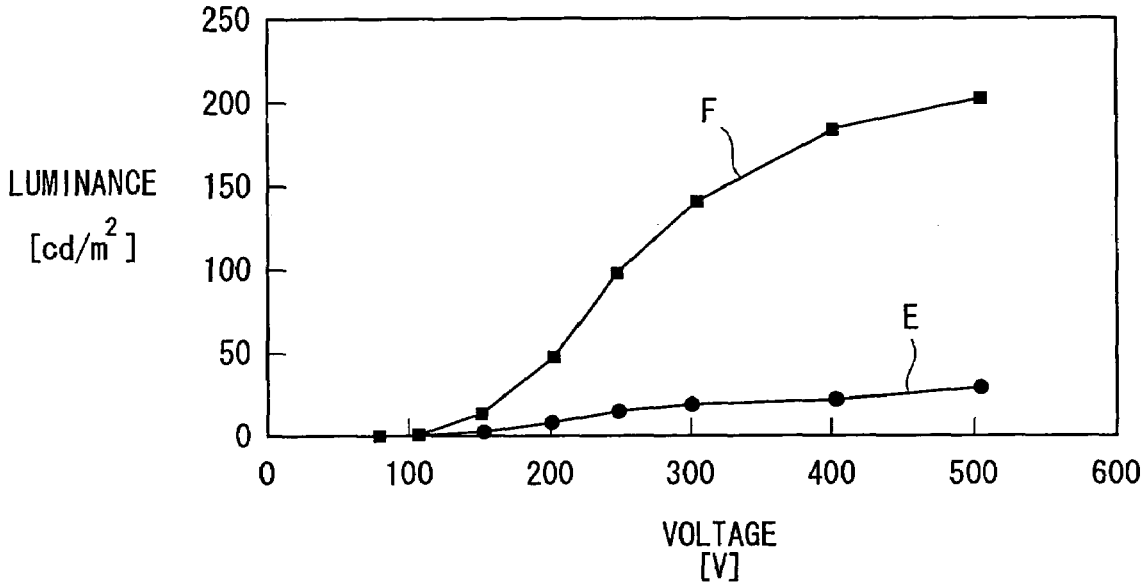
FIG. 30 is a characteristic diagram showing the results of a fourth experimental example (an experiment for observing how the amount of electrons emitted from the electron emitter changes depending on the level of a collector voltage)

In FIG. 30, the solid-line curve E represents the characteristics at the time the level of the collector voltage Vc was 3 kV and the amplitude of the turn-on pulse Ph was changed from 80 V to 500 V, and the solid-line curve F represents the characteristics at the time the level of the collector voltage Vc was 7 kV and the amplitude of the turn-on pulse Ph was changed from 80 V to 500 V.

As illustrated in FIG. 30, it can be understood that a change in the light emission luminance in response to the turn-on pulse Ph has a wider dynamic range when the collector voltage Vc is 7 kV than when the collector voltage Vc is 3 kV, which is advantageous for increased luminance and also increased contrast. This tendency appears to be more advantageous as the level of the collector voltage Vc increases. It is preferable also in this case to set the level of the collector voltage Vc to an optimum value in relation to the withstand voltage and power consumption of the signal transmission system.

Figure 31:
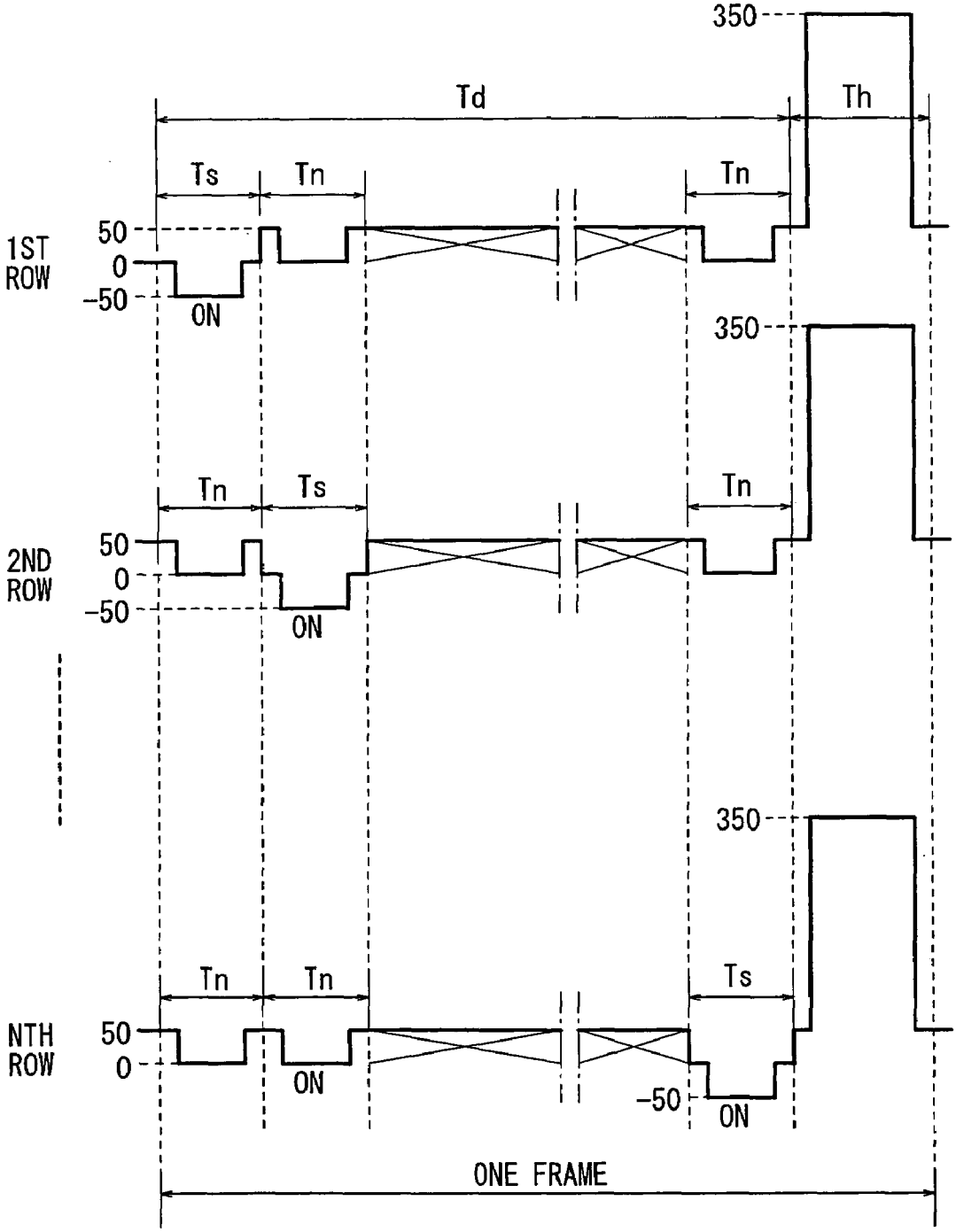
FIG. 31 is a timing chart illustrative of a drive method for the display.

A drive method for the display 100 described above will be described below with reference to FIGS. 31 and 32. FIG. 31 shows operation of pixels in the first row and the first column, the second row and the first column, and the nth row and the first column. An electron emitter 10A used in the drive method has such characteristics that the coercive voltage v1 at the point p2 shown in FIG. 16 is −20 V, for example, the coercive voltage v2 at the point p5 is +70 V, the voltage v3 at the point p3 is −50 V, and the voltage v4 at the point p4 is +50 V.

As shown in FIG. 31, if the period in which to select all the rows is defined as one frame, then one charge accumulation period Td and one light emission period Th are included in one frame, and n selection periods Ts are included in one charge accumulation period Td. Since each selection period Ts becomes a selection period Ts for a corresponding row, it becomes a non-selection period Tn for non-corresponding n−1 rows.

According to the drive method, all the electron emitters 10A are scanned in the charge accumulation period Td, and voltages depending on the luminance levels of corresponding pixels to be turned on (to emit light) are applied to a plurality of electron emitters 10A which correspond to pixels to be turned on, thereby accumulating charges (electrons) in amounts depending on the luminance levels of the corresponding pixels in the electron emitters 10A which correspond to the pixels to be turned on. In the next light emission period Th, a constant voltage is applied to all the electron emitters 10A to cause the electron emitters 10A which correspond to the pixels to be turned on to emit electrons in amounts depending on the luminance levels of the corresponding pixels, thereby emitting light from the pixels to be turned on.

More specifically, as also shown in FIG. 32, in the selection period Ts for the first row, a selection signal Ss of 50 V, for example, is supplied to the row selection line 106 of the first row, and a non-selection signal Sn of 0 V, for example, is applied to the row selection lines 106 of the other rows. A data signal Sd supplied to the signal lines 108 of the pixels to be turned on (to emit light) of all the pixels of the first row has a voltage in the range from 0 V to 30 V, depending on the luminance levels of the corresponding pixels. If the luminance level is maximum, then the voltage of the data signal Sd is 0 V. The data signal Sd is modulated depending on the luminance level by the amplitude modulating circuit 122 shown in FIG. 19 or the pulse width modulating circuit 126 shown in FIG. 21.

Thus, a voltage ranging from −50 V to −20 V depending on the luminance level is applied between the upper and lower electrodes 14, 16 of the electron emitter 10A which corresponds to each of the pixels to be turned on in the first row. As a result, each electron emitter 10A accumulates electrons depending on the applied voltage. For example, the electron emitter 10A corresponding to the pixel in the first row and the first column is in a state at the point p3 shown in FIG. 16 as the luminance level of the pixel is maximum, and the portion of the emitter 12 which is exposed through the through region 20 of the upper electrode 14 accumulates a maximum amount of electrons.

A pixel signal Sd supplied to the electron emitters 10A which correspond to pixels to be turned off (to extinguish light) has a voltage of 50 V, for example. Therefore, a voltage of 0 V is applied to the electron emitters 10A which correspond to pixels to be turned off, bringing those electron emitters 10A into a state at the point p1 shown in FIG. 16, so that no electrons are accumulated in those electron emitters 10A.

After the supply of the pixel signal Sd to the first row is finished, in the selection period Ts for the second row, a selection signal Ss of 50 V is supplied to the row selection line 106 of the second row, and a non-selection signal Sn of 0 V is applied to the row selection lines 106 of the other rows. In this case, a voltage ranging from −50 V to −20 V depending on the luminance level is also applied between the upper and lower electrodes 14, 16 of the electron emitter 10A which corresponds to each of the pixels to be turned on. At this time, a voltage ranging from 0 V to 50 V is applied between the upper and lower electrodes 14, 16 of the electron emitter 10A which corresponds to each of unselected pixels in the first row, for example. Since this voltage is of a level not reaching the point p4 in FIG. 16, no electrons are emitted from the electron emitters 10A which correspond to the pixels to be turned on in the first row. That is, the unselected pixels in the first row are not affected by the pixel signal Sd that is supplied to the selected pixels in the second row.

Similarly, in the selection period Ts for the nth row, a selection signal Ss of 50 V is supplied to the row selection line 106 of the nth row, and a non-selection signal Sn of 0 V is applied to the row selection lines 106 of the other rows. In this case, a voltage ranging from −50 V to −20 V depending on the luminance level is also applied between the upper and lower electrodes 14, 16 of the electron emitter 10A which corresponds to each of the pixels to be turned on. At this time, a voltage ranging from 0 V to 50 V is applied between the upper and lower electrodes 14, 16 of the electron emitter 10A which corresponds to each of unselected pixels in the first through (n−1)th rows. However, no electrons are emitted from the electron emitters 10A which correspond to the pixels to be turned on, of those unselected pixels.

Figure 18C:
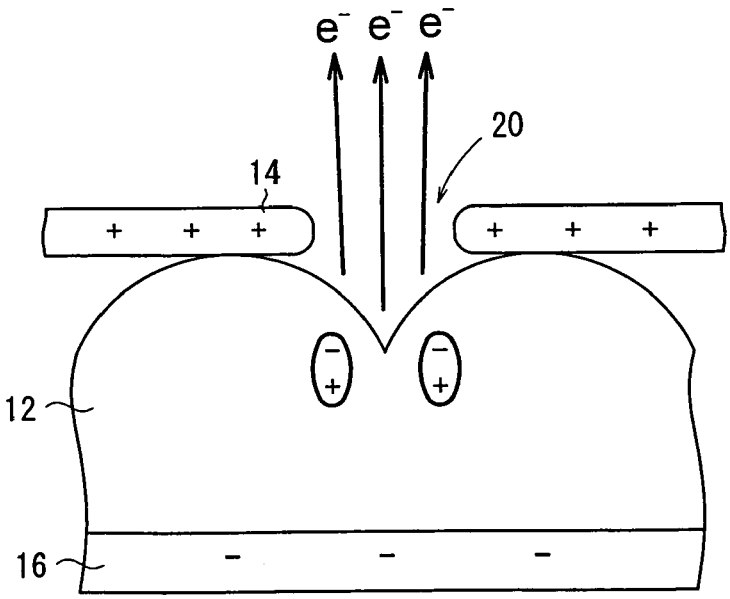
FIG. 18C is a view illustrative of a state from the point p4 to a point p6 shown in FIG. 16.

After elapse of the selection period Ts for the nth row, it is followed by the light emission period Th. In the light emission period Th, a reference voltage (e.g., 0 V) is applied from the signal supplying circuit 112 to the upper electrodes 14 of all the electron emitters 10A, and a voltage of −350 V (the sum of the voltage of −400 V from the pulse power supply 118 and the power supply voltage 50 V from the row selecting circuit 110) is applied to the lower electrodes 16 of all the electron emitters 10A. Thus, a high voltage (+350 V) is applied between the upper and lower electrodes 14, 16 of all the electron emitters 10A. All the electron emitters 10A are now brought into a state at the point p6 shown in FIG. 16. As shown in FIG. 18C, electrons are emitted from the portion of the emitter 12 where the electrons have been accumulated, through the through region 20. Electrons are also emitted from near the outer peripheral portion of the upper electrode 14.

Electrons are thus emitted from the electron emitters 10A which correspond to the pixels to be turned on (to emit light), and the emitted electrons are led to the collector electrodes 132 which correspond to those electron emitters 10A, exciting the corresponding phosphors 134 which emit light. The emitted light is radiated to display an image through the surface of the transparent plate 130.

Subsequently, electrons are accumulated in the electron emitters 10A which correspond to the pixels to be turned on (to emit light) in the charge accumulation period Td, and the accumulated electrons are emitted for fluorescent light emission in the light emission period Th, for thereby radiating emitted light to display a moving or still image through the surface of the transparent plate 130.

The electron emitter according to the first embodiment is easily applicable to the display 100 which has a plurality of electron emitters 10A arrayed in association with respective pixels for displaying an image with electrons emitted from the electron emitters 10A.

For example, as described above, all the electron emitters 10A are scanned in the charge accumulation period Td in one frame, and voltages depending on the luminance levels of corresponding pixels are applied to electron emitters 10A corresponding to the pixels to be turned on, thereby accumulating amounts of charges depending on the luminance levels of corresponding pixels in the electron emitters 10A corresponding to the pixels to be turned on. In the next light emission period Th, a constant voltage is applied to all the electron emitters 10A to cause a plurality of electron emitters 10A which correspond to the pixels to be turned on to emit electrons in amounts depending on the luminance levels of the corresponding pixels, thereby emitting light from the pixels to be turned on.

With the electron emitter 10A according to the first embodiment, the voltage V3 at which the accumulation of electrons is saturated and the voltage V4 at which electrons start being emitted satisfy the following relationship:

$$1 \leqq |V4/V3| \leqq 1.5$$

Usually, if the electron emitters 10A are arranged in a matrix, and when a row of electron emitters 10A is selected at a time in synchronism with a horizontal scanning period and the selected electron emitters 10A are supplied with a pixel signal Sd depending on the luminance levels of the pixels, the pixel signal Sd is also supplied to the unselected pixels.

If the unselected pixels emit electrons, for example, in response to the supplied pixel signal Sd, then the displayed image tends to be of lowered quality and smaller contrast.

Since the electron emitter 10A according the first embodiment has the above characteristics, however, even if a simple voltage relationship is employed such that the voltage level of the pixel signal Sd supplied to the selected electron emitters 10A is set to an arbitrary level from the reference voltage to the voltage V3, and a signal which is opposite in polarity to the pixel signal Sd, for example, is supplied to the unselected electron emitters 10A, the unselected pixels are not affected by the pixel signal Sd supplied to the selected pixels. That is, the amount of electrons accumulated by each electron emitter 10A (the amount of charges in the emitter 12 of each electron emitter 10A) in the selection period Ts is maintained until electrons are emitted in the next light emission period Th. As a result, each electron emitter 10A realizes a memory effect at one pixel for higher luminance and larger contrast.

With the display 100, necessary charges are accumulated in all the electron emitters 10A in the charge accumulation period Td, and a voltage required to emit electrons is applied to all the electron emitters 10A in the subsequent light emission period Th to cause a plurality of electron emitters 10A corresponding to pixels to be turned on to emit electrons thereby to emit light from the pixels to be turned on.

Usually, if pixels are constructed of the electron emitters 10A, then it is necessary to apply a high voltage to the electron emitters 10A in order to emit light from the pixels. For accumulating charges when the pixels are scanned and emitting light from the pixels, it is necessary to apply a high voltage throughout a period (e.g., one frame) for emitting light from one pixel, resulting in large electric power consumption. It is also necessary that the circuit for selecting the electron emitters 10A and supplying the pixel signal Sd be a circuit compatible with the high voltage.

In the present embodiment, after charges are accumulated in all the electron emitters 10*a*, a voltage is applied to all the electron emitters 10A to emit light from pixels corresponding to those electron emitters 10A which are to be turned on.

Therefore, the period Th for applying the voltage (emission voltage) for electron emission to all the electron emitters 10A is naturally shorter than one frame. Furthermore, since the period for applying the emission voltage can be shortened as can be seen from the first experimental example shown in FIGS. 26A and 26B, the electric power consumption can be much smaller than if charges are accumulated and light is emitted when the pixels are scanned.

Since the period Td in which charges are accumulated in the electron emitters 10A and the period Th in which electrons are emitted from the electron emitters 10A corresponding to the pixels to be turned on are separate from each other, the circuit for applying voltages depending on luminance levels to the electron emitters 10A can be driven at a lower voltage.

The pixel signal Sd and the selection signal Ss/non-selection signal Sn in the charge accumulation period Td need to be applied to each row or column. Since the drive voltage may be of several tens volts as can be seen in the above embodiment, an inexpensive multi-output driver for use with fluorescent display tubes or the like can be used. In the light emission period Th, the voltage for emitting sufficient electrons is possibly higher than the drive voltage. However, because all pixels to be turned on may be driven altogether, multi-output circuit components are not necessary. For example, a drive circuit having one output and constructed of discrete components of a high withstand voltage is sufficient, the light source may be inexpensive and may be of a small circuit scale. The drive voltage and discharge voltage may be lowered by reducing the film thickness of the emitter 12. The drive voltage may be set to several volts by setting the film thickness of the emitter 12.

According to the present drive method, furthermore, electrons are emitted in the second stage from all the pixels, independent of the row scanning, separately from the first stage based on the row scanning. Consequently, the light emission time can easily be maintained for increased luminance irrespective of the resolution and the screen size. Furthermore, because an image is displayed at once on the display screen, a moving image free of false contours and image blurs can be displayed.

An electron emitter 10B according to a second embodiment of the present invention will be described below with reference to FIG. 33.

Figure 33:
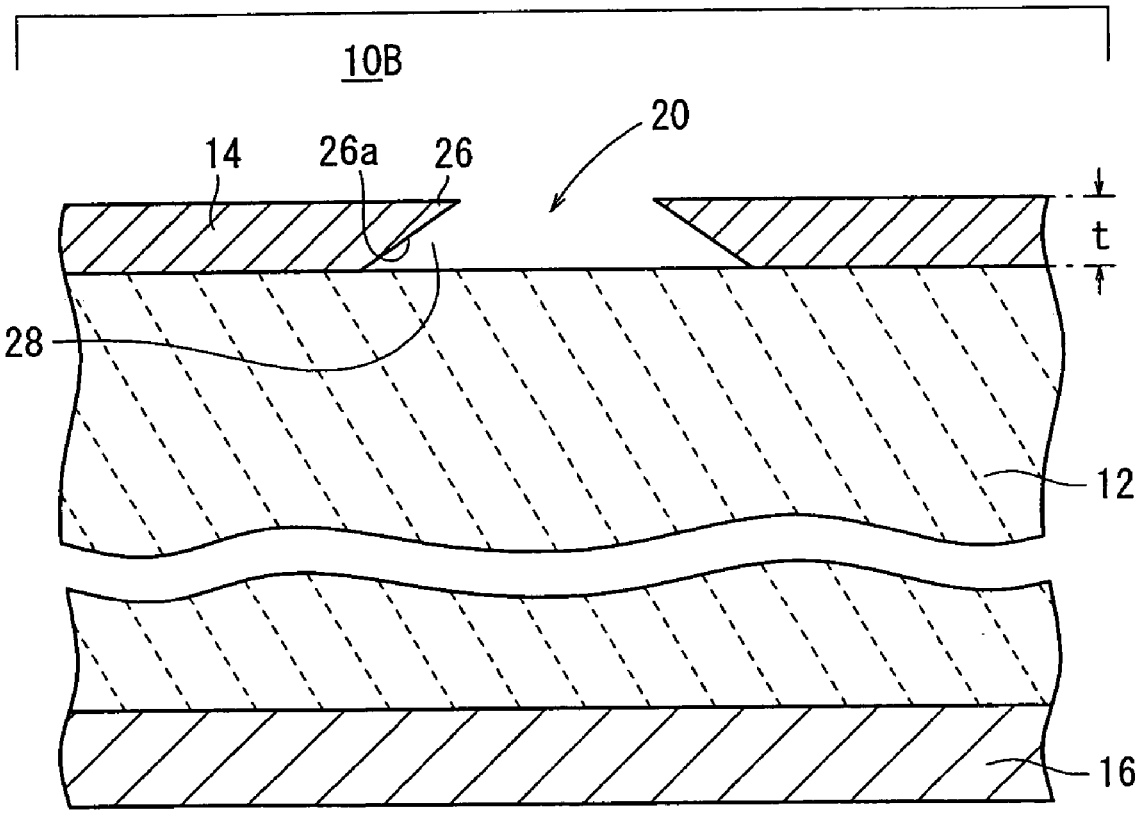
FIG. 33 is a fragmentary cross-sectional view of an electron emitter according to a second embodiment of the present invention.

As shown in FIG. 33, the electron emitter 10B according to the second embodiment has essentially the same structure as the electron emitter 10A according to the first embodiment described above, and resides in that the upper electrode 14 is made of the same material as the lower electrode 16, the upper electrode 14 has a thickness t greater than 10 μm, and the through region 20 is artificially formed by etching (wet etching or dry etching), lift-off, or a laser beam. The through region 20 may be shaped as the hole 32, the recess 44, or the slit 48, as with the electron emitter 10A according to the first embodiment described above.

The peripheral portion 26 of the upper electrode 14 has a lower surface 26*a* slanted gradually upwardly toward the center of the peripheral portion 26. The shape of the peripheral portion 26 can easily be formed by lift-off, for example.

The electron emitter 10B according to the second embodiment, as with the electron emitter 10A according to the first embodiment described above, is capable of easily developing a high electric field concentration, provides many electron emission regions, has a larger output and higher efficiency of the electron emission, and can be driven at a lower voltage (lower power consumption).

Figure 34:
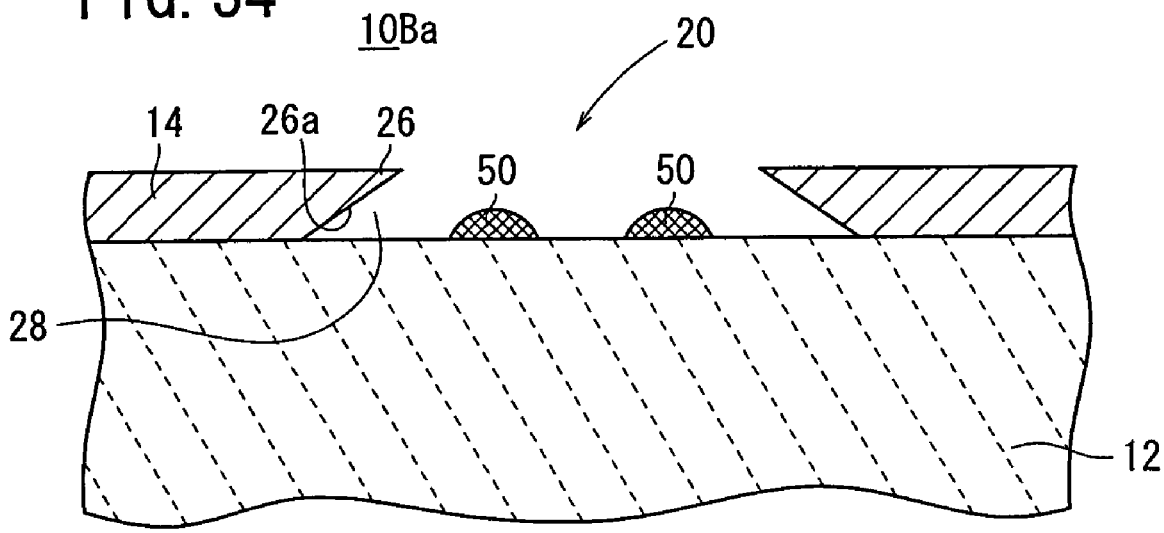
FIG. 34 is a fragmentary cross-sectional view of a first modification of the electron emitter according to the second embodiment.

FIG. 34 shows an electron emitter 10Ba according to a first modification. The electron emitter 10Ba has floating electrodes 50 which are present on the portion of the upper surface of the emitter 12 which corresponds to the through region 20.

Figure 35:
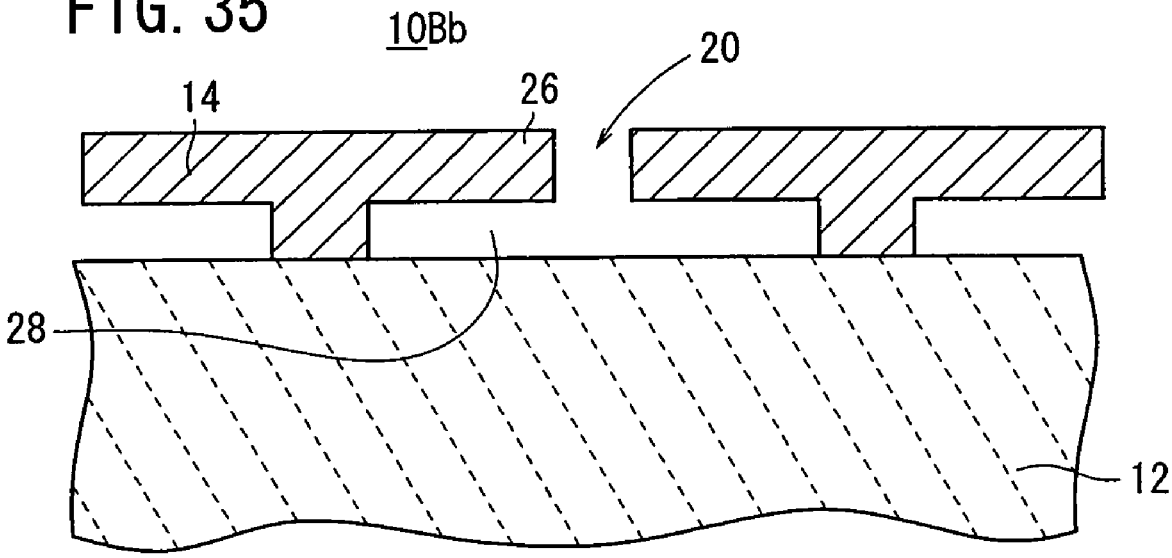
FIG. 35 is a fragmentary cross-sectional view of a second modification of the electron emitter according to the second embodiment.

FIG. 35 shows an electron emitter 12Bb according to a second modification. The electron emitter 12Bb has upper electrodes 14 each having a substantially T-shaped cross section.

Figure 36:
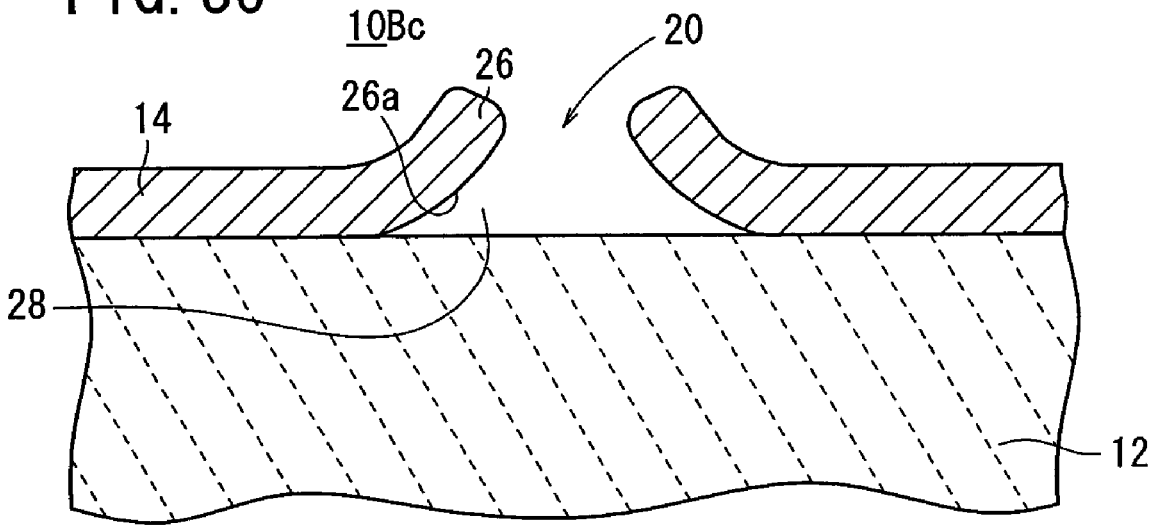
FIG. 36 is a fragmentary cross-sectional view of a third modification of the electron emitter according to the second embodiment.

FIG. 36 shows an electron emitter 12Bc according to a third modification. The electron emitter 12Bc has an upper electrode 14 including a lifted peripheral portion 26 of a through region 20. To produce such a shape, the film material of the upper electrode 14 contains a material which will be gasified in the baking process. In the process, the material is gasified, forming a number of through regions 20 in the upper electrode 14 and lifting the peripheral portions 26 of the through regions 20.

An electron emitter 10C according to a third embodiment will be described below with reference to FIG. 37.

Figure 37:
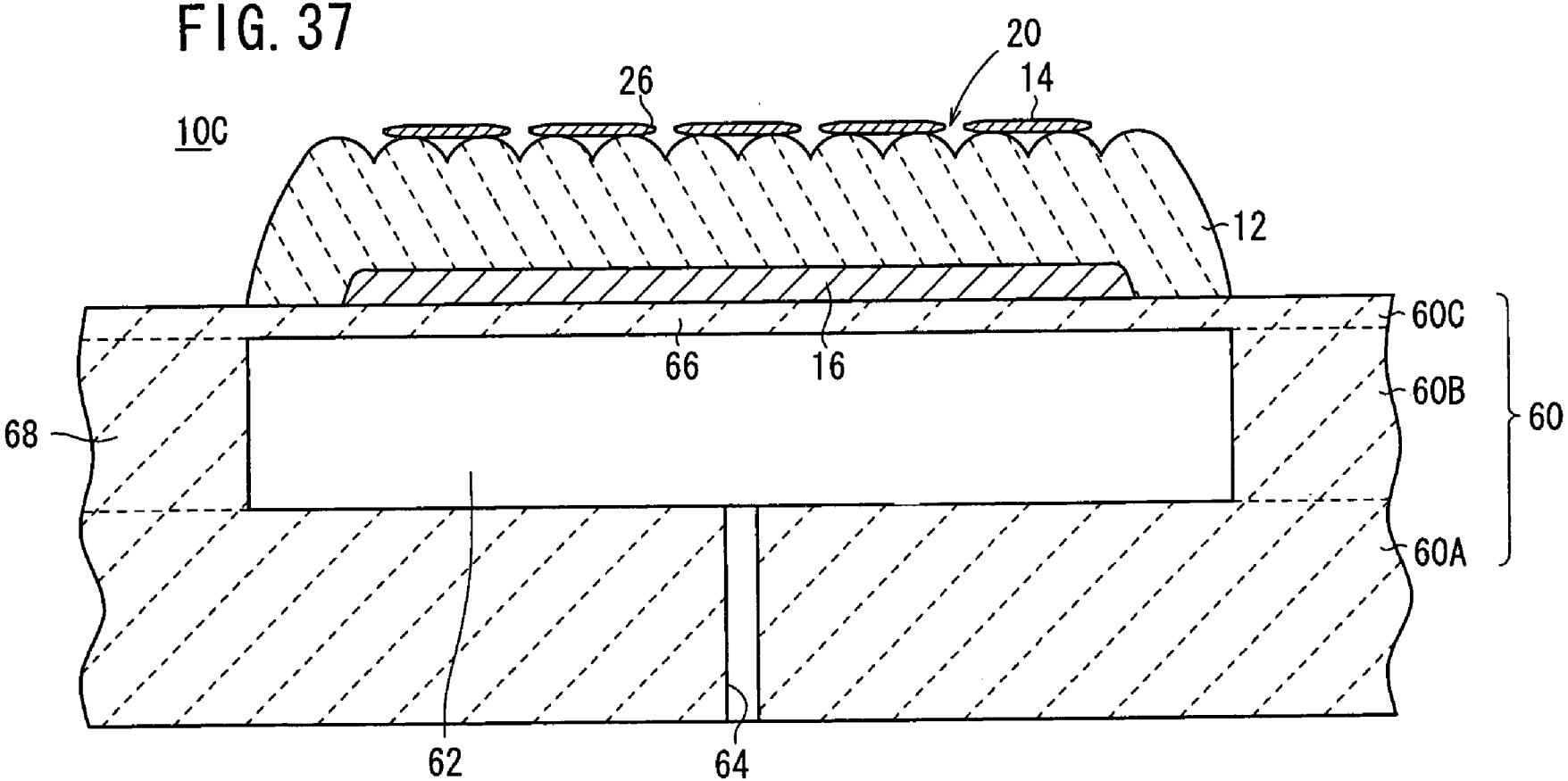
FIG. 37 is a fragmentary cross-sectional view of an electron emitter according to a third embodiment of the present invention.

As shown in FIG. 37, the electron emitter 10C according to the third embodiment has essentially the same structure as the electron emitter 10A according to the first embodiment described above, but differs therefrom in that it has a single substrate 60 of ceramics, a lower electrode 16 formed on the substrate 60, an emitter 12 formed on the substrate 60 in covering relation to the lower electrode 16, and an upper electrode 16 formed on the emitter 12.

The substrate 60 has a cavity 62 defined therein at a position aligned with the emitter 12 to form a thinned portion to be described below. The cavity 62 communicates with the exterior through a through hole 64 having a small diameter which is defined in the other end of the substrate 60 remote from the emitter 12.

The portion of the substrate 60 below which the cavity 62 is defined is thinned (hereinafter referred to as "thinned portion 66"). The other portion of the substrate 60 is thicker and functions as a stationary block 68 for supporting the thinned portion 66.

The substrate 60 comprises a laminated assembly of a substrate layer 60A as a lowermost layer, a spacer layer 60B as an intermediate layer, and a thin layer 60C as an uppermost layer. The laminated assembly may be regarded as an integral structure with the cavity 62 defined in the portion of the spacer layer 60B which is aligned with the emitter 12. The substrate layer 60A functions as a stiffening substrate and also as a wiring substrate. The substrate 60 may be formed by integrally baking the substrate layer 60A, the spacer layer 60B, and the thin layer 60C, or may be formed by bonding the substrate layer 60A, the spacer layer 60B, and the thin layer 60C together.

The thinned portion 66 should preferably be made of a highly heat-resistant material. The reason for this is that if the thinned portion 66 is directly supported by the stationary block 68 without using a heat-resistant material such as an organic adhesive or the like, the thinned portion 66 is not be modified at least when the emitter 12 is formed.

The thinned portion 66 should preferably be made of an electrically insulating material in order to electrically isolate interconnections connected to the upper electrode 14 formed on the substrate 60 and interconnections connected to the lower electrode 16 formed on the substrate 60.

The thinned portion 66 may thus be made of a material such as an enameled material where a highly heat-resistant metal or its surface is covered with a ceramic material such as glass or the like. However, ceramics is optimum as the material of the thinned portion 66.

The ceramics of the thinned portion 66 may be stabilized zirconium oxide, aluminum oxide, magnesium oxide, titanium oxide, spinel, mullite, aluminum nitride, silicon nitride, glass, or a mixture thereof. Of these materials, aluminum oxide and stabilized zirconium oxide are particularly preferable because they provide high mechanical strength and high rigidity. Stabilized zirconium oxide is particularly suitable because it has relatively high mechanical strength, relatively high tenacity, and causes a relatively small chemical reaction with the upper electrode 14 and the lower electrode 16. Stabilized zirconium oxide includes both stabilized zirconium oxide and partially stabilized zirconium oxide. Stabilized zirconium oxide does not cause a phase transition because it has a crystalline structure such as a cubic structure or the like.

Zirconium oxide causes a phase transition between a monoclinic structure and a tetragonal structure at about 1000° C., and may crack upon such a phase transition. Stabilized zirconium oxide contains 1-30 mol % of calcium oxide, magnesium oxide, yttrium oxide, scandium oxide, ytterbium oxide, cerium oxide, or an oxide of a rare earth metal. The stabilizer should preferably contain yttrium oxide for increasing the mechanical strength of the substrate 60. The stabilizer should preferably contain 1.5 to 6 mol % of yttrium oxide, or more preferably 2 to 4 mol % of yttrium oxide, and furthermore should preferably contain 0.1 to 5 mol % of aluminum oxide.

The crystalline phase of stabilized zirconium oxide may be a mixture of cubic and monoclinic systems, a mixture of tetragonal and monoclinic systems, or a mixture of cubic, tetragonal and monoclinic systems. Particularly, a mixture of cubic and monoclinic systems or a mixture of tetragonal and monoclinic systems is most preferable from the standpoint of strength, tenacity, and durability.

If the substrate 60 is made of ceramics, then it is constructed of relatively many crystal grains. In order to increase the mechanical strength of the substrate 60, the average diameter of the crystal grains should preferably be in the range from 0.05 μm to 2 μm and more preferably in the range from 0.1 μm to 1 μm.

The stationary block 68 should preferably be made of ceramics. The stationary block 68 may be made of ceramics which is the same as or different from the ceramics of the thinned portion 66. As with the material of the thinned portion 66, the ceramics of the stationary block 68 may be stabilized zirconium oxide, aluminum oxide, magnesium oxide, titanium oxide, spinel, mullite, aluminum nitride, silicon nitride, glass, or a mixture thereof.

The substrate 60 used in the electron emitter 10C is made of a material containing zirconium oxide as a chief component, a material containing aluminum oxide as a chief component, or a material containing a mixture of zirconium oxide and aluminum oxide as a chief component. Particularly preferable is a material chiefly containing zirconium oxide.

Clay or the like may be added as a sintering additive. Components of such a sintering additive need to be adjusted so that the sintering additive does not contain excessive amounts of materials which can easily be vitrified, e.g., silicon oxide, boron oxide, etc. This is because while these easily vitrifiable materials are advantageous in joining the substrate 60 to the emitter 12, they promote a reaction between the substrate 60 and the emitter 12, making it difficult to keep the desired composition of the emitter 12 and resulting in a reduction in the device characteristics.

Specifically, the easily vitrifiable materials such as silicon oxide in the substrate 60 should preferably be limited to 3% by weight or less or more preferably to 1% by weight or less. The chief component referred to above is a component which occurs at 50% by weight or more.

The thickness of the thinned portion 66 and the thickness of the emitter 12 should preferably be of substantially the same level. If the thickness of the thinned portion 66 were extremely larger than the thickness of the emitter 12 by at least ten times, then since the thinned portion 66 would work to prevent the emitter 12 from shrinking when it is baked, large stresses would be developed in the interface between the emitter 12 and the substrate 60, making the emitter 12 easy to peel off the substrate 60. If the thickness of the thinned portion 66 is substantially the same as the thickness of the emitter 12, the substrate 60 (the thinned portion 66) is easy to follow the emitter 12 as it shrinks when it is baked, allowing the substrate 60 and the emitter 12 to be appropriately combined with each other. Specifically, the thickness of the thinned portion 66 should preferably be in the range from 1 μm to 100 μm, more particularly in the range from 3 μm to 50 μm, and even more particularly in the range from 5 to 20 μm. The thickness of the emitter 12 should preferably be in the range from 5 μm to 100 μm, more particularly in the range from 5 μm to 50 μm, and even more particularly in the range from 5 μm to 30 μm.

The emitter 12 may be formed on the substrate 60 by any of various thick-film forming processes including screen printing, dipping, coating, electrophoresis, aerosol deposition, etc., or any of various thin-film forming processes including an ion beam process, sputtering, vacuum evaporation, ion plating, chemical vapor deposition (CVD), plating, etc. Particularly, it is preferable to form a powdery piezoelectric/electrostrictive material as the emitter 12 and impregnate the emitter 12 thus formed with glass of a low melting point or sol particles. According to this process, it is possible to form a film at a low temperature of 700° C. or lower, or 600° C. or lower.

The material of the lower electrode 16, the material of the emitter 12, and the material of the upper electrode 14 may be successively be stacked on the substrate 60, and then baked into an integral structure as the electron emitter 10C. Alternatively, each time the lower electrode 16, the emitter 12, or the upper electrode 14 is formed, the assembly may be heated (sintered) into an integral structure. Depending on how the upper electrode 14 and the lower electrode 16 are formed, however, the heating (sintering) process for producing an integral structure may not be required.

The sintering process for integrally combining the substrate 60 the emitter 12, the upper electrode 14, and the lower electrode 16 may be carried out at a temperature ranging from 500° to 1400° C., preferably from 1000° to 1400° C. For heating the emitter 12 which is in the form of a film, the emitter 12 should preferably be sintered together with its evaporation source while their atmosphere is being controlled, so that the composition of the emitter 12 will not become unstable at high temperatures.

The emitter 12 may be covered with a suitable member, and then sintered such that the surface of the emitter 12 will not be exposed directly to the sintering atmosphere. In this case, the covering member should preferably be of the same material as the substrate 60.

With the electron emitter 10C according to the third embodiment, the emitter 12 shrinks when baked. However, stresses produced when the emitter 12 shrinks are released when the cavity 62 is deformed, the emitter 12 can sufficiently be densified. The densification of the emitter 12 increases the withstand voltage and allows the emitter 12 to carry out the polarization inversion and the polarization change efficiently, resulting in improved characteristics of the electron emitter 10C.

Figure 38:
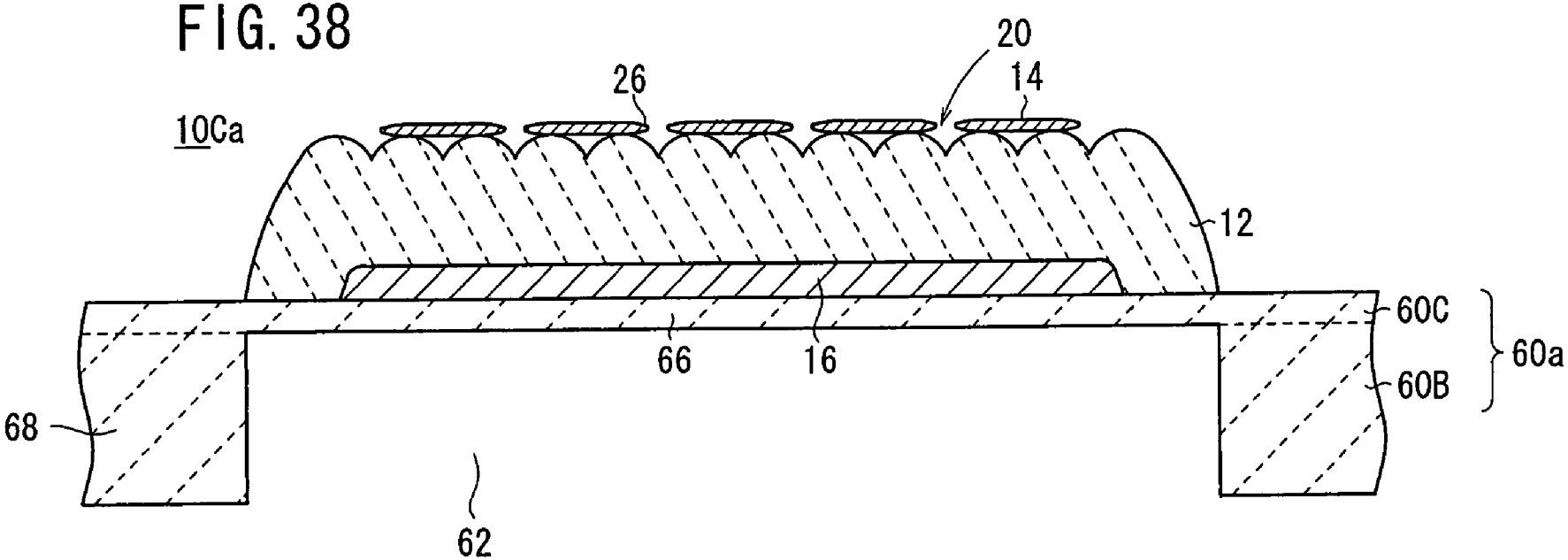
FIG. 38 is a fragmentary cross-sectional view of a first modification of the electron emitter according to the third embodiment.

According to the third embodiment, the substrate 60 comprises a three-layer substrate. FIG. 38 shows an electron emitter 10Ca according to a modification which has a two-layer substrate 60*a* which is free of the lowermost substrate layer 60A.

Figure 39:
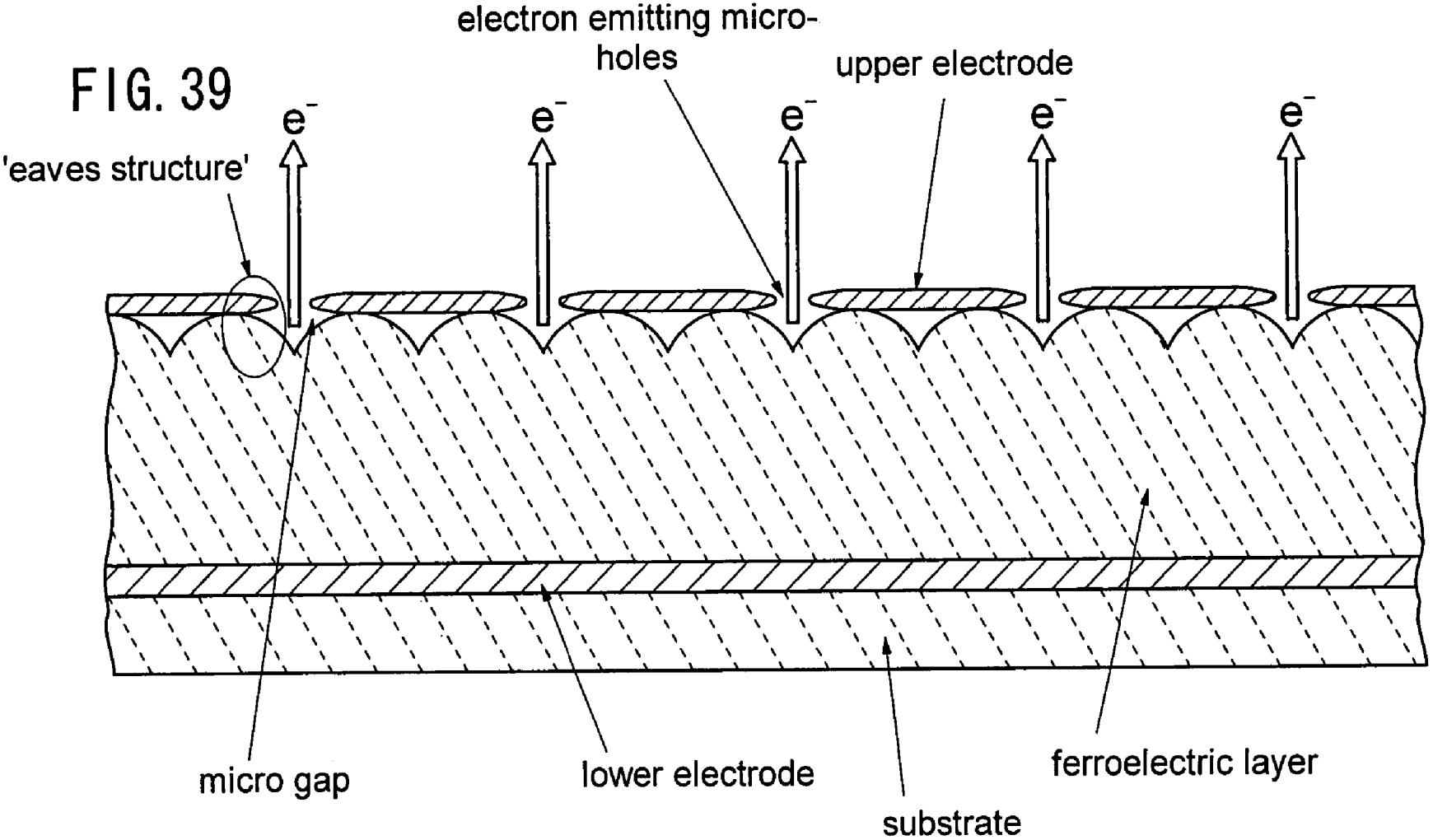
FIG. 39 is a fragmentary cross-sectional view showing a cross-sectional structure of an electron emission region of an electron emitter according to an inventive example.

An electron emitter 70 according to an inventive example as a test production sample will be described below with reference to FIGS. 39 to 50. FIG. 39 describes the section view of an electron emission region of the electron emitter 70 according to the inventive example.

The electron emitter has the sandwich structure which consists of lower electrode, ferroelectric layer and upper electrode. Over all the upper electrode, numerous electron emitting micro-holes (diameter: from 0.1 to 10 microns typically) are distributed in high density. These micro-holes expose the surfaces of the ferroelectric layer. Hereafter this surface is called an emitting surface. In order to make electron emission accompanied with memory function, charging by field effect and discharging by polarization reversal have to be operated in the micro-holes of the upper electrode.

For this purpose, we have developed 'eaves structure' of electron emitting portion. By this unique micro structure, we have successfully actualized electron emission accompanied with memory function.

The eaves structure of electron emitting portion is described as follows (see FIG. 39):

Micro gaps are formed between the upper electrodes and the emitting surfaces around the electron emitting micro-holes. By electric field concentrations in micro gaps, field emission can be performed to charge the emitting surfaces. Also, polarization reversal of the emitting surfaces can be performed by the electric field applied to the surrounding upper electrodes. In order to ensure the eaves structure, the preferable shape of the upper electrode is thin plate with sharp edges. We have successfully formed the upper electrodes and the micro-holes by thick film forming technique.

FIGS. 40 through 42C show an electron emission mechanism of the electron emitter 70. We have built up an electron emission model. The detail of the electron emission process accompanied with memory function is described as follows (see FIGS. 40 through 42C):

The electron emission process is composed of two steps. The first step is charging the emitting surfaces. The second step is electron emission from the emitting surfaces. As the initial state of the electron emitter, it is assumed that the ferroelectric layer has been already polarized and the negative poles of the dipoles emerge on the emitting surfaces.

1) The First Step (Charging the Emitting Surfaces)

By applying the electric field larger than the coercive electric field between upper and lower electrodes (upper electrode: negative pole, lower electrode: positive pole), polarization reversal of the ferroelectric layer is caused. At the moment, the positive poles of the dipoles emerge on the emitting surfaces. In the micro gaps the electric field concentrations occur because the gap length is small (typically less than 1 micron), the upper electrode has the sharp edges and the ferroelectric material has high dielectric constant. By the electric field concentrations, field emissions occur from the sharp edges of the upper electrodes and the emitting surfaces are charged with a large quantity of electrons at high speed.

Afterwards the electrons on the emitting surfaces of the ferroelectric layer are kept unless causing the polarization reversal. Then, even if applying the smaller electric field between upper and lower electrodes, these electrons on the emitting surfaces are stable. This means, the memory function is embedded in electron emitters.

2) The Second Step (Emitting the Electrons)

Next, the polarization reversal is caused by applying the larger electric field (upper electrode: positive pole, lower electrode: negative pole). The electrons on the emitting surfaces are expelled by the coulomb repelling power caused from the emerging negative poles of the dipoles. Because the large quantity of electrons are emitted in the vertical direction of the emitting surfaces, emission angle dispersion is small.

Figure 40:
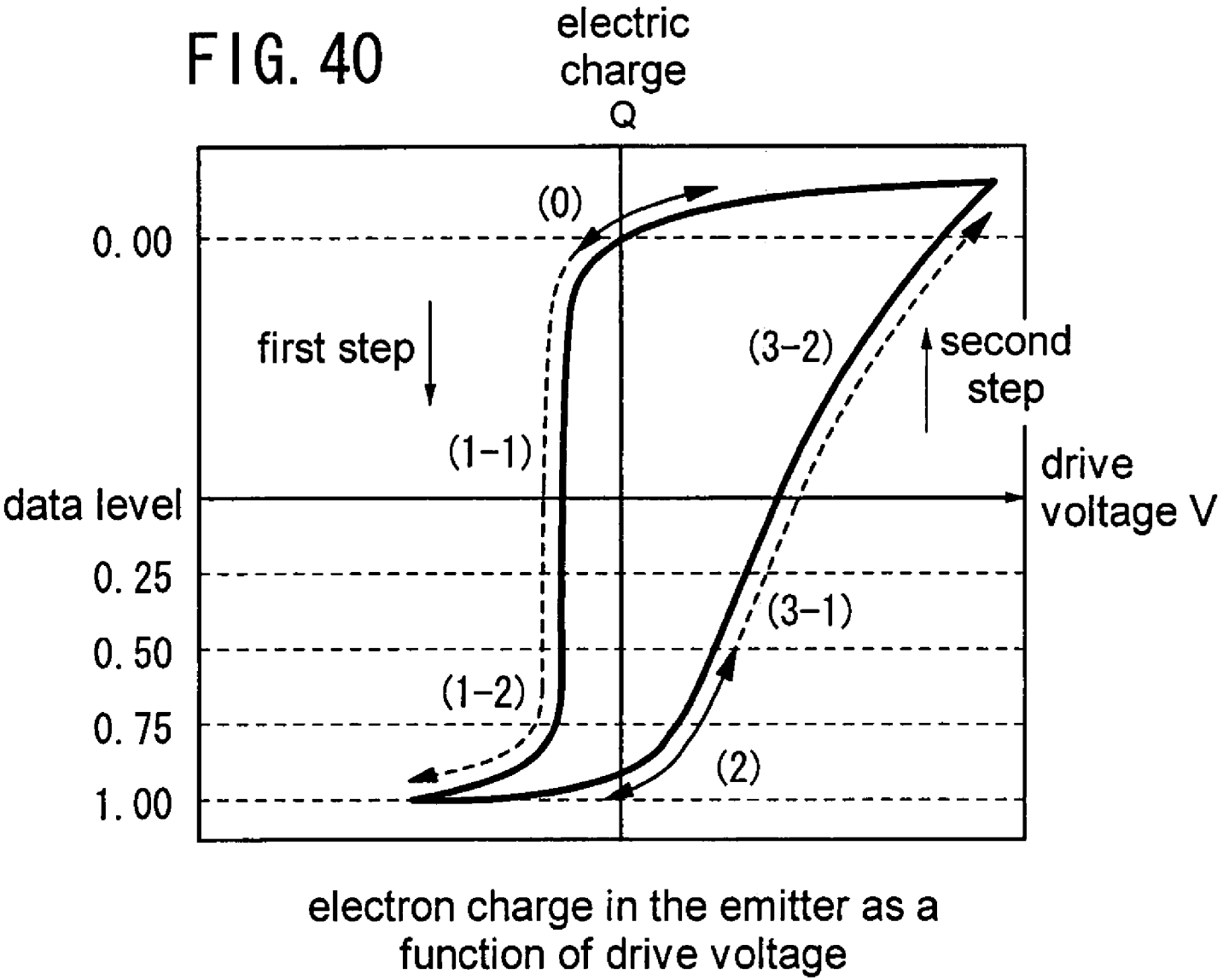
FIG. 40 is a diagram showing the voltage vs. charge quantity characteristics (voltage vs. polarized quantity characteristics) illustrative of the electron emission mechanism of the electron emitter according to the inventive example.
Figure 43:
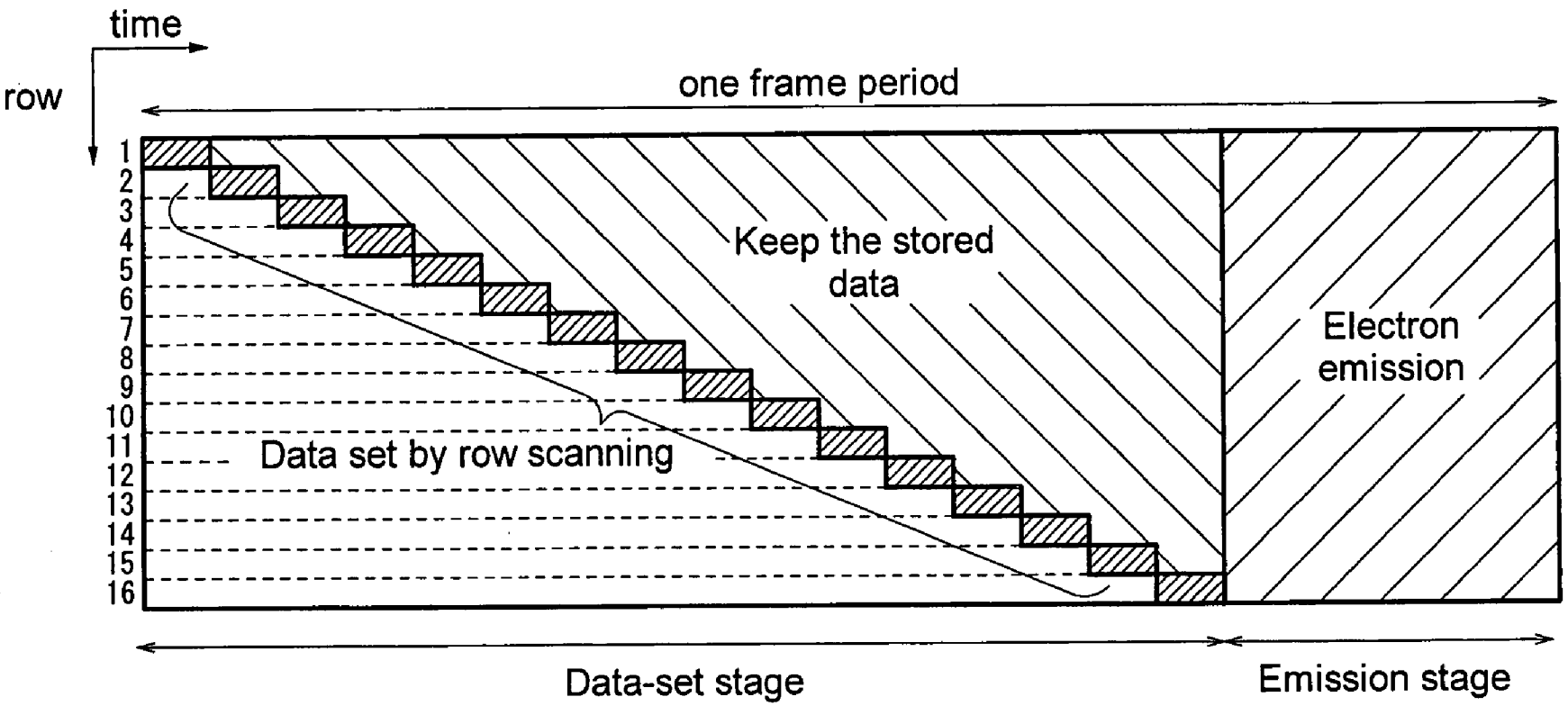
FIG. 43 is a timing chart of the driving process for the display.

FIG. 43 illustrates a driving process for a passive-matrix display 140 according to an inventive example based on the electron emission mechanism shown in FIG. 40. FIG. 43 shows the display 140 as a simple model having 16 rows to be scanned.

As shown in FIG. 43, one frame period (ex. 1/60 second) is divided into two stages. These are Data-set stage and Emission stage. Data-set stage is the first step of the electron emission process. We have confirmed that luminance can be controlled by the voltage applying between upper and lower electrodes. This means that the analog data can be written and stored in electron emitters. In this stage, the sequential row selection and the data setting for the electron emitters (the pixels) in the selected row are performed to the passive matrix display panel. In Data-set stage, there are no light emissions from the display panel. Emission stage is the second step of the electron emission process. In Emission stage, the image is displayed from all pixels simultaneously. We have confirmed that the single voltage level can be available to emit electrons proportional to the gray scale level. Then the only one discrete transistor can be available to emit electrons from all the electron emitters (i.e. all the pixels) simultaneously and the driver IC which has multiple outputs is not necessary. These two stages are independently assigned in one frame period. This means, in Data-set stage the high speed row scanning can be performed in the same way as the data-set into FeRAM and the period of Emission stage can be reserved independently of the resolution (i.e. the number of the duty cycle).

Figure 44:
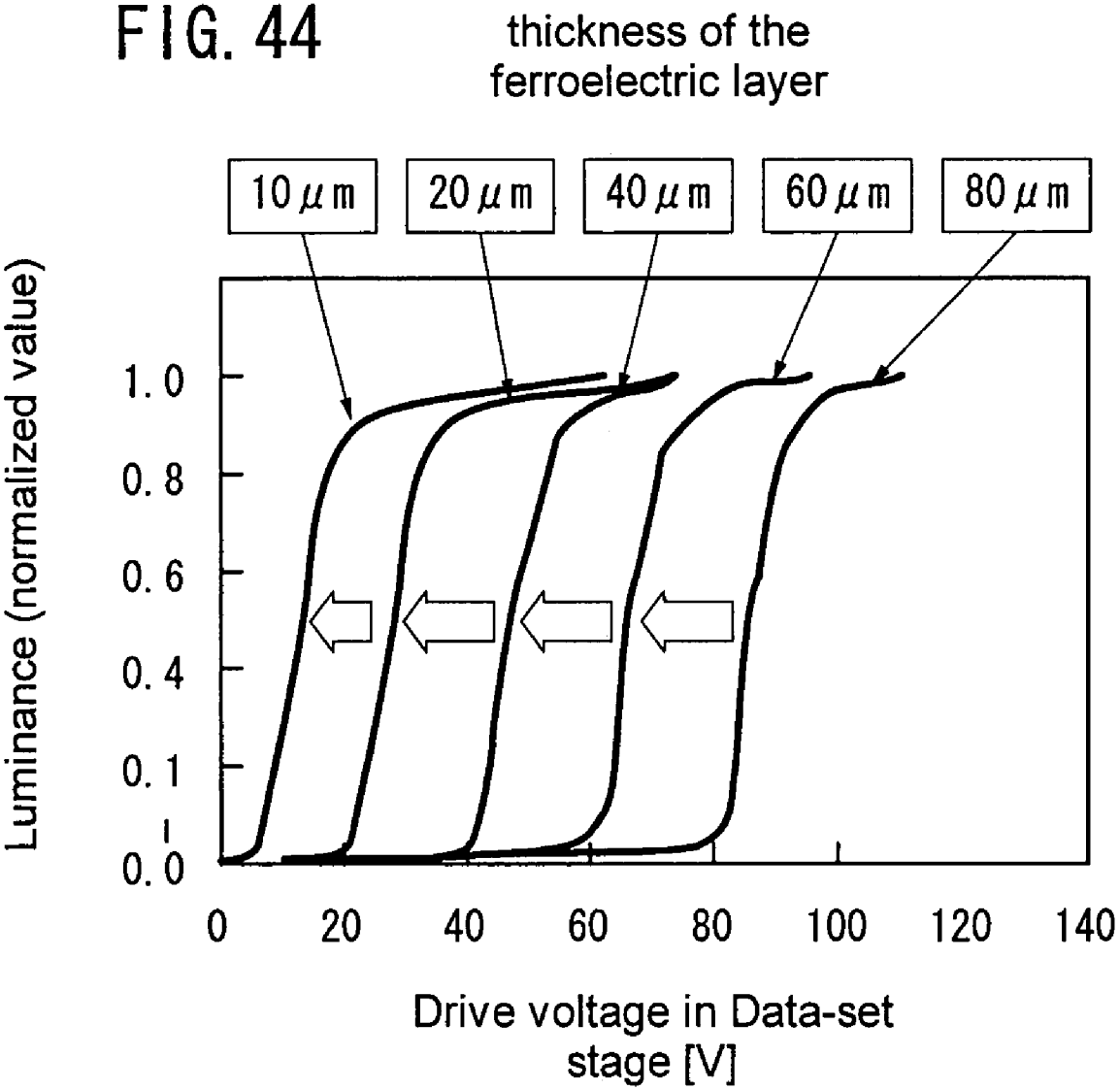
FIG. 44 is a diagram showing the relationship between the drive voltage applied when data are set and the light emission luminance.

FIG. 44 shows the luminance as a function of the drive voltage in Data-set stage. The voltage level has the strong relationship with the thickness of the ferroelectric layer. Then we estimate the voltage less than 10V is available under the condition of the thickness less than 10 microns.

Figure 45:
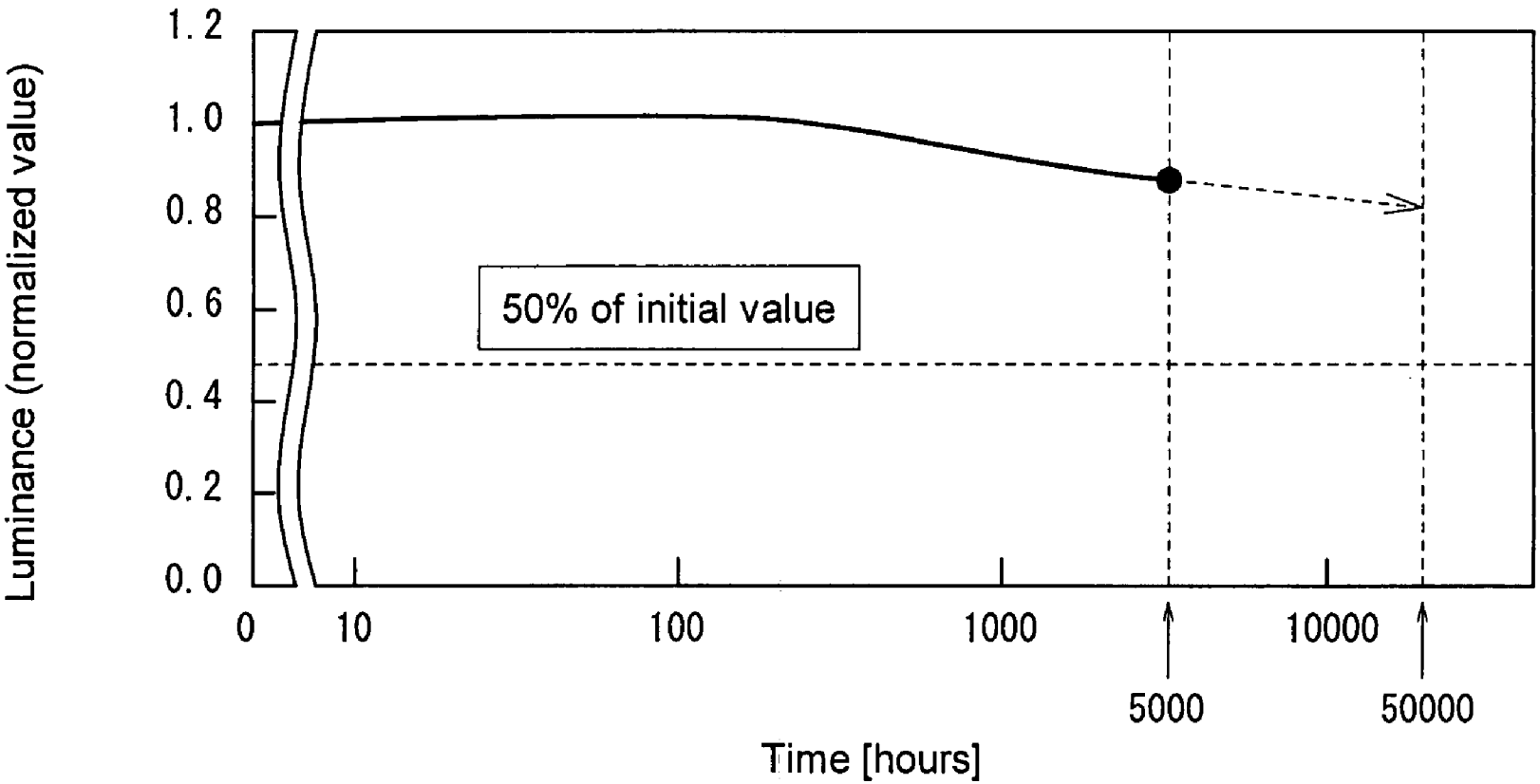
FIG. 45 is a diagram showing the life (light emission endurance) of the electron emitter according to the inventive example.

We are evaluating the emission life of the Field effect-Ferroelectric electron emitters (see FIG. 45). We have confirmed that the luminance after 5,000 hours is 90% of the initial value. Also, we estimate that the luminance after 50,000 hours will be still larger than 80% of the initial value.

We have built up the prototype display panel of diode structure with 0.6 mm-pitch pixels. Table 1 (see FIG. 46) shows the performance of 4.3 inch prototype display.

Figure 47:
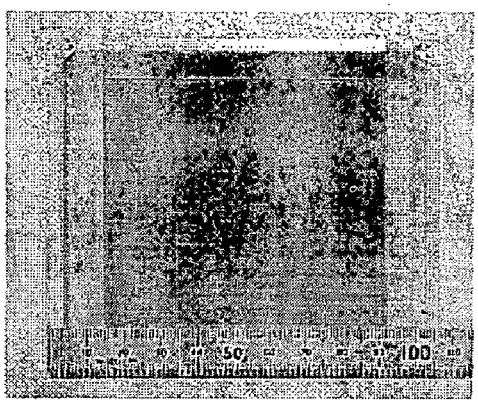
FIG. 47 is a photographic representation of the appearance of a display area of the display according to the inventive example.
Figure 48:
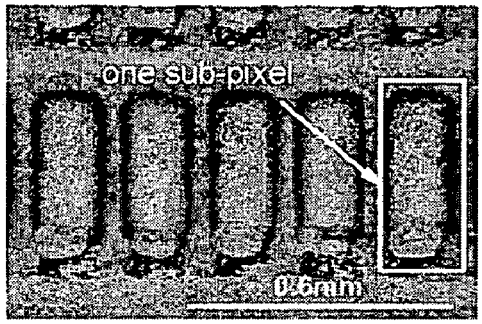
FIG. 48 is an enlarged photographic representation of electron emitters.
Figure 49:
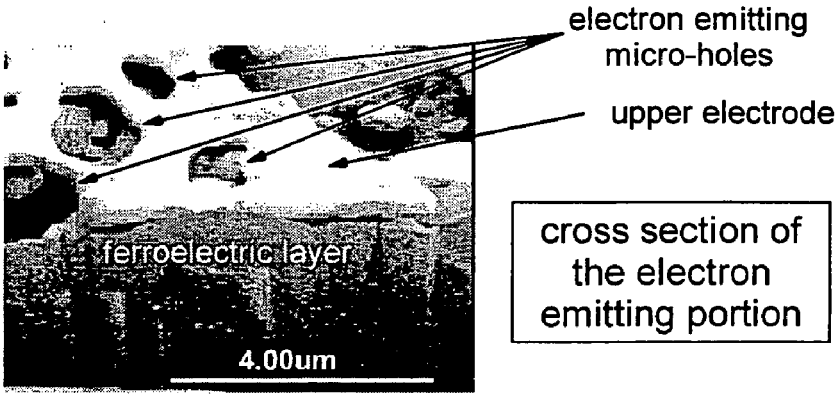
FIG. 49 is an electron microscopy photographic representation of an upper electrode and an emitter of the electron emitter.

FIG. 47 is a photographic representation of the appearance of a display area, comprising an array of electron emitters, of the display 140 according to the inventive example. FIG. 48 is an enlarged photographic representation of electron emitters. FIG. 49 is an electron microscopy photographic representation of the upper electrode 14 and the emitter 12.

The display 140 has 128 pixels (at a pitch of 0.6 mm) arrayed in a row direction and 128×3 colors=384 pixels (at a pitch of 0.2 mm) arrayed in a column direction. Three electron emitters make up one pixel. It can be seen from FIG. 49 that an overhanging structure is provided by a thick-film platinum resinate electrode.

Figure 50:
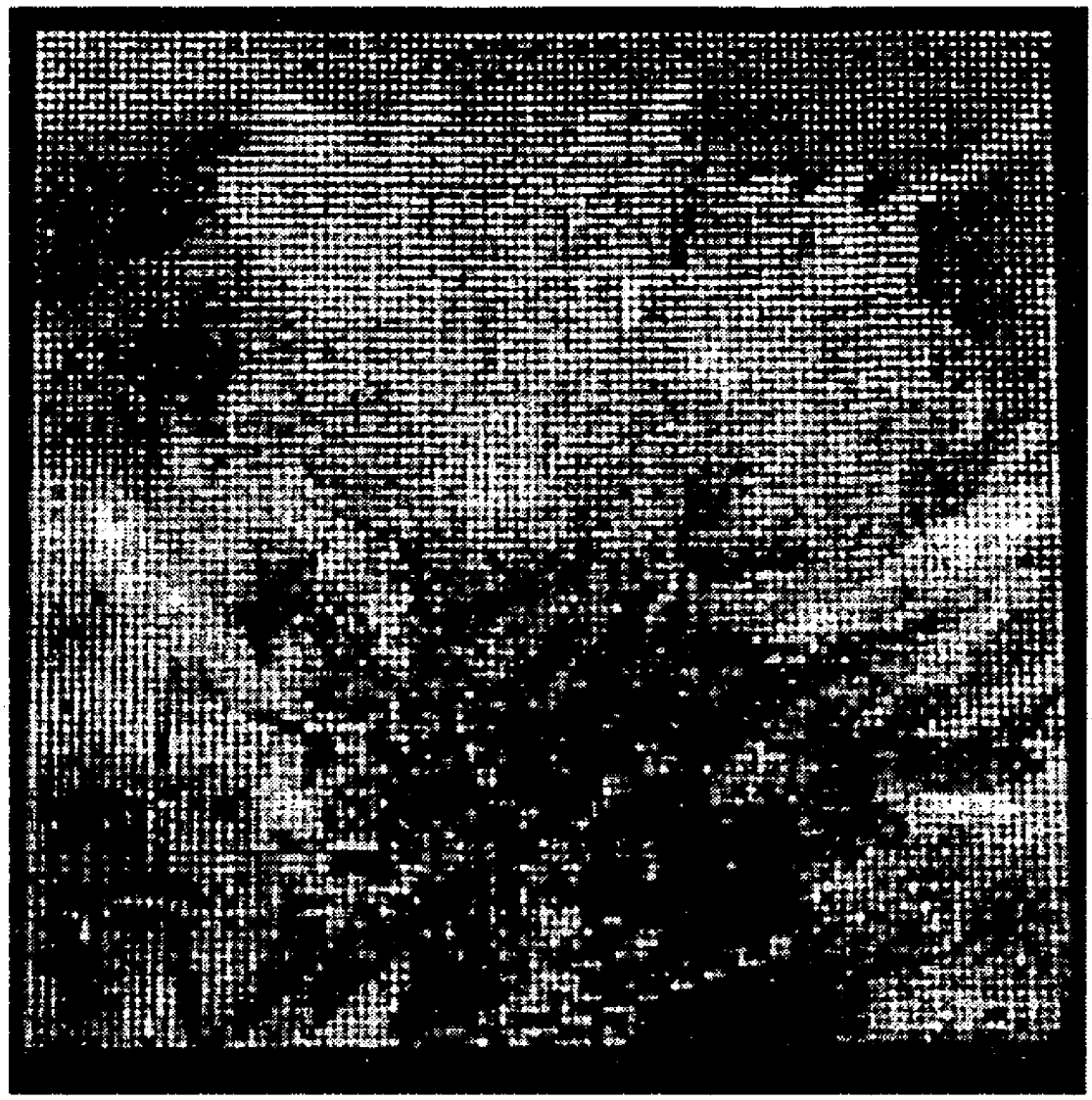
FIG. 50 is a photographic representation of a still image captured at an instant while a moving image is being displayed on the panel of the display according to the inventive example.
Figure 51:
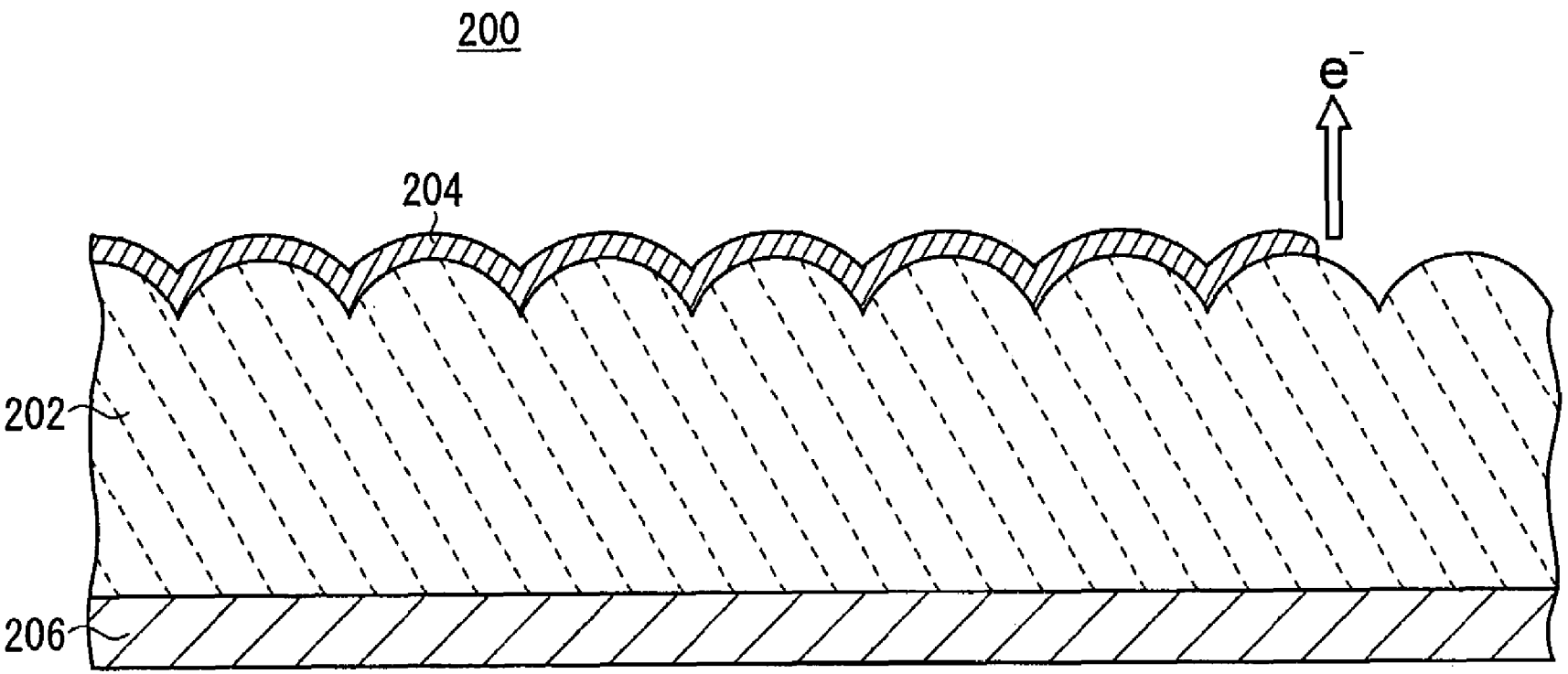
FIG. 51 is a fragmentary cross-sectional view of a conventional electron emitter.

We have confirmed that the color moving image with 128 gray scales per color by the memory driving method (see FIG. 50). Owing to the small emission angle dispersion, we have confirmed that the color moving image can be displayed without the extra electrodes to focus electron beams.

Although certain preferred embodiments of the present invention have been shown and described in detail, it should be understood that various changes and modifications may be made therein without departing from the scope of the appended claims.

What is claimed is:

1. An electron emitter comprising:

an emitter made of a dielectric material; and a first electrode and a second electrode for being supplied with a drive voltage for emitting electrons;

said first electrode being disposed on a first surface of said emitter;

said second electrode being disposed on a second surface of said emitter;

at least said first electrode having a plurality of through regions through which said emitter is exposed;

wherein electrons are emitted from said first electrode toward said emitter to charge the emitter in a first stage, and electrons are emitted from said emitter in a second stage, and wherein said first electrode comprises at least one of a cluster of a plurality of scale-like members and a cluster of electrically conductive members including the scale-like members, and only a part of said cluster covers and contacts said first surface of said emitter.

2. An electron emitter according to claim 1, wherein said first electrode has said through regions through which said emitter is exposed, each of said through regions of said first electrode having a peripheral portion having a surface facing said emitter, said surface being spaced from said emitter.

3. An electron emitter according to claim 1, wherein the electrons, which depend on an amount of charge stored in said emitter in said first stage, are emitted from said emitter in said second stage.

4. An electron emitter according to claim 1, wherein said amount of charge stored in said emitter in said first stage is maintained until the electrons are emitted from said emitter in said second stage.

5. An electron emitter according to claim 1, wherein a voltage applied in one direction between said first electrode and said second electrode to invert polarization in one direction of said emitter in said first stage is referred to as a first coercive voltage v1, and a voltage applied in an opposite direction between said first electrode and said second electrode to change polarization of said emitter back to said one direction in said second stage is referred to as a second coercive voltage v2, said first coercive voltage v1 and said second coercive voltage v2 satisfying the following relationship:

$$v1<0 \text{and } v2>, \text{ and}$$

$$|v1|<|v2|.$$

6. An electron emitter according to claim 1, wherein at least said first surface of said emitter has surface irregularities due to the grain boundary of the dielectric material, said first electrode having said through regions in areas corresponding to concavities of the surface irregularities due to the grain boundary of the dielectric material.

* * * * *

UNITED STATES PATENT AND TRADEMARK OFFICE

CERTIFICATE OF CORRECTION

PATENT NO. : 7,336,026 B2
APPLICATION NO. : 10/950976
DATED : February 26, 2008
INVENTOR(S) : Yukihisa Takeuchi et al.

It is certified that error appears in the above-identified patent and that said Letters Patent is hereby corrected as shown below:

Title Page, Other Publications: Item 56

*Please change* "U.S. Appl. No. 10/979,747, filed Aug. 17, 2004, Takeuchi et al." to --U.S. Appl. No. 10/919,747, filed Aug. 17, 2004, Takeuchi et al.--

Column 34

*Line 4*: please change "v1<0 and v2>, and" to --v1 < 0 and v2 > 0, and--

Signed and Sealed this

Eighth Day of July, 2008

JON W. DUDAS
*Director of the United States Patent and Trademark Office*